United States Patent [19]

Sawayama et al.

[11] Patent Number: 4,901,113

[45] Date of Patent: Feb. 13, 1990

[54] IMAGE-FORMING DEVICE

[75] Inventors: Noboru Sawayama, Tokyo; Shinichi Kamiyama, Yokohama; Hideo Yuh, Tama; Masayuki Takashima, Yokohama; Tadayuki Sekiya, Ichikawa, all of Japan

[73] Assignee: Ricoh Company, Ltd., Tokyo, Japan

[21] Appl. No.: 263,366

[22] Filed: Oct. 27, 1988

Related U.S. Application Data

[62] Division of Ser. No. 73,480, Jul. 15, 1987.

[30] Foreign Application Priority Data

Jul. 15, 1986 [JP] Japan ..... 61-164831
Jul. 15, 1986 [JP] Japan ..... 61-164832

[51] Int. Cl.[4] ..... G03G 15/00

[52] U.S. Cl. ..... 355/243; 355/55; 355/60; 355/235

[58] Field of Search ..... 355/243, 233, 235, 55, 355/56, 57, 60

[56] References Cited

U.S. PATENT DOCUMENTS

| | | | |
|---|---|---|---|
| 4,139,298 | 2/1979 | Tani | 355/243 X |
| 4,362,382 | 7/1982 | Simpson | 355/243 X |
| 4,591,261 | 5/1986 | Saruwatari et al. | 355/326 X |
| 4,605,299 | 8/1986 | Mochimaru | 355/260 X |
| 4,609,276 | 9/1986 | Mitzutani | 355/260 X |
| 4,619,518 | 10/1986 | Kameyama et al. | 355/326 X |
| 4,711,553 | 12/1987 | Watanabe | 355/326 X |
| 4,714,941 | 12/1987 | Yamagishi et al. | 355/243 |
| 4,720,730 | 1/1988 | Ito | 355/326 X |
| 4,743,944 | 5/1988 | Tomosada et al. | 355/218 |
| 4,752,809 | 6/1988 | Ito | 355/218 |

FOREIGN PATENT DOCUMENTS

| | | |
|---|---|---|
| 60-222875 | 11/1985 | Japan . |
| 61-109074 | 5/1986 | Japan . |
| 61-137172 | 6/1986 | Japan . |

*Primary Examiner*—A. C. Prescott
*Attorney, Agent, or Firm*—Oblon, Spivak, McClelland, Maier & Neustadt

[57] ABSTRACT

An image forming device having a mechanism for conducting variable magnification by moving a mirror, and lenses, which includes an optical system having six mirrors and a mechanism for moving the fourth mirror and the fifth mirror which are disposed behind the lenses.

3 Claims, 51 Drawing Sheets

| | A3 | B4 | A4 | A4R | B5 | B5R | A5 | A5R | B6 | B6R |
|---|---|---|---|---|---|---|---|---|---|---|
| 1 | ● | ● | ○ | ● | ○ | ● | ○ | ● | ○ | ● |
| 2 | ○ | ● | ○ | ○ | ● | ● | ○ | ○ | ● | ● |
| 3 | ○ | ○ | ● | ● | ● | ● | ○ | ○ | ○ | ○ |
| 4 | ○ | ○ | ○ | ○ | ○ | ○ | ● | ● | ● | ● |
| 5 | ○ | ○ | ○ | ○ | ○ | ○ | ○ | ○ | ○ | ○ |

ADF
EDITOR
E C D
MONITOR FOR DEBUG
COUNTER
SWITCH MATRIX
DISPLAY CIRCUIT
MODE CONTROL
SEQUENCE CONTROL
TIMER
INTERRUPTION
EDITOR COMMUNICATION
MONITOR COMMUNICATION
I/O COMMUNICATION
TxD
RxD
iNT2
NMi
A/D
ERASER
ADS
P SENSOR
SETTING OF DESIRED VALUE

Fig.39 (ii)

| Fig.39 (i) | Fig.39 (ii) |
|---|---|

| Fig.40 (i) | Fig.40 (ii) | Fig.40 (iii) |
|---|---|---|

(ii)

(iii)

| Fig.40 (i) | Fig.40 (ii) | Fig.40 (iii) |
|---|---|---|

| Fig. 41 (i) | Fig. 41 (ii) | Fig. 41 (iii) |
|---|---|---|

Fig. 41 (ii)
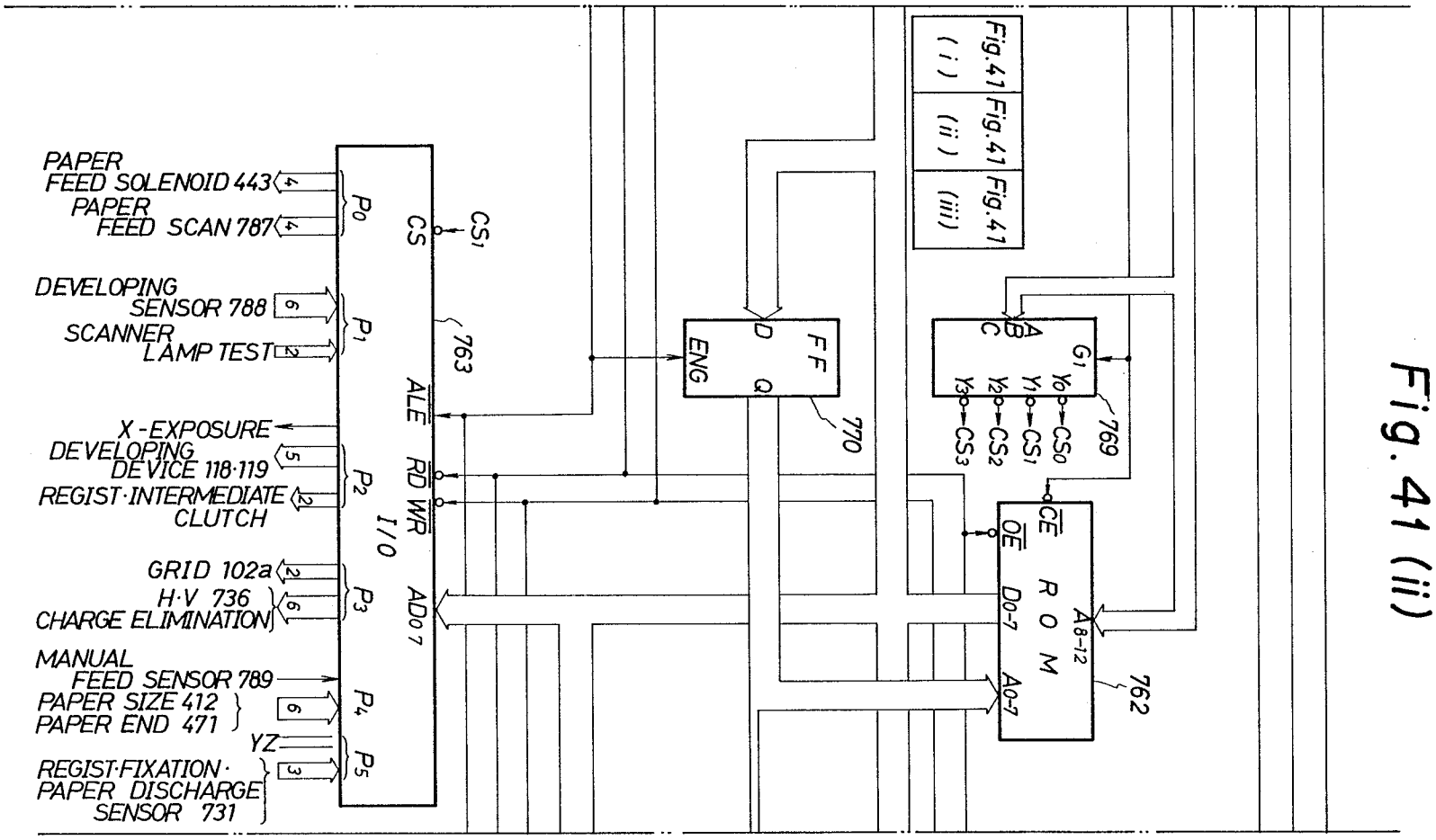

Fig.41(iii)
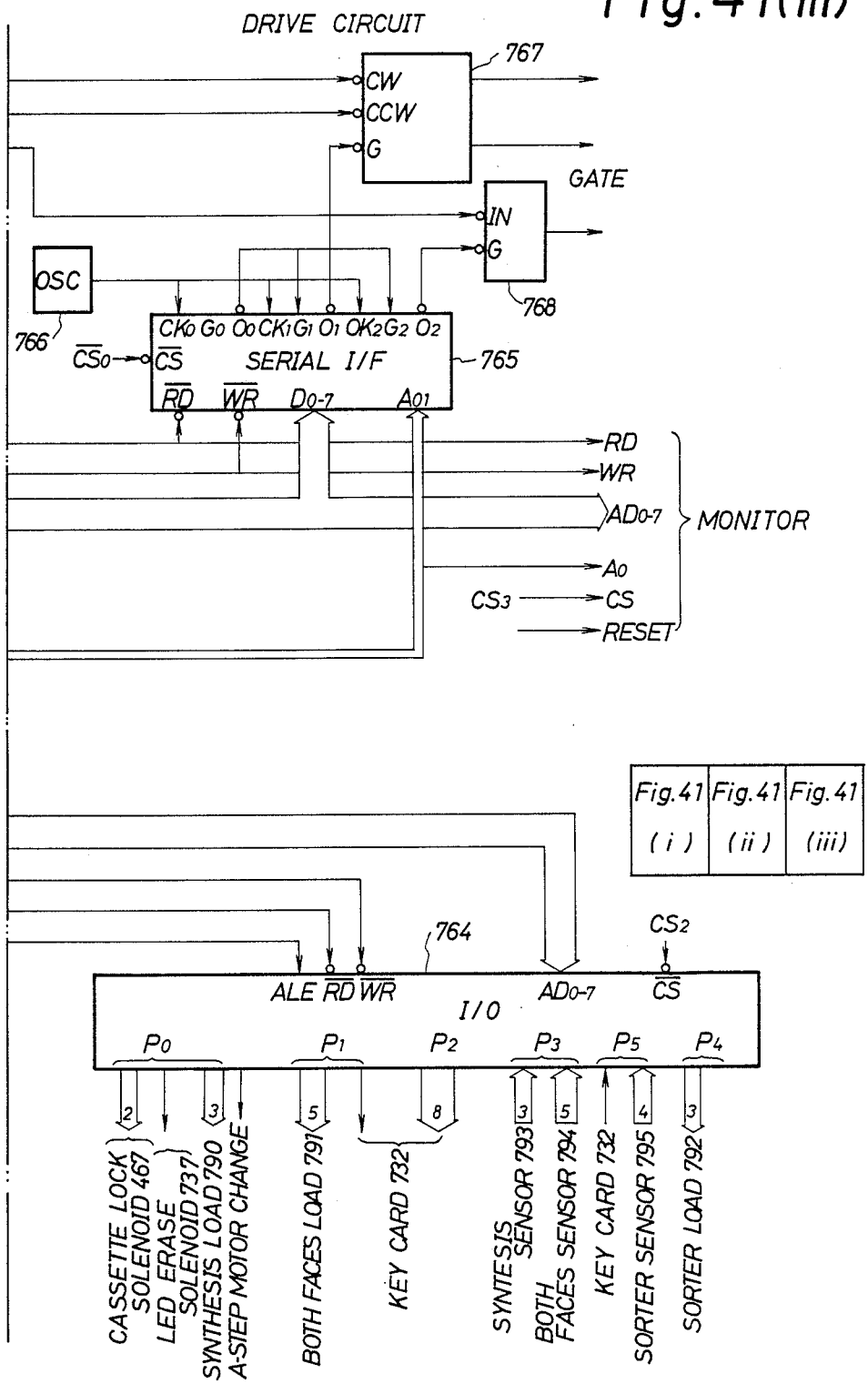

| Fig. 42 (i) | Fig. 42 (ii) |
|---|---|

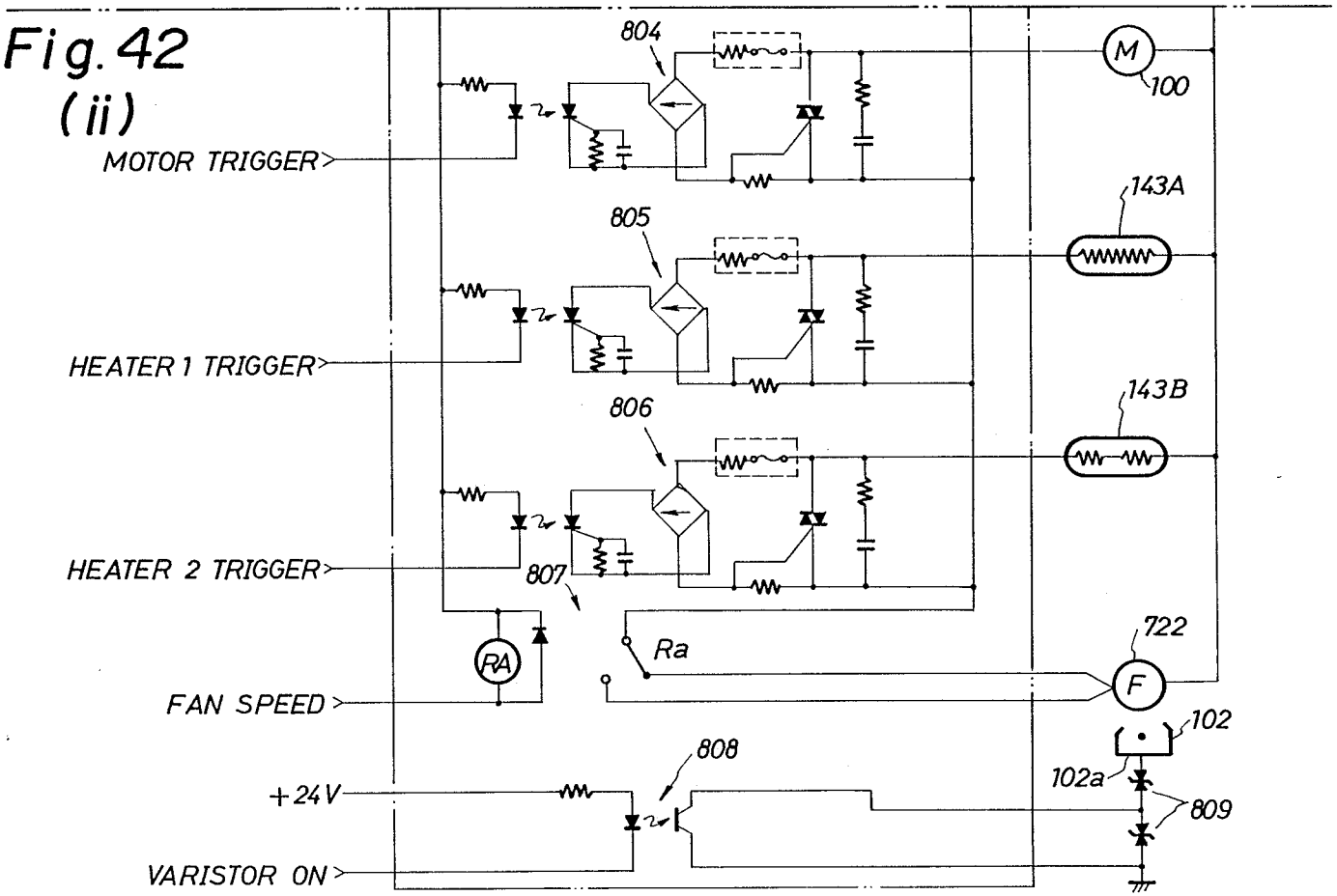
Fig. 42 (ii)
| Fig. 42 (i) | Fig. 42 (ii) |
|---|---|

| Fig.43 (i) | Fig.43 (ii) |
|---|---|

Fig.43 (ii)
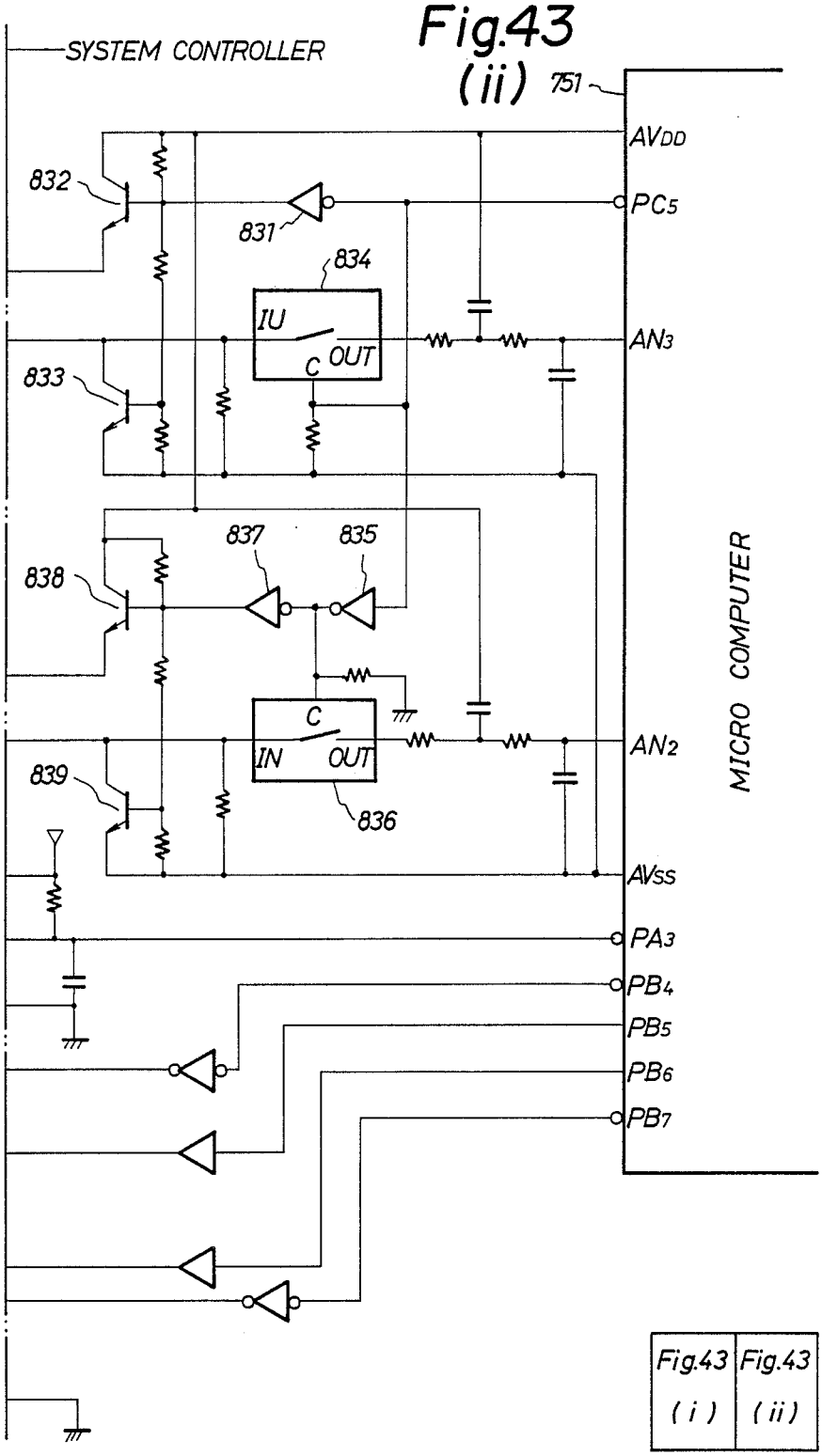
| Fig.43 (i) | Fig.43 (ii) |
|---|---|

Fig. 48

| CASSETTE SIZE | 1 | 2 | 3 | 4 | 5 | 6 | 7 | 8 | 9 | 10 | 11 | 12 |
|---|---|---|---|---|---|---|---|---|---|---|---|---|
| A3 | 0 | 0 | 0 | 0 | 0 | 0 | 0 | 0 | 0 | 0 | 0 | 0 |
| B4 | 1 | 1 | 1 | 0 | 0 | 0 | 0 | 0 | 0 | 0 | 0 | 0 |
| A4 | 0 | 0 | 0 | 0 | 0 | 0 | 0 | 0 | 0 | 0 | 0 | 0 |
| A4R | 1 | 1 | 1 | 1 | 1 | 1 | 0 | 0 | 0 | 0 | 0 | 0 |
| B5 | 1 | 1 | 1 | 0 | 0 | 0 | 0 | 0 | 0 | 0 | 0 | 0 |
| B5R | 1 | 1 | 1 | 1 | 1 | 1 | 1 | 1 | 0 | 0 | 0 | 0 |
| A5 | 1 | 1 | 1 | 1 | 1 | 1 | 0 | 0 | 0 | 0 | 0 | 0 |
| A5R | 1 | 1 | 1 | 1 | 1 | 1 | 1 | 1 | 1 | 1 | 1 | 0 |
| B6 | 1 | 1 | 1 | 1 | 1 | 1 | 1 | 1 | 0 | 0 | 0 | 0 |
| B6R | 1 | 1 | 1 | 1 | 1 | 1 | 1 | 1 | 1 | 1 | 1 | 0 |
| MANNUAL FEED | 0 | 0 | 0 | 0 | 0 | 0 | 0 | 0 | 0 | 0 | 0 | 0 |

Fig. 49

| MAGNIFICATION (%) | 1 | 2 | 3 | 4 | 5 | 6 | 7 | 8 | 9 | 10 | 11 | 12 |
|---|---|---|---|---|---|---|---|---|---|---|---|---|
| 50 ~ 51 | 1 | 1 | 1 | 1 | 1 | 1 | 1 | 1 | 1 | 1 | 1 | 0 |
| 52 ~ 55 | 1 | 1 | 1 | 1 | 1 | 1 | 1 | 1 | 1 | 1 | 0 | 0 |
| 56 ~ 58 | 1 | 1 | 1 | 1 | 1 | 1 | 1 | 1 | 1 | 0 | 0 | 0 |
| 59 ~ 62 | 1 | 1 | 1 | 1 | 1 | 1 | 1 | 1 | 0 | 0 | 0 | 0 |
| 63 ~ 67 | 1 | 1 | 1 | 1 | 1 | 1 | 1 | 0 | 0 | 0 | 0 | 0 |
| 68 ~ 72 | 1 | 1 | 1 | 1 | 1 | 1 | 0 | 0 | 0 | 0 | 0 | 0 |
| 73 ~ 77 | 1 | 1 | 1 | 1 | 1 | 0 | 0 | 0 | 0 | 0 | 0 | 0 |
| 78 ~ 82 | 1 | 1 | 1 | 1 | 0 | 0 | 0 | 0 | 0 | 0 | 0 | 0 |
| 83 ~ 88 | 1 | 1 | 1 | 0 | 0 | 0 | 0 | 0 | 0 | 0 | 0 | 0 |
| 89 ~ 93 | 1 | 1 | 0 | 0 | 0 | 0 | 0 | 0 | 0 | 0 | 0 | 0 |
| 94 ~ 96 | 1 | 0 | 0 | 0 | 0 | 0 | 0 | 0 | 0 | 0 | 0 | 0 |
| OVER 97 | 0 | 0 | 0 | 0 | 0 | 0 | 0 | 0 | 0 | 0 | 0 | 0 |

(IN DENSITY CONTROL MODE)

Fig. 53

| No | SEL 4 | SEL 3 | SEL 2 | SEL 1 | OUT (V) PUT | NOTCH | ADS |
|---|---|---|---|---|---|---|---|
| 1 | 0 | 0 | 0 | 1 | 200 | | |
| 2 | 0 | 0 | 1 | 0 | 230 | | |
| 3 | 0 | 0 | 1 | 1 | 260 | 3~6 | 2.6~ |
| 4 | 0 | 1 | 0 | 0 | 290 | 2 | |
| 5 | 0 | 1 | 0 | 1 | 320 | 1,7 | 2.16~2.6 |
| 6 | 0 | 1 | 1 | 0 | 350 | | |
| 7 | 0 | 1 | 1 | 1 | 380 | | 1.65~2.16 |
| 8 | 1 | 0 | 0 | 0 | 410 | | |
| 9 | 1 | 0 | 0 | 1 | 440 | | ~1.65 |
| 10 | 1 | 0 | 1 | 0 | 470 | | |
| 11 | 1 | 0 | 1 | 1 | 500 | | |
| 12 | 1 | 1 | 0 | 0 | 530 | | |
| 13 | 1 | 1 | 0 | 1 | 560 | | |
| 14 | 1 | 1 | 1 | 0 | 590 | | |
| 15 | 1 | 1 | 1 | 1 | 620 | | |
| 16 | 0 | 0 | 0 | 0 | 0 | | |

IMAGE-FORMING DEVICE

This is a division of application Ser. No. 07/073,480, filed July 15, 1987.

BACKGROUND OF THE INVENTION

1. Field of the Invention

The present invention concerns an image-forming device such as an electrophotographic apparatus, etc.

2. Discussion of the Background

Image-forming device having a mechanism which varies the magnification ratio by moving mirrors and lenses is generally known. In such an image-forming device, the optical system comprises four mirrors including first through fourth mirrors which are arranged from the side of an original to the side of photosensitive material, for example, in the order of a first mirror, second mirror, third mirror, through lens, fourth mirror, or in the order of the first mirror, second mirror, through lens, third mirror and fourth mirror.

Upon varying the magnification ratio, the optical distance between the original and the through lens and the optical distance between the through lens and the photosensitive material are changed by moving the through lens. Since the optical distance between the original and a drum has to be increased upon varying the magnification ratio, it has been adapted to move the second and the third mirrors in a device where these second and third mirrors are arranged ahead of the through lens, or to move the third and fourth mirrors interlocking with the movement of the through lens in a device where these third and fourth mirrors are arranged behind the through lens.

However, the mechanism is complicated in the system which moves the second and the third mirrors, particularly, when a both sides driving system is employed. Further, the interlocking moving mechanism is also complicated in the system which interlocks the third and the fourth mirrors with the movement of the through lens.

Further, an image-forming device such as an electrophotographic copying apparatus or laser printer, has a developing device adapted to deposit toners onto electrostatic latent images formed on a photosensitive material for visualizing them. In such a device, a toner hopper is disposed in an upper portion and toners are successively supplied from the toner hopper.

In a conventional image-forming device, which conducts two color reproduction, for example black and red, quite identical developing devices have been used for developing black color and developing red color except for merely changing the color of the toners contained in the toner hopper.

However, since quite identical devices have been used for the black color developing device and the red color developing device and their toner hoppers are disposed above the image-forming device, the space occupied by the developing section in the direction of the height is particularly increased to thereby enlarge the size of the image-forming device.

SUMMARY OF THE INVENTION

The present invention has been made in view of the foregoing and the first object thereof is to reduce the size of the image-forming device.

The second object of the present invention is to simplify the mechanism for varying the magnification ratio.

The first object of the present invention can be attained by an image-forming device having mechanism for conducting variable magnification by moving mirrors and lenses, which comprises an optical system constituted with a first through sixth mirror and a mechanism for moving the fourth mirror and the fifth mirror disposed behind the lenses.

The second object of the present invention can be attained by an image-forming device having a black color developing device and a color developing device, which comprises a first toner hopper for containing black toners for use in said black color developing device and a second toner hopper for containing color toners for use in said color developing device, a configuration of said first toner hopper being different from that of said second toner hopper.

The first feature of the present invention is that the mechanism for correcting the path upon varying the magnification ratio (correction for changing the distance between the original and the photosensitive material) can be simplified and the path correction can be made accurately by constituting the optical system with six mirrors and disposing a mirror moving mechanism for moving the fourth mirror and the fifth mirror for varying the magnification ratio (magnification and reduction).

The second feature of the present invention is that the space occupied by a developing device, particularly, the space in the direction of height can be reduced to thereby reduce the size of an image-forming device compared with the case where the toner hopper of the color developing device is made identical with the shape of the toner hopper of the black color developing device, by making the diameter of the developing sleeve of the color developing device smaller than the diameter of the developing sleeve of the black color developing device, and making the shape of the toner hopper for the color developing device different from that of the toner hopper for the black color developing device and disposing the toner hopper for the color developing device at the flank of the photosensitive drum thereby reducing the height of the developing device itself.

BRIEF DESCRIPTION OF THE DRAWINGS

Explanation will be made to a preferred embodiment according to the present invention while referring to the drawings, wherein

FIGS. 44 through 55 are explanatory views for explaining the operation of each of the portions in the copying apparatus.

DESCRIPTION OF THE PREFERRED EMBODIMENTS

Figure 1:
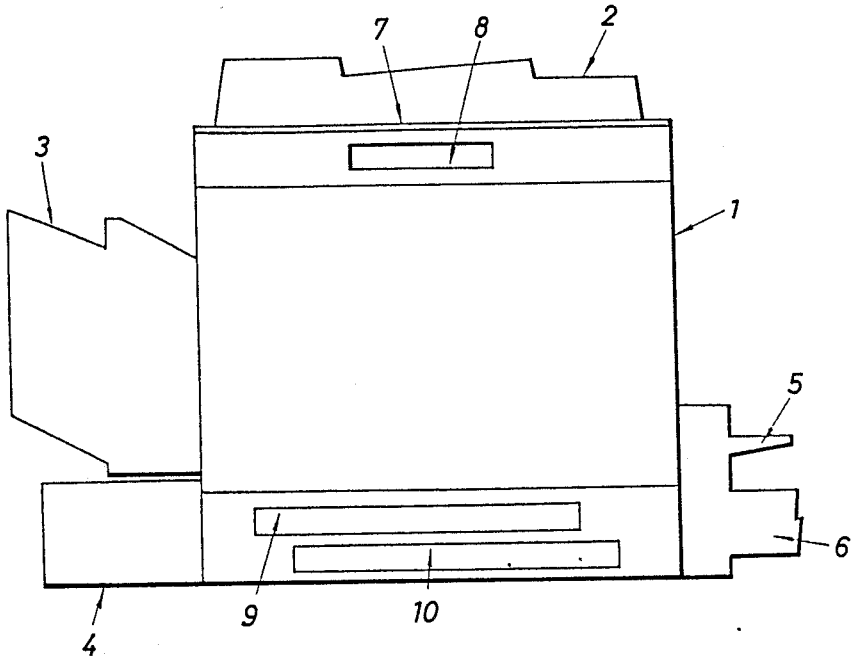
FIG. 1 is an outer view illustrating one embodiment of a copying apparatus as an image-forming device of the present invention.

The copying apparatus comprises a copying apparatus main body 1 for performing an image-forming process, an automatic original feeder (ADF)2 for automatically feeding original documents mounted at the upper surface of the copying apparatus main body 1, a sorter 3 for sorting or arranging papers discharged from the copying apparatus main body 1 and a synthesis front and back (i.e. two sided) faces unit 4 for re-feeding and reversing the papers for conducting synthetic reproduction and front and back faces reproduction, a tray 5 for feeding papers from outside to the copying apparatus main body 1 and a paper feed cassette 6.

A main operation panel 7 attached with various keys and displays for operating the copying apparatus is disposed an the upper surface of the copying apparatus main body 1 and a sub-operation panel 8 normally contained inside the copying apparatus main body 1 is disposed at the upper portion on the side of the main body 1.

Further, a upper feed cassette 9 and a lower feed cassette 10 are mounted to the lower portion on the side of the copying apparatus main body 1 for feeding papers from inside the copying apparatus main body 1.

Figure 2:
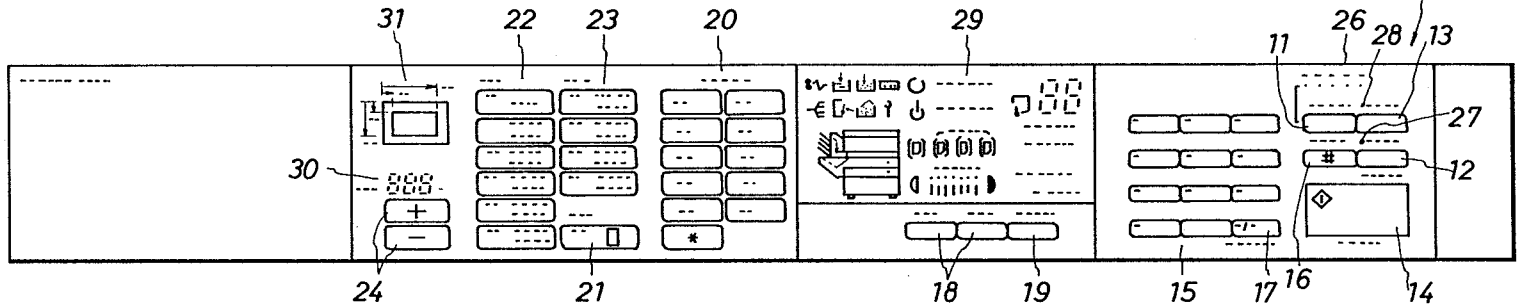
FIGS. 2, 3 and 4 are plan views showing the operation section thereof and a schematic cross sectional view showing the mounting structure of its sub-operation panel.

FIG. 2 is a plan view illustrating the main operation panel 7 of the copying apparatus.

The main operation panel 7 is attached with a program key 11 for instructing the writing, storing and reading of programs, a preheat mode clear key 12, an interruption key 13 for instructing interruption copy, a start key 14 for instructing print start, ten key 15 for setting the number of copy sheets and various kind of modes, a confirmation key 16 used for the confirmation of a set number of sheets during reproduction and setting of various modes, a clear stop key 17 for instructing stopping of the repeat copy, release of the program protect, etc.m, a density key 18 for adjusting the density of a copy image, an automatic density key 19 for instructing the release and re-setting of an automatic density control system (ADS), a paper selection key 20 for selecting the size of copying paper, an equi-magnification key 21, a reduction key 22, a magnification key 23 for instructing copying under equi-magnification, reduction and magnification respectively and a zoom key 24 for instructing the copy magnification ratio (from 50 to 200%).

Further, the main operation panel 7 is also attached with a program display 26, a preheat display 27, an interruption display 28, a display panel 29 for indicating the number of copy sheets, a density, original size, paper size, type of toner, various kind of errors, etc., a magnifying ratio display 30 for displaying the magnifying ratio, and an area designation display 31 for displaying the position for trimming, masking and binding width.

Figure 3:
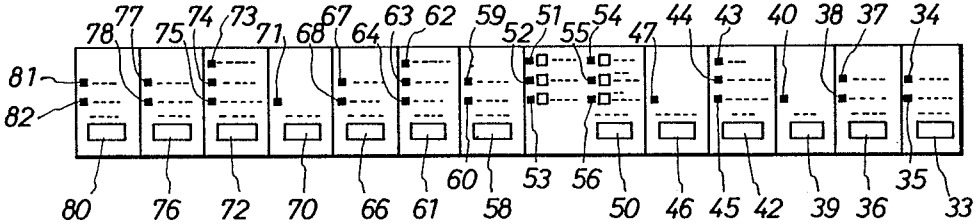

FIG. 3 is a plan view illustrating the sub-operation panel 8 of the copying apparatus.

The sub-operation panel 8 is attached with a size designation key 33 for designating an original size input mode for varying magnification in accordance with the original size or a designated size input mode for varying the designated size, an original size input display 34 and a designated size input display 35 for displaying the mode selected by the size designation key 33, a photographic original key 36 for designating a red erase mode for copying while erasing a red description on the original and a photographic original mode for copying a photographic original while lowering the charging voltage, a red erase display 37 and a photographic original display 38 for displaying the mode selected by the photographic original key 36, and a color key 39 and a color display 40 for designating the color mode for reproduction by color toners and displaying the selection thereof.

Further, the sub-operation panel 8 is attached with a synthetic key 42 for designating a synthetic mode for reproducing several sheets of originals in a same paper, a continuous page reproduction mode for reproducing a spread of an original and a compression synthesis mode for synthesizing a plurality of originals under compression, and a synthetic display 43, a continuous page reproducing display 44 and a compressive synthesis display 45 for displaying the mode selected by the synthesis key 42.

Furthermore, the sub operation panel 8 is equipped with a point designation key 46 for designating the point of an editor region and a point designation display 47 for displaying the selection, a mode designation key 50 for designating a trimming mode for reproducing while partially extracting an original, a masking mode for reproducing while partially masking an original, a first framing mode for making the inside of point-designated area into black colored and the outside into colored, a second framing mode for making the inside of point-designated area into colored and the inside into black colored, color trimming mode and color masking mode respectively, a trimming display 51, a masking display 52, a first framing display 53, a second framing display 54, a color trimming display 55 and a color masking display 56 for displaying the mode selected by the mode designation key 50.

The sub-operation panel 8 is also attached with an erase key 58 for designating a frame erase mode for erasing the frame portion of the original over a predetermined range, a book center erase mode for erasing the center portion of the book original, a frame erase display 59 and a book center erase display 60 for displaying the mode selected by the erase key 58.

Further, the sub-operation panel 8 is also equipped with a move key 61 for designating a centering for reproducing an original at the center position of a paper, a rightward shifting for reproducing the original to the right of the paper and a leftward shifting for reproducing the original to the left of the paper, a centering display 62, a right shift display 63 and a left shift display 64 for displaying the mode selected by the move key 61.

Further, the sub-operation panel 8 is attached with a binding width adjusting key 66 for designating the front face adjusting mode and the rear face adjusting mode to adjust the binding width (blank) on the right and left of the copy, a front face display 67 and a rear face display 68 for displaying the mode selected by the binding width adjusting key 66, a continuous page copying key 70 for designating the continuous page reproduction for automatically copying a spread of an original page by page and a continuous page copying display 71 for displaying the selection by the continuous page copying key 70.

Further, the sub-operation panel 8 is equipped with a front and back faces key 72 for designating the single side copying mode, front and back faces copying mode and a book copying mode, a single side copying display 73, a front and back faces copying display 74 and a book copying display 75 for displaying the mode selected by the both faces key 72, an APS key 76 for designating an automatic paper selection mode for selecting a paper in accordance with an original size, and a size unifying mode for adjusting magnification in accordance with a paper size, an automatic paper selection display 77 for displaying the mode selected by the APS key 76 and a size unifying display 79.

Further, the sub-operation panel 8 is attached with a sorter key 80 for designating the sort mode and the stack mode, and a sort display 81 and a stack display 82 for displaying the mode designated by the sorter key 80.

Figure 4:
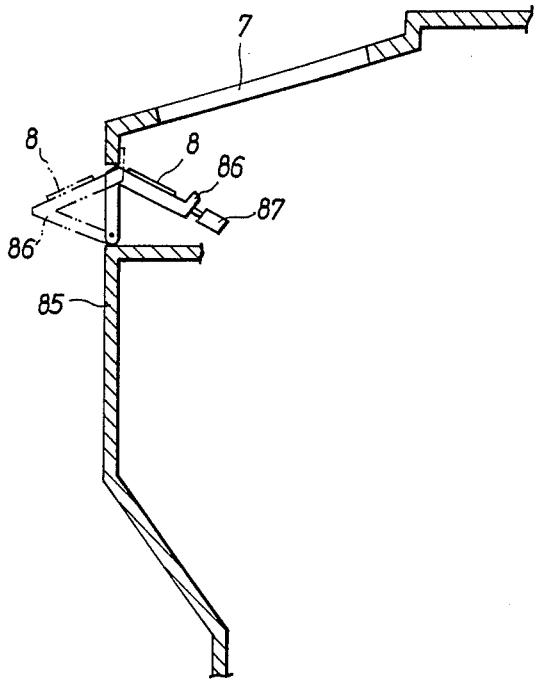

Then, as shown in FIG. 4, the sub-operation panel 8 is disposed on a support plate 86 rotatably journaled to the upper portion on the side of the main body front frame 85 and rotatably biased outwardly by a spring not illustrated, and a ratch 87 is disposed for engaging the support plate 86.

The sub-operation panel 8 is usually hidden by being held in the state shown by the solid line by a ratch 87 and, when the support plate 86 is pushed from the outside to the inside in this state, the engagement with the ratch 87 is released and rotated by the resilient force of a spring not illustrated to the position shown by the phantom line to be in a state of use. Then, by closing the support plate 86 again after the use, the panel is engaged by the ratch 87.

Figure 5:
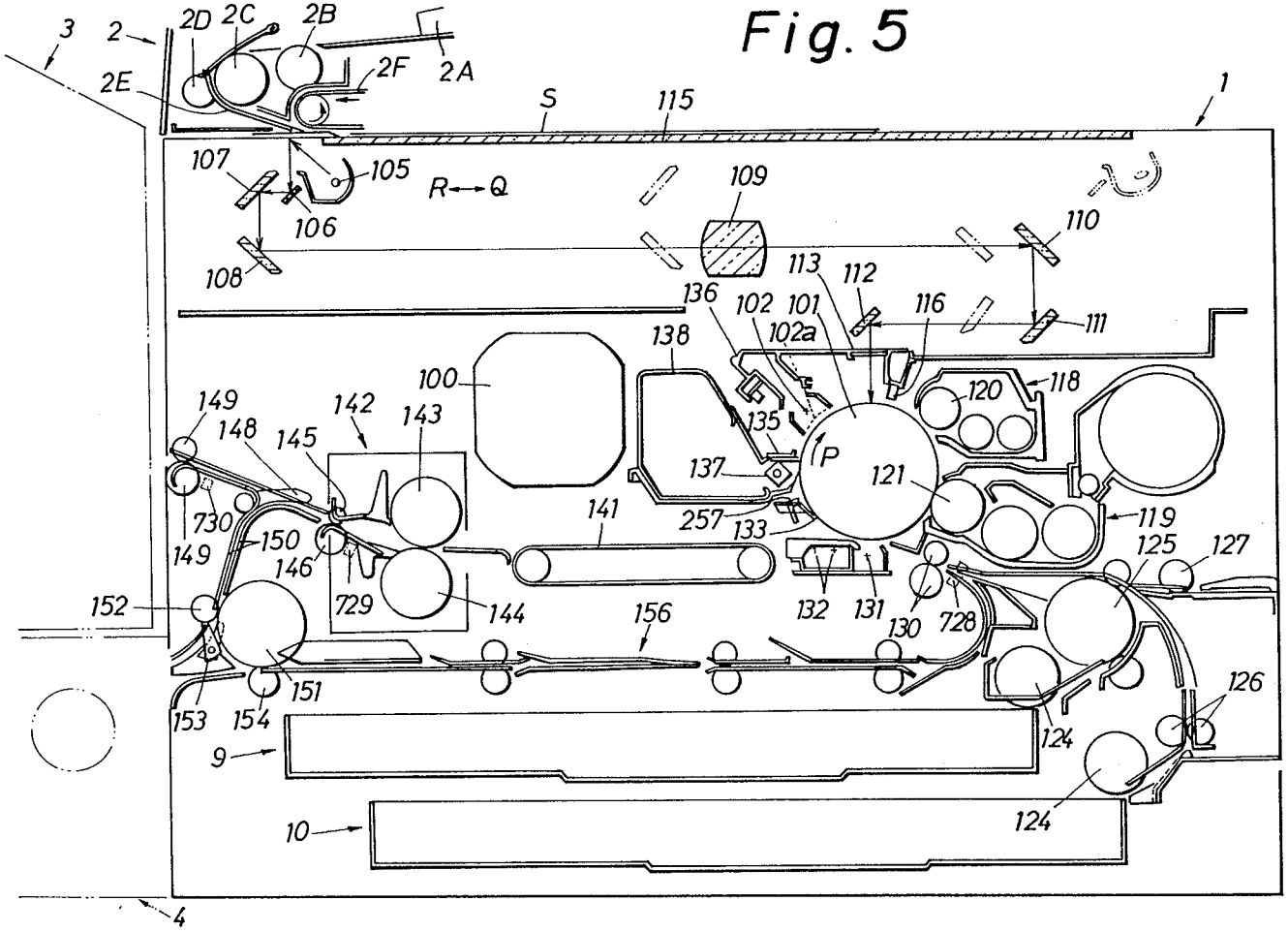
FIG. 5 is a schematic constitutional view showing the mechanical portion of the copying apparatus main body.

FIG. 5 is an entire schematic constitutional view illustrating the mechanical section of the copying apparatus main body 1.

In the copying apparatus main body 1, when the start key 14 on the main operation panel 7 is pushed, a main motor 100 rotates thereby causing a photosensitive drum 101 to rotate in the direction of the arrow P and a high voltage is applied to an electric charger 102 having a grid electrode **102*a* to uniformly charge the surface of the photosensitive drum 101**.

On the other hand, the optical system comprising an exposure lamp 105 and a first mirror 106 attached to a first scanner, as well as a second mirror 107 and a third mirror 108 attached to a second scanner as described later is driven by a scanner driving mechanism described later.

An original document is set on a contact glass 115 by way of the automatic original feeder 2 or manually. The automatic original feeder 2 is so adapted to deliver originals stacked on a original table 2A by a delivery roll 2B, separate them one by one by a separation roller 2C and a pull out roller 2D, feed them beneath a conveyor belt 2F moving in the direction of the arrow by way of a guide 2E and convey the original S to a predetermined position on the contact glass 115 by way of the conveyor belt 2F.

The exposure lamp 105 is lighted up at a predetermined timing and the scanner advances to a position shown by the phantom line in the direction of the arrow Q while irradiating the original S set on the contact glass 115 and, thereafter, returns in the direction of the arrow R.

In this case, reflection light from the original S irradiated from the exposure lamp 107, enters by way of the first mirror 106, the second mirror 197, the third mirror 108, the through lens 109, the fourth mirror 110, the fifth mirror 111 and the sixth mirror 112 and a dust-preventive glass 113 respectively onto a charged photosensitive drum 101 to conduct exposure, whereby an electrostatic latent image is formed on the photosensitive drum 101 in accordance with the original image.

Then, after the electric charges on the photosensitive drum 101 which are not needed for transferring have been erased by an erase lamp 116 composed of a light emission diode (LED), the electrostatic latent image on the photosensitive drum 101 is visualized when it is deposited with color toners or black toners by means of a developing sleeve 120 of a color developing device 118 or a developing sleeve 121 of a black developing device 119.

On the other hand, a paper contained in the upper paper feed cassette 9 mounted inside is fed by way of a feed roller 124 and an intermediate roller 125, while a paper contained in the lower paper feed cassette 10 is fed by way of a feed roller 124, a relay roller 126 and the intermediate roller 125, further, a paper fed from a tray 5 are fed by way of a send roller 127 and the intermediate roller 125, and still further, a paper contained in the paper feed cassette 6 is fed from a paper feed channel, not illustrated, by way of the intermediate roller 125 to the register rollers 130 respectively in accordance with the selection by the paper selection key 20 on the main operation panel 7.

Then, the paper fed as far as the register rollers 130 is brought into contact with the top of the photosensitive drum 101 by the rotation of the register rollers 130 which rotates with accurate timing, and toner images on the photosensitive drum 101 are transferred on the paper.

Since a high DC voltage is applied at an exact timing to the transfer charger 131, toners on the photosensitive drum 101 are attracted toward the paper.

Then, an AC high voltage is applied to a separation charger 132 to eliminate static electric charges on the paper and then the paper is separated from the photosensitive drum 101 by way of a separation finger 133.

In this manner, the photosensitive drum 101 after completion of the transfer and the separation is removed with residual toners by means of a cleaning blade 135 for the preparation of the next coy step and is also removed with electric charges by means of a charge elimination lamp 136 composed of LED.

The residual toners stripped from the photosensitive drum 101 by the cleaning blade 135 are recovered by a toner recovery shaft 137 to the inside of a toner recovery tank 138.

On the other hand, the transferred paper separated from the photosensitive drum 101 is conveyed by way of a conveyor belt 141 to the inside of a fixing device 142, in which toner images are fixed under heating by means of a heater roller 143 and a pressure roller 144 and, thereafter, discharged by means of discharge rollers 145, 146.

Then, the paper discharged from the fixing device 142 is discharged through the gap between the discharge rollers 149, 149 to the inside of the sorter 3 when a switching member 148 is situated on the discharge side.

Further, when the switching member 148 is situated on the synthesis front and back faces side (as in the illustrated state), the paper is sent through the inside of the guide 150 into the gap between the rollers 151 and 152.

Then, in case of preparing only one sheet of synthesized copy, the paper is sent, while being guided by the direction change member 153 in the state shown by the solid line, through the gap between the rollers 151 and 154 to the inside of a synthesis/front and back faces conveying unit 156, applied with correction for the attitude in the synthesis/ both faces conveying unit 156, and thereafter, fed to the regist roller 130 again at a predetermined timing.

In case of continuous synthesis copy or continuous front and back copy mode, the paper is guided by the direction switching member 153 in the state shown by the phantom line in the drawing and fed to the inside of the synthesis/both faces unit 4. The copied surface of the paper is the next copy surface in the case of the synthesis coy mode, whereas in case of the front and back faces mode, the surface opposite the copied surface is reversed since the opposite surface is the next copy surface. After that, the paper in the unit 4 is sent again into the coping apparatus main body 1, and sent to the synthesis front and back faces conveying unit 156 by way of the rollers 151 and 154. After the correction of the attitude, the paper is fed again to the resister rollers 130 at a predetermined timing.

Then, after the next image on the photosensitive drum 101 has been transferred, the paper is fixed and then discharged or fed into the synthesis/front and back faces conveying unit 156 or into the synthesis/front and back faces unit 4.

Explanation for each of the portions of the copying apparatus will be made greater detail by referring to FIG. 6 and succeeding Figures.

Figure 6:
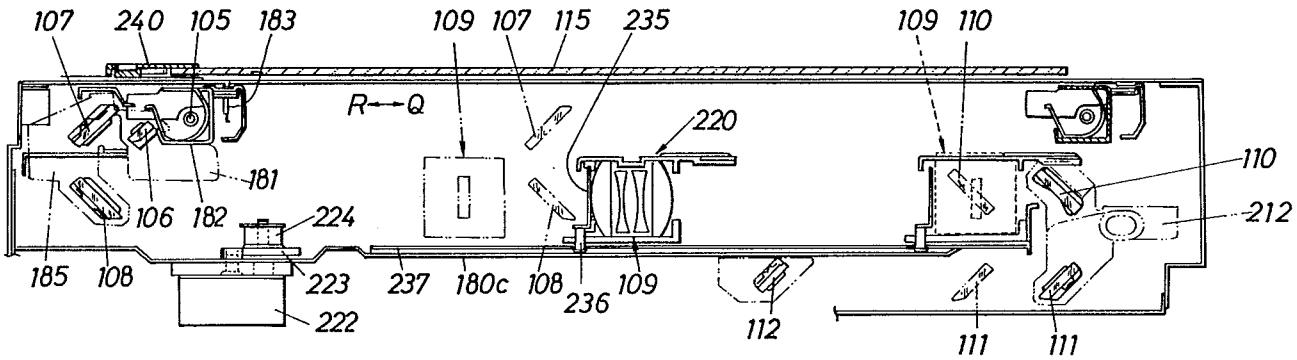
FIGS. 6 through 10 are a front elevational cross sectional view, front elevational view, plan view explanatory perspective view and explanatory view, respectively, for providing an explanation of an optical system unit thereof.
Figure 7:
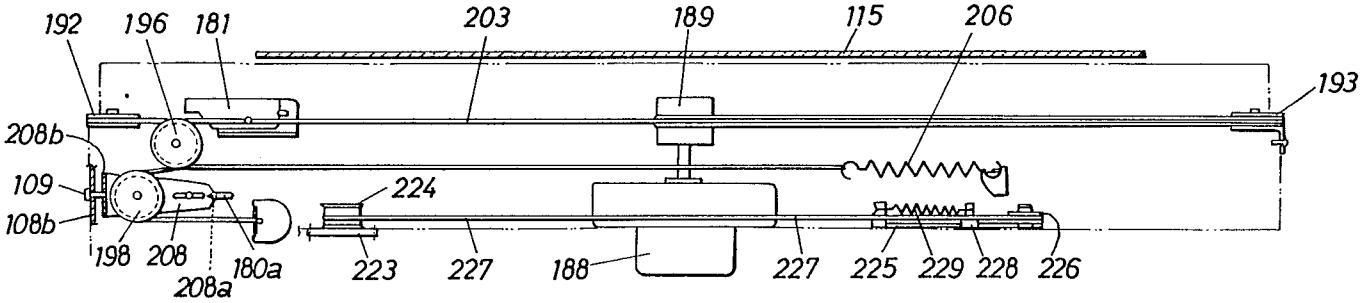
Figure 8:
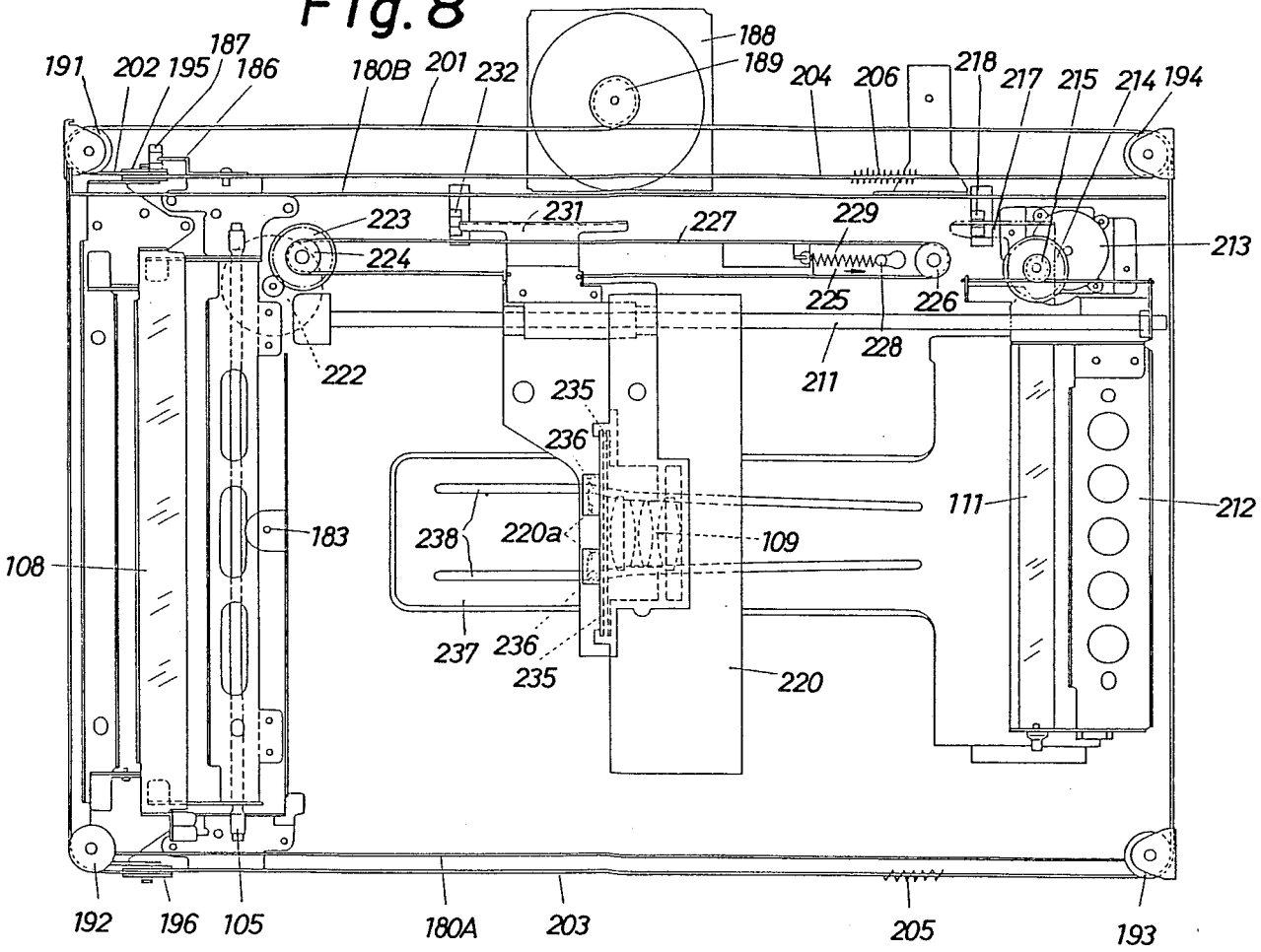

FIGS. 6 through 8 are a sectional front elevational view, schematic front elevational view respectively and plan view illustrating an optical system of the copying apparatus main body 1.

In this optical system, since a twin color is intended by disposing a color developing device 118 and a black color developing device 119, six mirrors comprising first mirror 106, second mirror 107, third mirror 108, fourth mirror 110, fifth mirror 111 and sixth mirror 112 are used so that the reflection light for exposure enters just from above the photosensitive drum 101.

That is, if the optical system is composed of four mirrors the reflection light for exposure can not but enter obliquely to the photosensitive drum 101. However, by adopting six mirrors it becomes possible to enter the reflection light for exposure from just above the photosensitive drum 101.

Next, explanation will be made as to the constitution of the scanner and the scanner driving mechanism. A first scanner 181 is slidably mounted between the frame 180A and the frame 180B, and the first scanner 181 has the exposure lamp 105, reflection plate 182, the first mirror 106 and an optical fiber 183 for detecting the original density when the automatic density control system (ADS) is actuated. Further, a second scanner 185 is slidably mounted between the frame 180A and the frame 180B, and the second scanner 185 has the second mirror 107 and the third mirror 108.

The first scanner 181 has a sensor bracket 186, and a scanner home position sensor 187 of a photosensor composed of a light emitting element and a photoreceiving element is attached on the frame 180B so as to positioned at each side of the sensor bracket 186.

For driving the first and the second scanners 181 and 185, a scanner motor 188 of a bracket type servo motor is fixed to the frame 180B and a motor pulley 189 is secured to the rotational shaft of the scanner motor 188.

Figure 9:
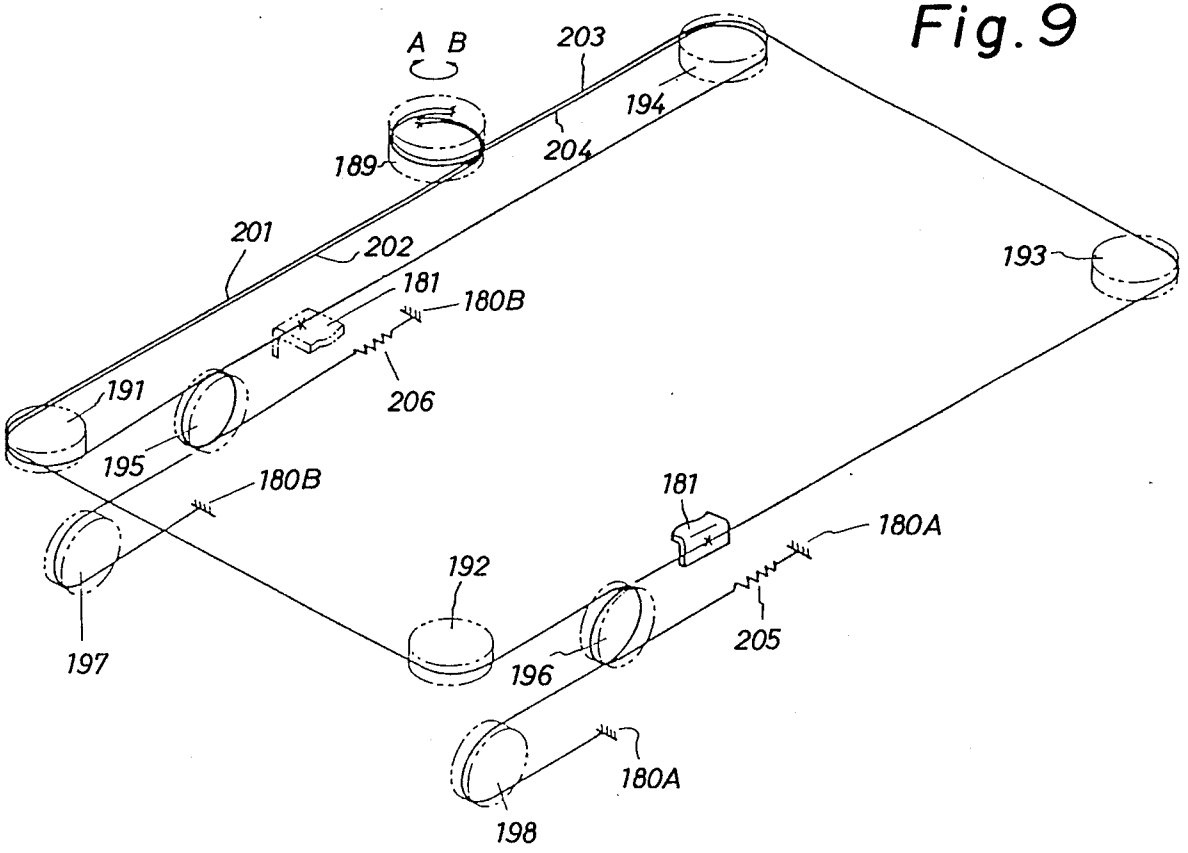

Then, as shown in FIG. 9, four wires 201–104 are stretched in the scanner driving system comprising the motor pulley 189 of the scanner motor 188, four pulleys 191–194 mounted rotatably at four corners of the frame 180A and the frame 180B, pulleys 155, 156 rotatably mounted on both sides of the second scanner 185, turn pulleys 197, 198 mounted rotatably on the side of the frame 180A and the frame 180B. The weight of the scanner is reduced, and the scanning is stabilized by using the both sides wire driving system, which brings about a broad speed range with low jitter.

The wire 201 is secured at one end to the motor pulley 189 and at the other end by way of the pulleys 191, 192, 196 and the turn pulley 198 to the frame 180A. The wire 202 is secured at one end to the motor pulley 189 and at the other end by way of the pulleys 191, 195 and the turn pulley 197 to the frame 180B.

Further, the wire 203 is secured at one end to the motor pulley 185, at the other end by way of the pulleys 194, 193, 196 to one end of tension coil spring 205 which is connected to the frame 180A at the other end thereof, and at the intermediate portion to the first scanner 181. The wire 204 is secured at one end to the motor pulley 189, at the other end by way of the pulleys 194, 195 to one end of a tension coil spring 106 which is connected to the frame 180B at the other end thereof and at the intermediate portion to the first scanner 181.

Although each of the wires 201–104 is wound by a predetermined number around each of the pulleys 191–198, it is shown in a simplified form in FIG. 9.

In thus constituted scanner driving mechanism, when the scanner motor 188 is driven to rotate the motor pulley 189 in the direction of the arrow A in FIG. 9, the wires 203 and 204 are rolled up by the motor pulley 189, while the wires 201 and 202 are released from the motor pulley 189, therefore, the first scanner 181 and the second scanner 185 are moved by predetermined amount and velocity in the direction shown by the arrow Q to scan the original document.

In the same manner, when the scanner motor 188 is driven to rotate the motor pulley 189 in the direction shown by the arrow B in FIG. 9 in the same way, wires 201 and 202 are rolled up by the motor pulley 189, while the wires 203 and 204 are released from the motor pulley 189, therefore, the first scanner 181 and the second scanner 185 are returned in the direction shown by the arrow R in FIG. 6.

As shown in FIG. 7, a finger 208*a* are formed at the top end of a pulley retaining plate 208 rotatably journaling the turn pulley 198 is engaged with a long hole 180a formed in the frame 180A, and a flange 208*b* formed at the rear end of the plate 208 is screwed to an adjust screw 109 which is screwed to an erect portion of the frame 180A, so that the position of the turn pulley 198, that is, the tension of the wires 201 and 203 can be adjusted by rotating the adjust screw 109. The tension of the wires 202 and 204 can also be adjusted by the turn pulley 197 in the same manner.

Explanation will now be made to the variable magnifying mechanism. A carriage 212 is slidably mounted to a guide rod 211 disposed at the bottom plate 180C of the optical system and the first mirror 110 and the fifth mirror 111 are attached to the carriage 212.

A mirror motor 213 of a step motor is attached on the bottom plate 180C of the optical system, and the rotation of the mirror motor 213 is transmitted to the carriage 212 by way of the pulley 215 having a gear 214 integrally formed therewith and rotatably journaled to the frame 180 and a wire 216 stretched between the pulley 215 and the carriage 212.

The carriage 212 has a sensor bracket 217, and a mirror home position sensor 218 of a photosensor comprising a light emitting element and a photoreceiving element which are disposed so as to oppose with each other at both sides of the sensor bracket 217, is attached on the optical system bottom plate 180C.

Further, a lens housing 220 is slidably mounted to the guide rod 211, and the through lens 109 is mounted to the lens housing 220.

On the other hand, a lens motor 222 of a step motor is attached to the bottom plate 180C of the optical system, and the rotation of the lens motor 222 is transmitted to the lens housing 220 by way of a pulley 224 having a gear 223 integrally formed thereto and rotatably journaled on the bottom plate 180C of the optical system, a pulley 226 rotatably journaled on a pulley holder 225 slidably mounted on the bottom plate 180C of the optical system and a wire 227 stretched between the pulley 226 and the lens housing 220.

The pulley holder 225 provides tension to the pulley 226 by way of a tension coil spring 229 secured at one end to a pin 228 planted on the bottom plate 180C in the direction of the arrow shown in FIG. 8, thereby resiliently biasing the lens housing 220 to the size-reduction side.

Further, the lens housing 220 has a sensor bracket 231, and a lens home position sensor 232 of a photosensor comprising a light emitting element and a photoreceiving element is attached on the bottom plate 180C so as to oppose each other on both sides of the sensor bracket 232.

The sensor bracket 231 is adapted to always enter the lens home position sensor 232 when the lens housing 220 is moved from the equi-magnifying position to the enlarging side, n order to detect the position of the lens housing 220.

In the variable magnifying mechanism thus constituted, the optical length between the original and the through lens 109 and the optical length between the through lens 109 and the photosensitive drum 101 are changed on varying the magnifying ration, by moving the lens housing 220, that is, the through lens 109 by driving the lens motor 222.

Specifically, as shown in FIG. 6, the through lens 108 situated at the position shown by the solid line for equi-magnification ratio (100% ratio) moves, for example, to the position shown by the chain line for 200% magnification ratio (2 times) and moves to a position shown by the dotted line for 50% magnifying ratio (0.5 times).

At the same time, since it is necessary to correct the path so as to increase the distance between the original and the photosensitive drum 101 upon varying magnification, the carriage 212, i.e., the fourth mirror 110 and the fifth mirror 111 are moved by driving the mirror motor 213. That is, referring to FIG. 6, the fourth mirror 110 and the fifth mirror 111 situated at the position shown by the chain line for equi-magnifying ratio are moved to the position shown by the solid line for 200% magnifying ratio (twice) and for 50% magnification ratio (0.5 times).

In this way, by using six mirrors and disposing the mirror moving mechanism for moving the fourth mirror 110 and the fifth mirror 111 for variable magnification (enlargement and reduction), it is possible to simplify the mechanism for correcting the path (correction for varying the distance between the original and the photosensitive drum) and conduct such path correction accurately.

Then, movement of the through lens 109 upon varying magnification will be explained referring to FIG. 10. At first, the detection signal of the lens home position sensor 232 becomes a high level "H" on the reduction side and low level "L" on the enlargement side as shown in FIG. 10 (A).

Then, when through lens 109 is moved from the reduction side to the enlargement side, the lens moves straight across the equi-magnifying position as shown in FIG. 10(B). When the through lens 109 is moved within the reduction side, the through lens 109 moves to a new reduction position without returning to the home position HP as shown in FIG. 10(C). When the through lens 109 is moved from the reduction side to the equi-magnifying position, the through lens 109 moves straight to the equi-magnifying position as shown in FIG. 10(D).

Figure 10:
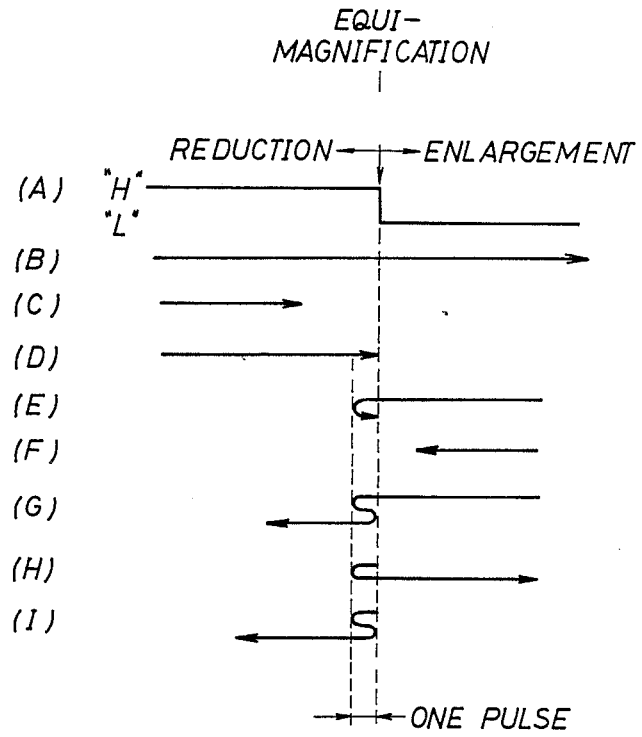

When the through lens 109 is moved from the enlargement side to the equi-magnifying position, it moves once to the reduction side by one pulse amount across the lens home position (lens HP) and then returns to the enlargement side by one pulse amount to reach the equi-magnifying position as shown in FIG. 10(E). The through lens 109 moves straight to a new enlargement position without returning to the lens HP when it is moved within the enlargement side as shown in FIG. 10(F). When the through lens 109 is moved form the enlargement side to the reduction side, it returns once to the enlargement side by one pulse amount after after moving by one pulse amount across the equi-magnifying position and then it moves to the reduction side again as shown in FIG. 10(*g*). When the through lens is moved from the equi-magnifying position to the enlargement side, it moves at first by one pulse amount to the reduction side, then moves to the enlargement side as shown in FIG. 10(H). When the through lens 109 is moved from the equi-magnifying position to the reduction side, it once returns to the enlargement side by one pulse amount after moving by one pulse amount from the equi-magnifying position, and then it moves to the reduction side again as shown in FIG. 10(I).

Since the lens housing 220 is biased toward the reduction side, the through lens 109 is returned once to the enlargement side by one pulse amount on its way to the required position as described above.

Explanation will now be made to the shading mechanism of the variable magnifying mechanism. Two shading plates 235, 235 are slidably mounted in front of the lens housing 220 on the side of the exposure lamp 105, and pins 236, 236 planted at the lower surface of the shading plates 235, 235 are engaged, by way of long holes 220a, 220a formed on the lens housing 220 with shading cam grooves 238, 238 formed on a cam plate 237 attached to the bottom plate 180C.

Accordingly, when the lens housing 220 is moved toward the reduction side, the shading plates 235, 235 are moved in such a direction that they approach each other along the shading cam grooves 238, 238 to shield the periphery of the through lens 109 for unifying the illuminance.

Figure 11:
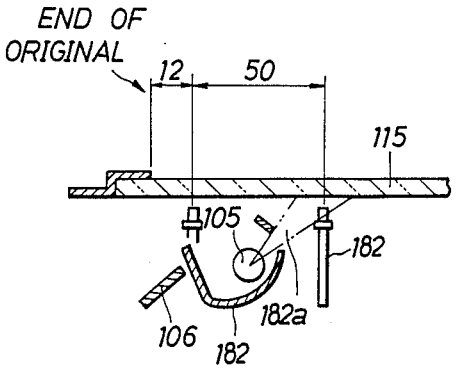
FIGS. 11 and FIGS. 11A through 11C are explanatory views for the explanation of ADS (Automatic Density control System)

Explanation will now be made to the automatic density control system (ADS) referring to FIG. 11.

The ADS is adapted to receive the light emitted from the exposure lamp 105 through a hole 182*a* formed on a part of a reflection plate 182. Prior to the scanning of an original, an optical fiber 183 receives a reflection light from the portion between 12 mm and 50 mm from the top end of the original.

The light received by the optical fiber 183 is photoelectrically converted into voltage VDE and a reference voltage VB for the developing bias is set based on the maximum voltage, that is, the voltage VDE corresponding to the maximum amount of light reflected from the background of the original.

Figure 11C:
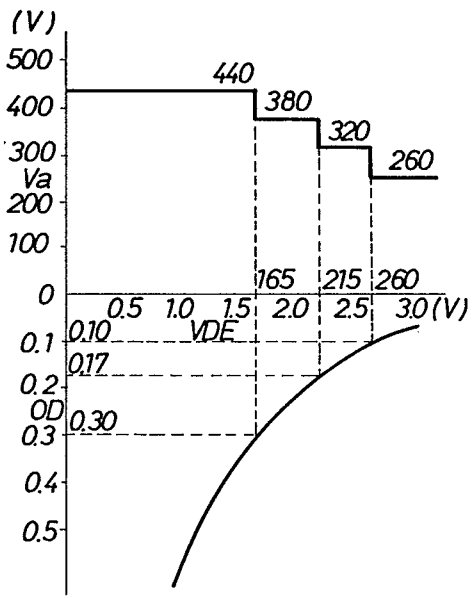
Figure 11A:
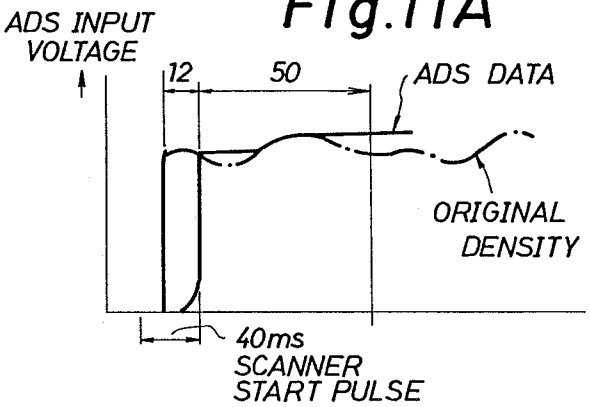
Figure 11B:
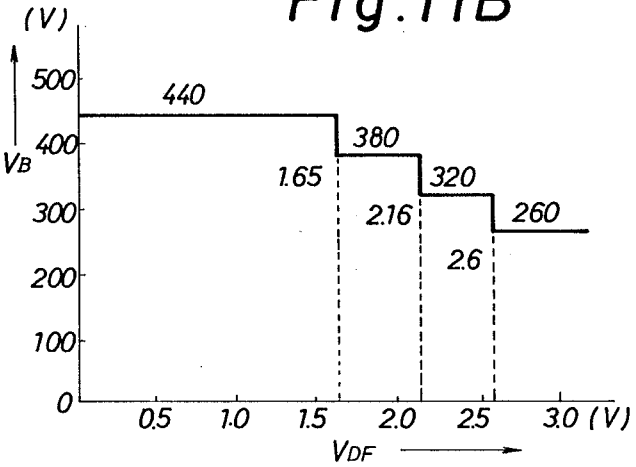

FIG. 11A shows the voltage VDE corresponding to the background area (ADS data volue), FIG. 11B shows a relationship between the voltage VDE and the reference voltage VB and FIG. 11C shows the relationship between the exposure voltage (4-noch variation) and the reference voltage VB.

Figure 12:
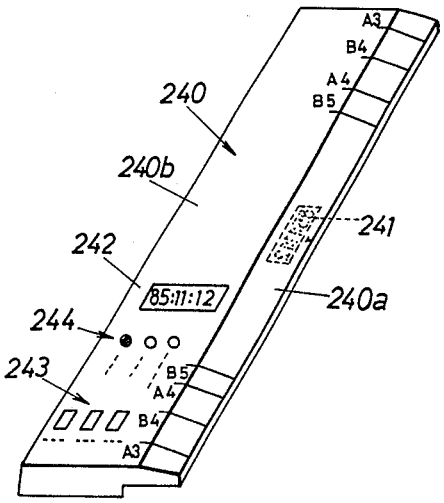
FIGS. 12 and 13 are perspective view and cross sectional view showing one embodiment of an original scale.
Figure 13:
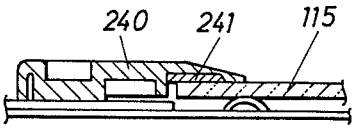

Next, an explanation will be given as to an original scale that can be used in the copying apparatus referring to FIGS. 12 and 13.

An original scale 240 comprises a scale part 240a, a display device 241 which is composed of an electronic display (ECD) for displaying date and time to be printed and attached at the bottom of the scale part 240*a* and a display device 242 for displaying the same contents as those of the display device 241 attached at the surface of the main body 240*b*.

Further, the main body 240*b* has a select key for selecting the display content of the display devices 241 and 242, an input key group 243 comprising an up key for updating the date and time and a set key for setting the date and time, and a mode indicator group 244 comprising a date indicator, time indicator and non-print indicator for indicating the selected result by the select key.

Since the original scale 240 is thus constituted; date or time can be automatically printed on a copy paper by displaying the date or time in the display device 241.

Figure 14:
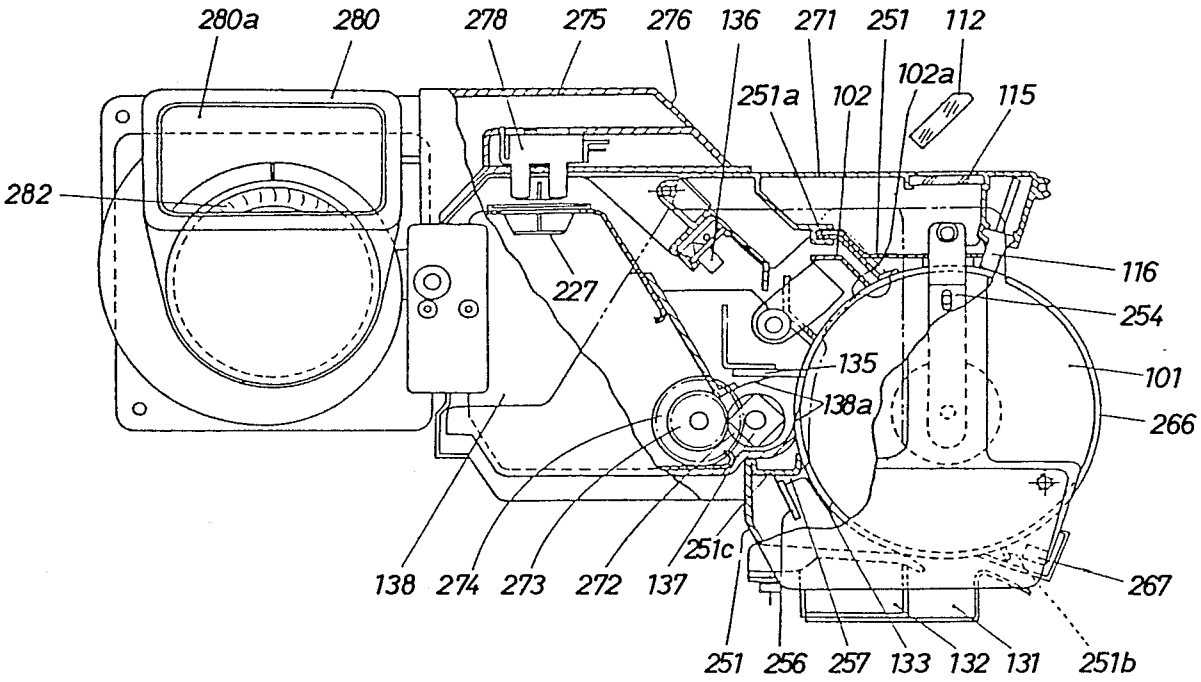
FIGS. 14 and 15 are a front elevational cross sectional view and a plan view providing an explanation of the drum-cleaning unit.
Figure 15:
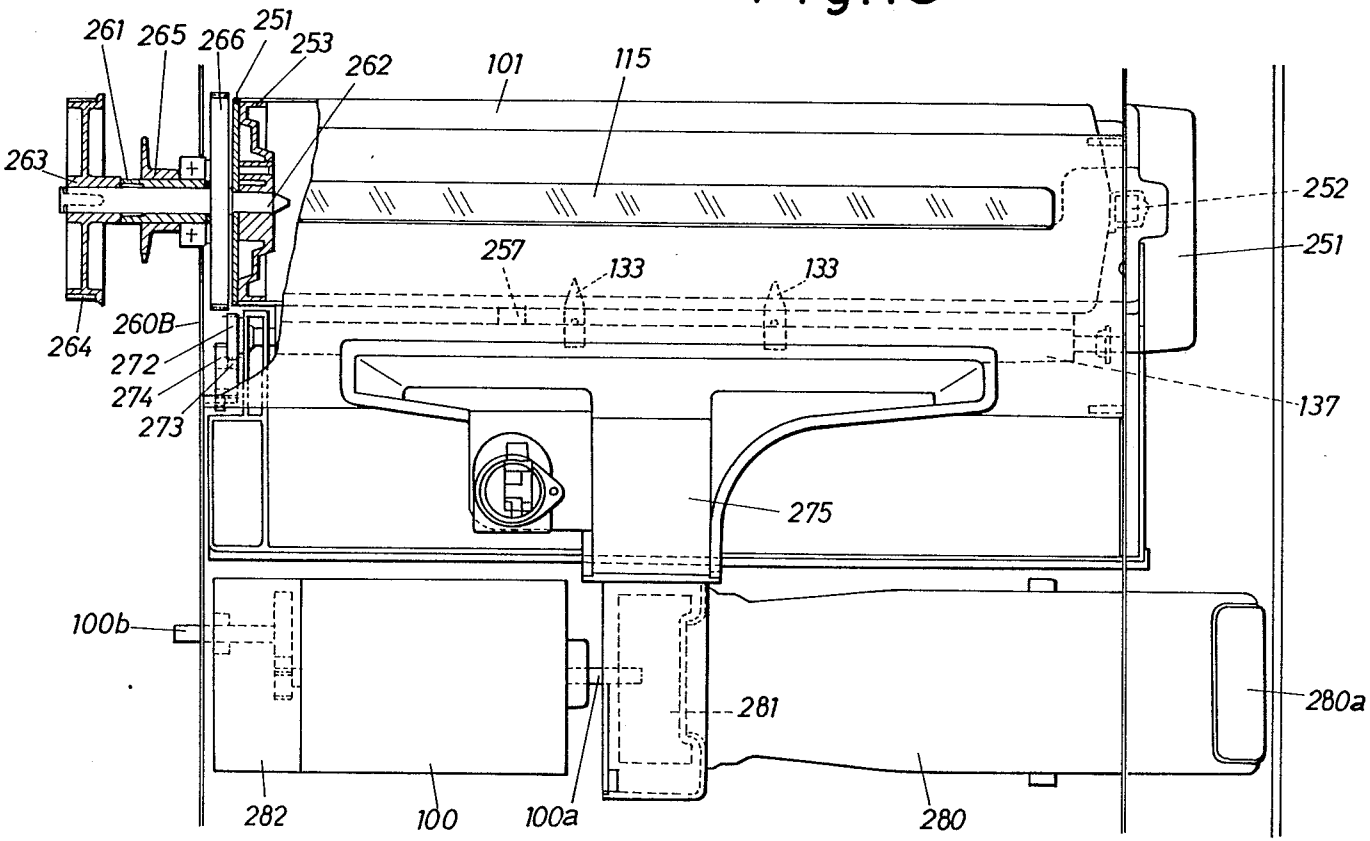

FIGS. 14 and 15 are a cross sectional front elevational view, respectively, and a plan view illustrating a drum unit and a cleaning unit of a copying apparatus main body 1.

The drum unit case 251 is a cylindrical casing comprising an upper mounting/detaching guide 251*a* and a lower mounting/detaching guide 251*b* used for mounting and detaching the drum unit, a bracket 251*c*, and openings required for charging, exposure, development, transfer and cleaning.

The photosensitive drum 101 having a cover 253 is rotatably mounted by means of a shaft 252 at the inside of the drum unit case 251, and a leaf spring 254 for grounding to the earth abuts resiliently to the shaft 252 of the photosensitive drum 101. Further, two separation fingers 133 are attached to the bracket 251C and also a P sensor 257 is attached with a sensor bracket 256.

Accordingly, by detaching the drum unit case 251, the photosensitive drum 101, the separation fingers 133 and the P sensor 257 can be detached integrally.

A drum shaft 262 is secured tot eh cover 253 of the photosensitive drum 101, and a timing pulley 263 is secured to the end of the drum shaft 262. A timing belt 264 is stretched between the timing pulley 263 and another timing pulley (not illustrated) mounted on a main motor 100 to rotate the photosensitive drum 101 by the main motor 100.

The sleeve 261 is provided with a sprocket 265 which is rotationally driven by the main motor 100 by way of a chain not illustrated, and a developing gear 266 is disposed between the frame 260B and the photosensitive drum 101 for transmitting the rotation to the color developing device 118 and the black color developing device 119. Further, a charge elimination lamp 167, for example, made of LED is disposed below the photosensitive drum 101.

An explanation will now be made to the cleaning unit. A toner recovery tank 138 is detachably mounted to a cleaning unit case 271. At the entrance of the toner recovery tank 138, a toner recovery shaft 137 is rotatably attached. A cleaning blade 135, a charge elimination lamp 136 and a detachable electric charger 102 are also provided in the cleaning unit case 271. Material 138*a* is attached at the entrance of the toner recovery tank 138, for preventing the toners from falling and scattering.

Further, two-stage gears 273 and 274 meshing with a gear 272 secured to the toner recovery shaft 137 are rotatably journaled to the cleaning unit case 271.

A duct 275 is connected to upper portion of the cleaning unit case 271 and a sensor mounting frame 276 is attached on the duct 275. A toner over sensor 278 of a photosensor comprising a light emitting element and a photoreceiving element opposed each other at both sides of a plate 277 made of rubber movable vertically in the toner recovery tank 138 is attached to the sensor mounting frame 276.

External air taken by a centrifugal blower 281 is supplied to the duct 275 by way of a duct 280 having an air inlet port 280*a*, and the air is blown from the duct 275 by way of the inside of the electric charger 102 to the periphery of the photosensitive drum 101.

The blower 281 is secured to one shaft 100*a* of the double-shaft type main motor 100, and the other shaft of the main motor 100 is connected with a gear head 282 and the shaft of the gear head 282 constitutes a shaft 100*b* for rotating the photosensitive drum 101, etc.

FIG. 16 through FIG. 19 are, respectively, a cross sectional view for the color developing device 118 and the black color developing device 119, a plan view for the color developing device 118 and a cross sectional view for the toner supplying portion of the color developing device 118.

Explanation will now be made regarding the black color developing device 119. The unit case 301 of the black color developing device 119 has a long hole 301*b* formed at its top end 301*a* adjacent to the photosensitive drum 101, and the unit case 301 is held by pins 303 planted on the frame 302 and inserted into the long hole 301*b*. Further, the rear end 301*c* is rotatably journaled by means of a shaft 306 to a support plate 305 which is swingeably journaled by means of a shaft 304 to a subframe 302*a* secured to the frame 302, so that the developing sleeve 121 can be in contact with or apart from the surface of the photosensitive drum 101.

The unit case 301 of the black color developing device 119 is engaged with the drum unit case 251, although not illustrated, in order that the black color developing device 119 is not pulled out alone separated from the photosensitive drum 101 to prevent positional deviation between the photosensitive drum 101 and the developing sleeve 121, etc. to thereby maintain the quality, since being different from the color developing device, the black color developing device 119 is not intended to be replaced for color change. Further, adjustment for the position of the unit case 301 can be made, for example, by way of a solenoid and a clutch.

A toner supplying portion comprising a toner hopper 312 for containing toners to be supplied to the inside of the unit case 301 and a toner supplying roller 313 is mounted integrally above the unit case 301, so that the toner supplying portion can be moved integrally with the unit case 301.

Further, to the inside of the unit case 301, are rotatably mounted a developing sleeve 121 for supplying the toners to the photosensitive drum 101, a paddle wheel 310 for supplying the toners to the developing sleeve 121, a paddle wheel 311 for supplying toners supplied from the toner hopper 312 by way of the toner supply roller 313 to the paddle wheel 310, a mixing roller 315 comprising wires 314 wound spirally along the outer circumference of the paddle wheel 311 respectively.

Further, doctor blade 316 for controlling the amount of the toners supplied is disposed above the developing sleeve 121 and inside of the unit case 301, and a guide plate 318 attached to a deviation plate 317 is disposed above the paddle wheel 310 for returning the toners controlled by the doctor blade 316 to the mixing roller 315 by sending them backwardly in the direction of the drum axis pitch by pitch.

The toner return guide plate 318 has a toner return screw 319 formed inside thereof for returning the toners sent to the final end toward the foremost end and an opening 320 for discharge of the toners returned to the foremost end by the toner return screw 319 above the paddle wheel 310.

Then, a sleeve gear 322 meshing the developing gear 266 for the drum unit as described above is secured to the developing sleeve 121, and a paddle gear 323 meshing with the sleeve gear 322 by way of a gear not illustrated is secured to the paddle wheel 310, a roller gear 324 meshing with the paddle gear 323 by way of a gear not illustrated is secured to the mixing roller 315 and, further, a gear meshing with the roller gear 324 is secured to the toner return screw 319, so that the paddle wheel 310 and the mixing roller 315 are each rotated in opposite directions. It is also possible to rotate the mixing roller 315 in the same direction as the paddle wheel 310.

Further, a handle 326 is secured at the front end of the unit case 301, and is used upon mounting and detaching the black color developing device 119 together with the photosensitive drum 101.

Figure 16:
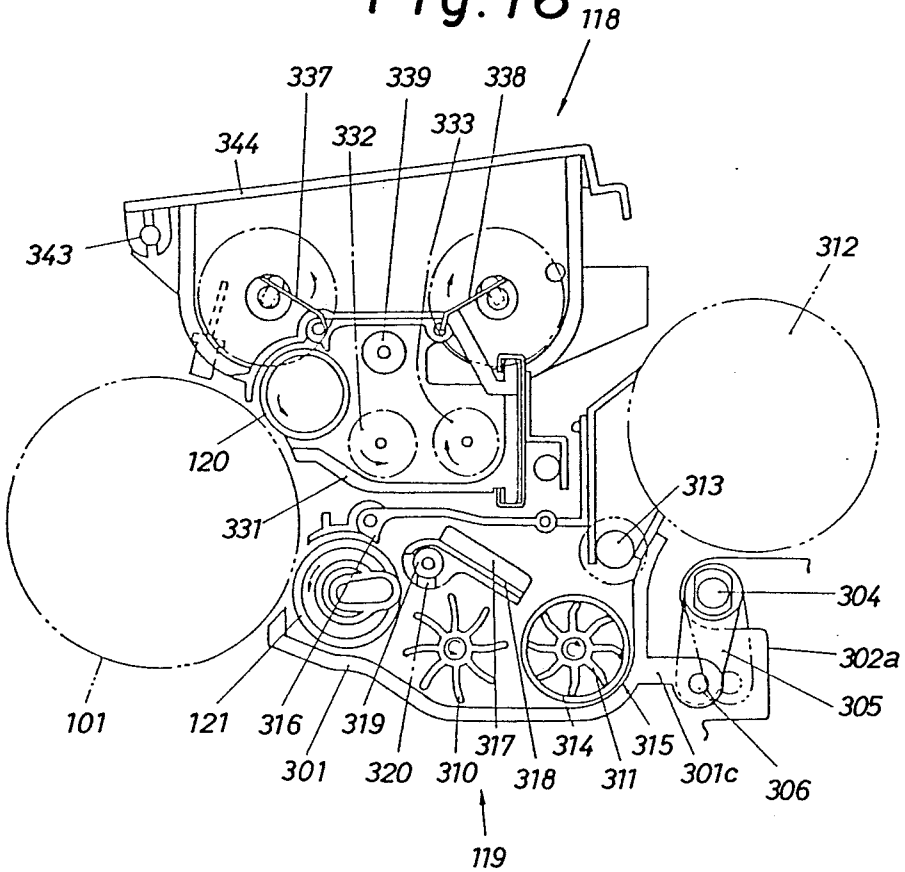
FIGS. 16 through 19 are a front elevational cross section view and a plan view of a black color developing device, as well as a plan view and a front elevational cross sectional view of a color developing device.
Figure 17:
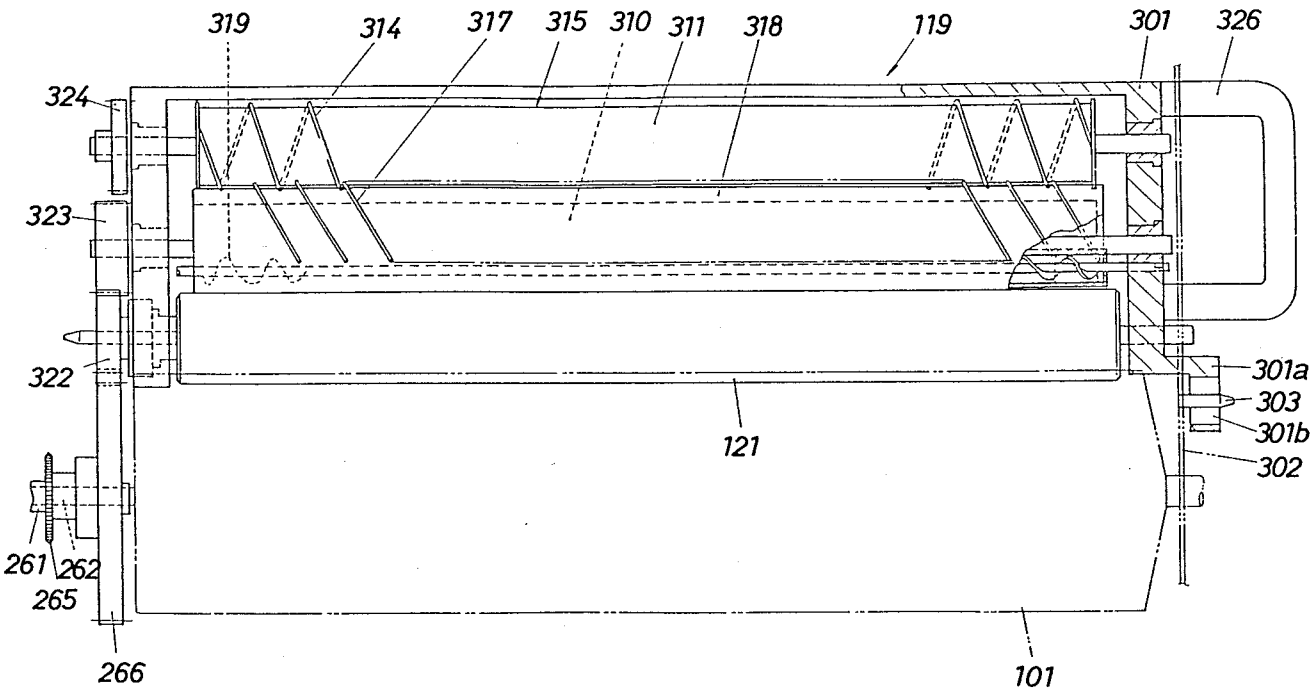

In the black color developing device 119 having thus been constituted, fresh toners supplied from the toner hopper 312 by way of the toner supply roller 313 are supplied on the mixing roller 315, while surplus toners are also supplied to the mixing roller 315 by way of the toner return guide plate 318, and these toners are sent toward the paddle wheel 310 by the rotation of the mixing roller 315 in the direction of the arrow shown in FIG. 16.

On the other hand, those toners supplied to the photosensitive drum 101 by the developing sleeve 121 but not used for the development are returned to the paddle wheel 310 by the rotation of the developing sleeve 120 in the direction of the arrow shown in FIG. 16.

Then, toners returned from the developing sleeve 121 by the rotation of the paddle wheel 310 in the direction of the arrow shown in FIG. 16 and the fresh toners supplied from the mixing roller 315 are mixed and then newly supplied to the developing sleeve 121 by way of the paddle wheel 310. In this case, the surplus toners controlled by the doctor blade 316 are supplied on the paddle wheel 310 from the opening 320 of the toner return guide plate 318.

Explanation will next be made as to the color developing device 118. For the unit case 331 of the color developing device 118, the developing sleeve 120 is so disposed that the developing sleeve 120 can be in contact with and apart from the surface of the photosensitive drum 101 in the same manner as the unit case 301 for the black color developing device 119 described above. The unit case 331, different from the unit case 301 for the black color developing device 119, is not engaged with the drum unit case 251 and the color developing device 118 is so adapted that it can be separated from the photosensitive drum 101 and pulled out by itself, so that the color change, etc. can be made with ease.

In the case 331, there are rotatably disposed a developing sleeve 120 for supplying toners to the photosensitive drum 101, a paddle wheel 332 for supplying the toners to the developing sleeve 120 as well as recovering the surplus toners, and a mixing roller 333 for supplying fresh toners to the paddle wheel 332 respectively.

The diameter of the developing sleeve 120 of the color developing device 118 is made smaller than the diameter of the developing sleeve 121 of the black color developing device 119. The developing performance is generally determined by the ratio between the diameter of the developing sleeve and the diameter of the photosensitive drum. However, comparing black toner with color toner, the former is used at a high frequency and requires particularly high image quality, whereas the latter is used at a low frequency and brings about no substantial problem if the image quality is relatively lower compared with that of the black color and it is rather desirable to reduce the volume of the device. In view of the above, the diameter of the developing sleeve 120 of the color developing device 118 is made smaller as compared with the diameter of the developing sleeve 121 of the black color developing device 119 to thereby reduce the size of the color developing device.

Further, in the same manner as the mixing roller 315 for the black color developing device 119 described above, the paddle wheel 332 has wires spirally wound counterclockwise along the circumference of the paddle wheel, while the mixing roller 333 also has wires spirally wound clockwise along the outer circumference of the paddle wheel.

The unit case 331 is extended axially beyond the frame 302 to from toner mixing portion 331*a*, a toner hopper 336 of the toner supply portion 335 is integrally formed at the upper portion of the toner mixing portion 331*a*, while the paddle wheel 332 and the mixing roller 333 are also extended axially so as to be situated in the toner mixing portion 331*a*.

Since the toner hopper 336 for the color developing device 118 is disposed on the side of the drum 101 while making the shape thereof different from that of the toner hopper 312 for the black color developing device 119 to reduce the height of the developing section itself, the space occupied by the developing section, particularly, in the direction of the height is reduced thereby enabling to decrease the size of the image-forming device itself as compared with the case where the configuration of the toner hopper for the color developing device 118 is made identical with that of the toner hopper for the black color developing device 119.

Two agitators 337 and 338 are rotatably mounted within the toner hopper 336, a toner supply roller 339 is rotatably mounted between the agitators 337 and 338 and seals 341 and 342 forming a toner supply port are in contact with the toner supply roller 339.

A cover 334 capable of opening and closing around a shaft 343 as a fulcrum is attached on the toner hopper 336. Further, a color toner end sensor 345 comprising a vibration sensor for detecting the toner end is attached to the toner hopper 336.

A sleeve gear 346 meshing with the developing gear 266 for the drum unit as described above is secured to the developing sleeve 120, a paddle gear 347 meshing with the sleeve gear 346 by way of a gear not illustrated is secured to the paddle wheel 332, and a roller 348 meshing with the paddle gear 347 by way of a gear not illustrated is secured to the mixing roller 333, so that the paddle wheel 332 and the mixing roller 333 are rotated each in opposite direction.

Further, gears 351 and 352 formed integrally are secured to the agitator 337 in the toner hopper 336, while a gear 353 meshing by way of two gears not illustrated with one gear 351 and a gear 354 integrally formed with the gear 351 are secured to the agitator 338, and a gear 355 meshing with the gear 351 by way of two gears not illustrated is also secured to the toner supply roller 339.

Figure 19:
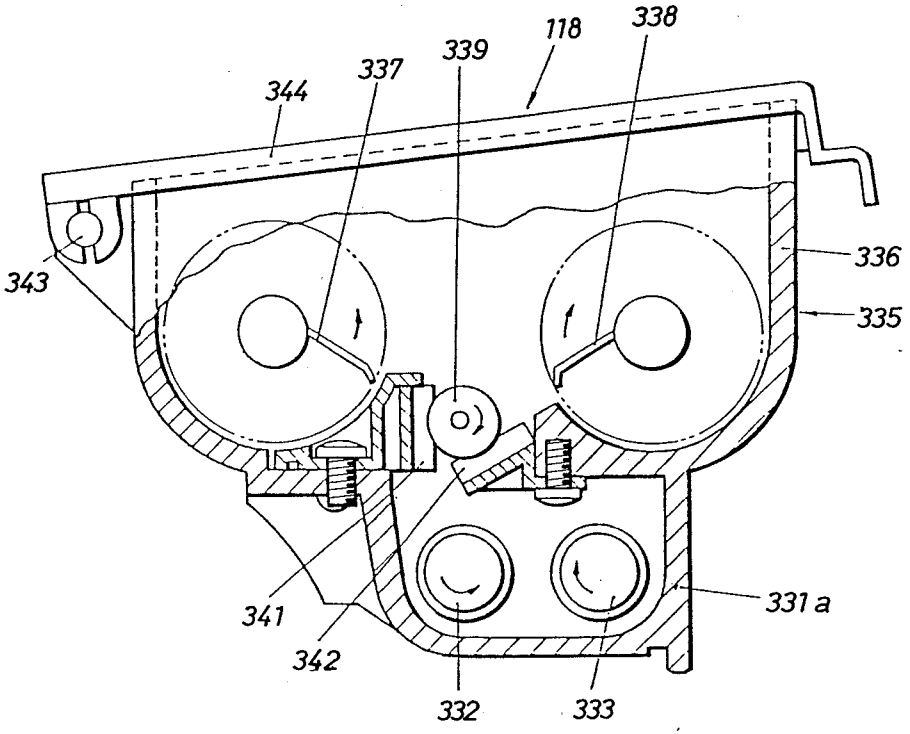

In the color developing device 118 having thus been constituted, the tow agitators 337 and 338 in the toner supply portion 335 rotate in the direction of the arrow shown in FIG. 19 to agitate the toners filled in the toner hopper 336 and the toner supply roller 339 is rotated to supply the toners on the paddle wheel 332 n the toner mixing portion 331*a*.

On the other hand, those surplus toners supplied to the photosensitive drum 101 by the developing sleeve 120 but not used for the development are returned to the paddle wheel 332 by the rotation of the developing sleeve 121 in the direction of the arrow shown in FIG. 16.

Figure 18:
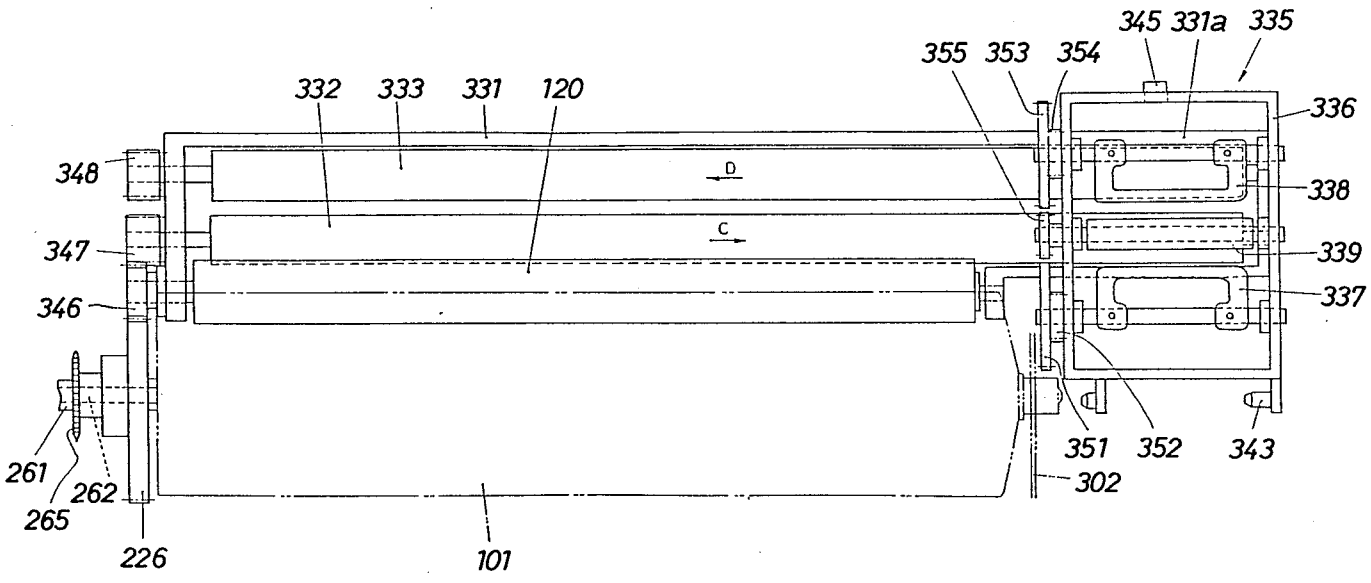

Then, the toners returned from the developing sleeve 121 by the rotation of the paddle wheel 332 in the direction of the arrow shown in FIG. 19 are moved in the direction of the arrow C in FIG. 18, returned to the inside of the toner mixing portion 331*a* and then mixed with fresh toners supplied from the toner hopper 336 as described above.

The toners in the tone mixing portion 331*a*, in the course of being supplied in the direction of the arrow D shown in FIG. 18 by the rotation of the mixing roller 333 in the direction of the arrow shown in FIG. 19, are supplied again by the paddle wheel 332 to the developing sleeve 120.

Since the surplus toners are recovered by the paddle wheel 332 into the toner mixing portion 331a at the outside of the developing device and, after being mixed with the fresh toners, are transported again by the mixing roller 333 to the inside of the developing device, the toners can surely be supply even in a case where the toner hopper 336 is disposed on the side of the developing device as described above.

As has been described above, the color developing device 118 and the black color developing device 119 are respectively disposed so that they can be brought into contact and apart from the photosensitive drum 101. Upon color development, the color developing device 118 is brought into contact, while the black color developing device 119 is separated from the photosensitive drum 101. Upon black color development, while color developing device 118 is kept apart from and the black color developing device 119 is brought into contact with the photosensitive drum 101. Further, in the case where the copying operation is not being conducted, both the color developing device 118 and the black color developing device 119 are separated.

Although it is also possible to maintain them as they are in the copy operation state when the copying operation is not conducted, since the color developing device 118 is adapted so as to be pulled out being separated from the photosensitive drum 101, injury to the surface of the photosensitive drum 101 upon mounting and detaching the color developing device 118 can be avoided by putting the color developing device 118 in the separated state. If the black color developing device 119 is also adapted so that it can be pulled out being separated from the photosensitive drum 101, injury to the photosensitive drum 101 can also be prevented by putting the device also in the separated state.

In this way, in the color developing device 118, since the surplus toners are moved by the paddle wheel 332 to the toner mixing portion 331*a* at the outside, mixed with fresh toners and, thereafter, sent out again by the mixing roller 333 from the toner mixing portion 331*a* and supplied by way of the paddle wheel 332 to the developing sleeve 120, the size of the developing device can be reduced without degrading the developing performance.

For the color developing device 118 and the black color developing device 119, if the toner end is detected by the toner end sensor 345 in the color developing device 118, the toner supply roller 339 is rotated to supply a predetermined amount of toners. Further, the toner supply roller 313 is rotated to supply the toners according to the density detected by the P-sensor 257 as described above in the black color developing device 119.

Explanation will next be made as to the toner density detection using a P-sensor while referring to the Figures 20 and 21.

Figure 20:
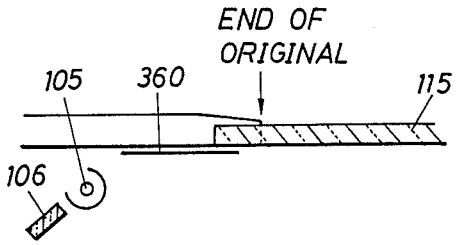
FIGS. 20 and 21 are explanatory views for the toner density detection by a P sensor.
Figure 21:
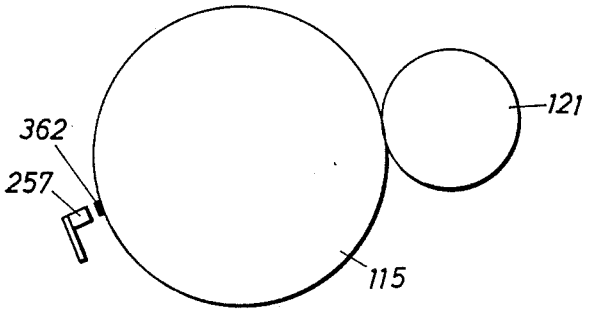

As shown in FIG. 20, since the P-sensor pattern 360 is attached to the lower surface of the contact glass 115 to the left of the top end position of the original, the P-sensor pattern image 362 is formed before the original image at the surface of the photosensitive drum 101 as shown in FIG. 21.

Then, the P-sensor pattern image 362 is moved to the position for the P-sensor 257 without transfer to the copy paper by controlling the paper feed timing, light is irradiated to the P-sensor pattern image 362 by the light emitting element of the P-sensor 257 and the reflection light therefrom is received by the photo-receiving element, by which the density of the P-sensor pattern image 362 is detected and the toner supply amount is controlled depending on the result of the detection.

The toner density detection using the P-sensor is conducted, for example, to the first paper sheet after the turn ON of the power source and on every 10 paper sheets thereafter. Then if it is detected that the toner density is low, the toner supply roller 313 is turned ON on every paper sheet to continue the toner supply till the next detection for the toner concentration.

For the color toners, it is possible to conduct the abnormality judging, etc. based on the result of the toner density detection by the P-sensor 257.

Figure 22:
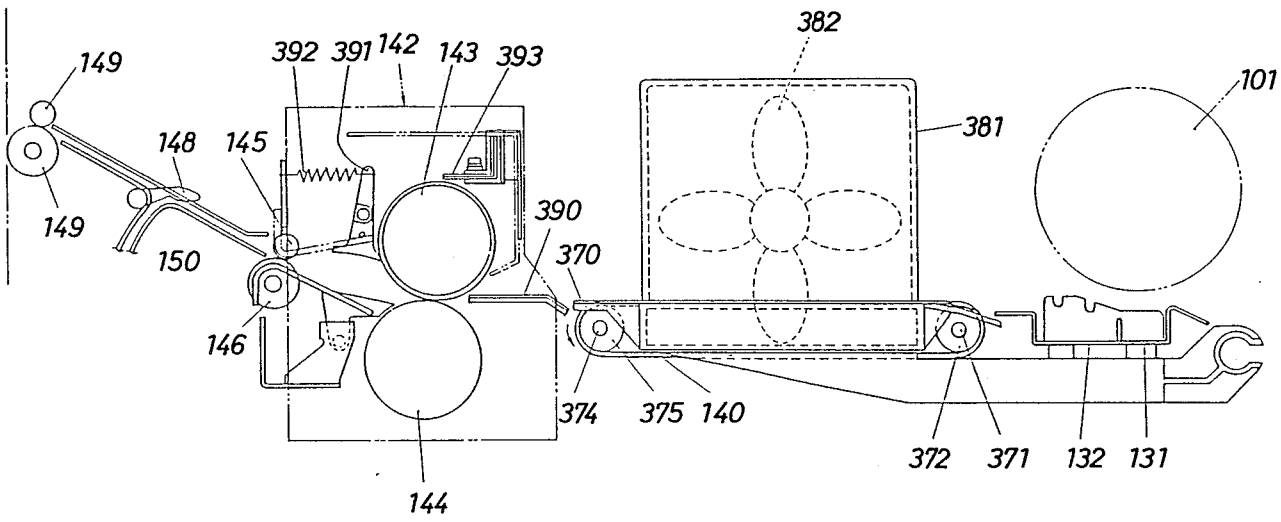
FIGS. 22 through 24 are a front elevational cross sectional view, a plan view and a side elevational cross sectional view, respectively, for providing an explanation of the fixing unit.
Figure 23:
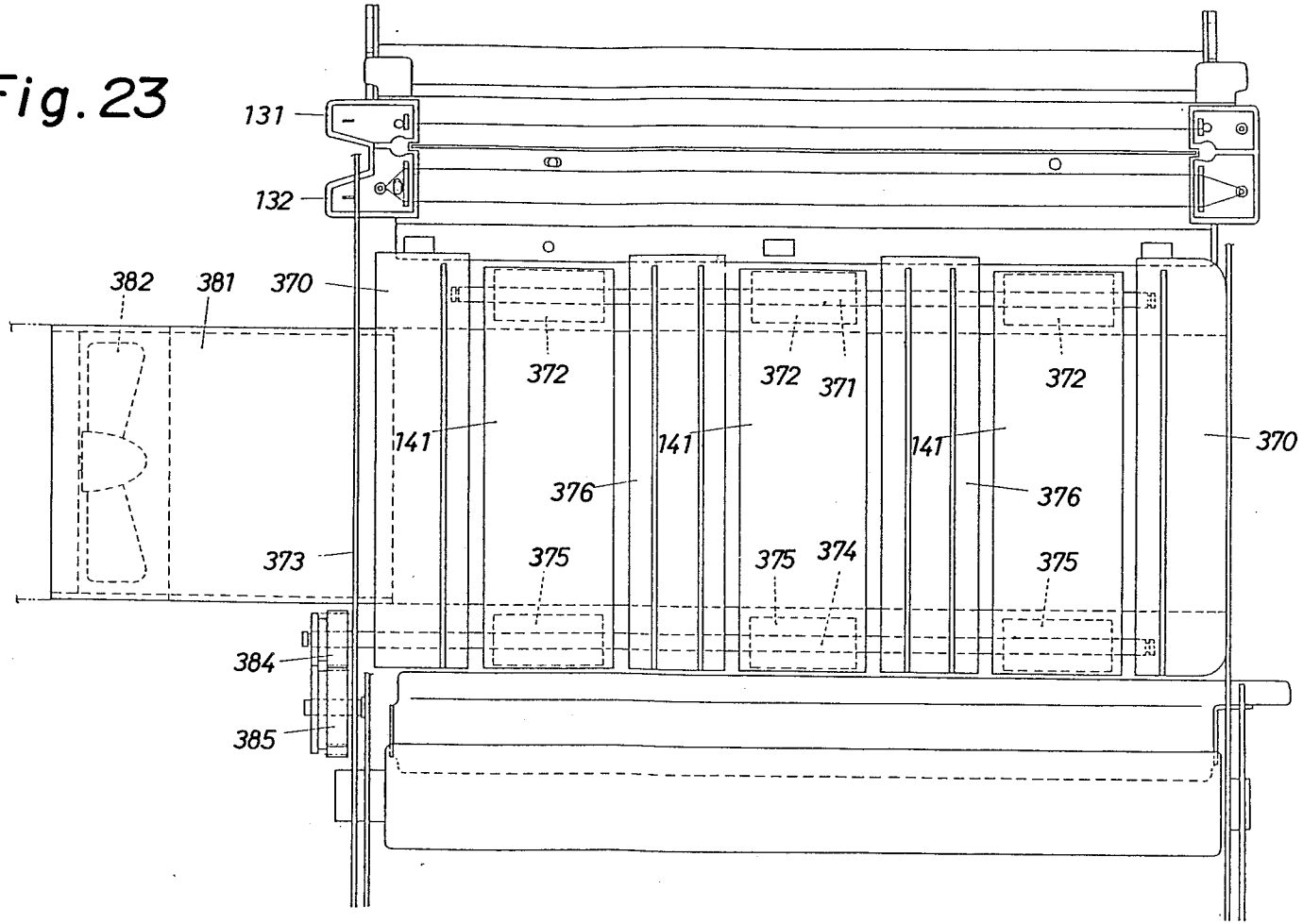
Figure 24:
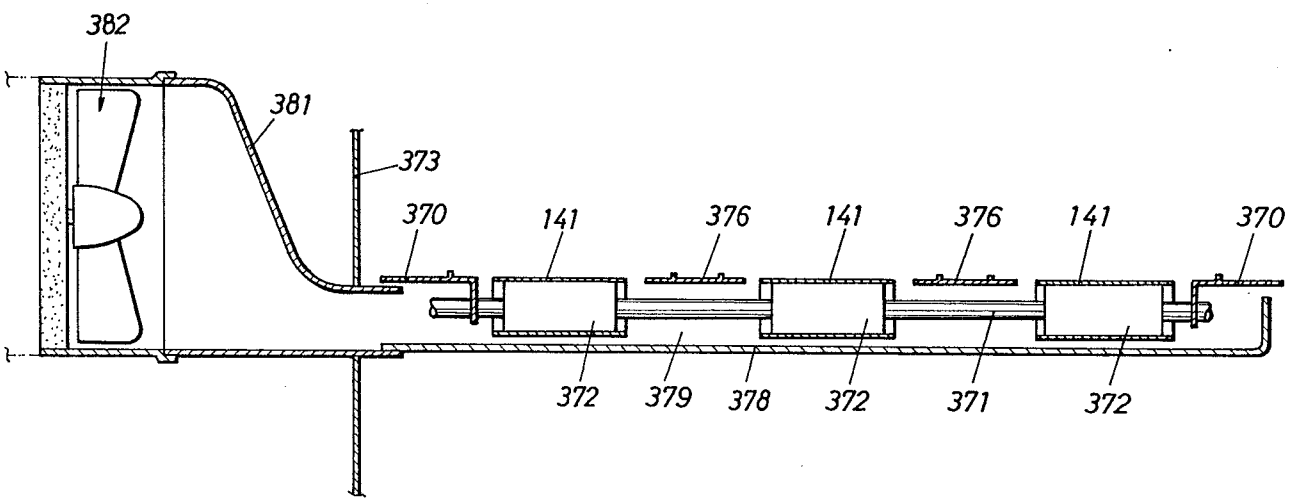

FIGS. 22 through 24 are, respectively, a schematic front elevational view, a plan view and a cross sectional side elevational view for the conveying unit and the fixing device.

Explanation will next be made relating to the conveying unit. As shown in FIG. 23, three rollers 372 are secured at predetermined intervals to a rod 371 rotatably journaled between sub-frames 370 and 370 which also serve as a paper guide, three rollers 375 are secured at predetermined intervals to a rod 371 rotatably journaled between the frame 373 and another frame not illustrated, a conveyor belt 141 is stretched between each of the rollers 372 and 375, and paper guides 376 and 376 are disposed between each of the conveyor belts 141 and 141.

A partition plate 378 is disposed at the bottom of the conveying unit and a duct 381 is connected with a space defined by the partition plate 378, the conveying belt 141, the paper guide 376, etc. and a blower 382 is disposed in the duct 381.

A gear 384 is secured to the rod 374 and a gear 385 for transmitting the rotation of the main motor 100 is meshed with the gear 384.

In the conveying unit, air is drawn through each of the gaps between the sub-frame 370 and the conveying belt 141 and between the paper guide 376 and the conveying belt 141 by the rotation of the blower 382 to bring the transfer paper into a tight contact with the surface of the conveying belt 141, and the paper separated from the photosensitive drum 101 is sent into the fixing device.

Explanation will next be made as to the fixing device 142. The fixing device 142 comprises a heater roller 143 having two heaters in its inside and a pressure roller 144 in contact with the heater roller 143, in which the paper sent from the conveying unit is supplied between the heater roller 143 and the pressure roll 144 while being guided along the guide plate 390, applied with heat-roll fixing, and after the fixing, discharged through the gap between the rollers 145 and 146.

Since a separation plate 391 is in a tight contact with the heater roller 143 by means of a tension coil spring 392, rolling up of the paper can be prevented. Further, a fixing temperature sensor 393 comprising a non-contact type thermister is disposed above the heater roller 143 for detecting the fixing temperature.

FIG. 25 through FIG. 32 are, respectively, a front elevational view of a paper feed unit, a front elevational view of a paper feeding mechanism and a front elevational cross sectional view of a different portion thereof, a plan view for a main portion and a front elevational view in cross section of a different portion thereof.

Referring at first to the upper feed cassette 9 and the lower feed cassette 10, an explanation will be made, for example, of the paper feed cassette 9 since both of the cassettes have the similar constitution. The upper feed cassette 9 has in its interior a bottom plate 402 attached to a support plate 401 rotatably journaled to the side plate and mounted on a cassette table 403.

The cassette table 403 has a recess **403*a* on the right for allowing the bottom plate lift arm described later to enter and has on each side a retention portion 407 for engaging a plurality of cassette table guide rollers 406 rotatably journaled to a cassette rail 405**.

The upper feed cassette 9 can be set to the inside of the copying apparatus main body 1 by mounting the cassette on the cassette table 403 and then pushing the cassette table 403 into the copying apparatus main body 1.

The upper feed cassette 9 can be removed from the interior of the copying apparatus main body 1 by pulling out the cassette table 403 and then taking out the upper paper feed cassette 9 from the cassette table 403. In a case where the feed cassette 9 is adapted to be set in the copying apparatus main body 1 by mounting the feed cassette 9 on the cassette table 403, the cassette take out procedure can be facilitated by adopting such a structure that the cassette table 403 is automatically popped out a predetermined amount by pushing a cassette take out button disposed to the outside.

Further, a mechanical type paper size sensor 412 is attached to the side frame 411 for detecting the size of the paper set in the upper feed cassette 9 or the lower feed cassette 10. The paper size sensor 412 comprises a switch having five retractable detection pins 413 energized in the protruding direction. When any one of the detection pins 413 is forceably inserted by the upper feed cassette 9 or the lower feed cassette 10 the switch is actuated to detect the size of the paper.

Figures 25, 25A:
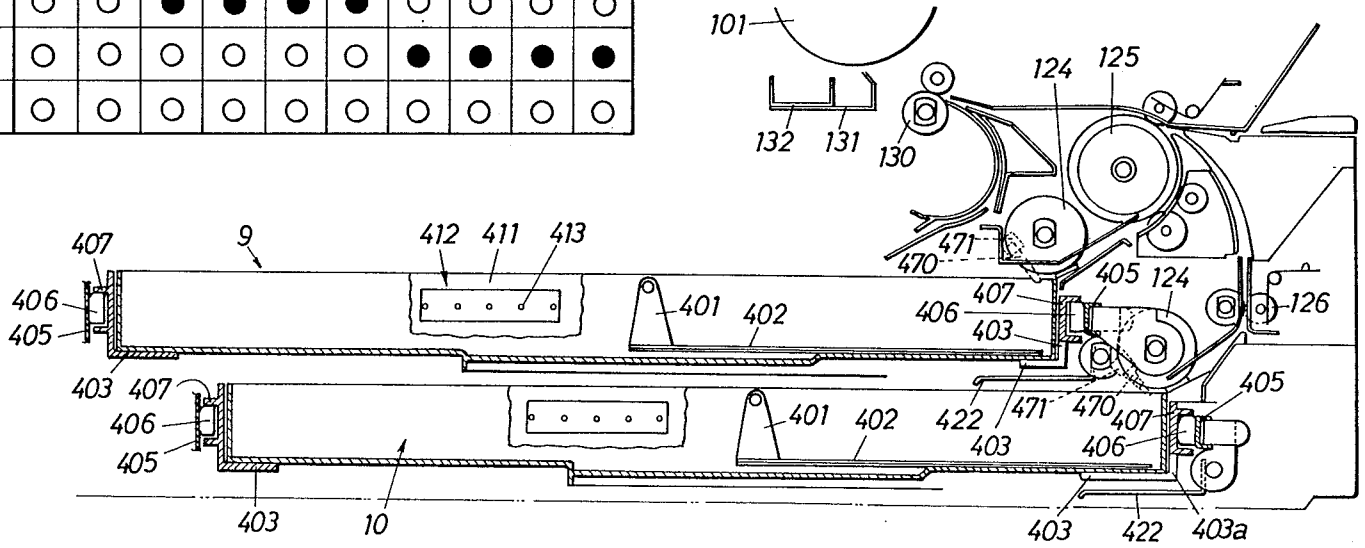
FIGS. 25, 25A and FIGS. 26 through 32 are a front elevational cross sectional view for the explanation of a paper feed unit, an explanatory view for providing an explanation of a size detection code, as well as a front elevational cross sectional view, a plan view, a front elevational cross sectional view, a plan view for a portion and a cross sectional view for a different portion of the paper feeding mechanism.

FIG. 25A shows a relationship between the size detection code and the size of the paper. In the drawing, the black circle means switch OFF, while the white circle means switch ON.

Figure 26:
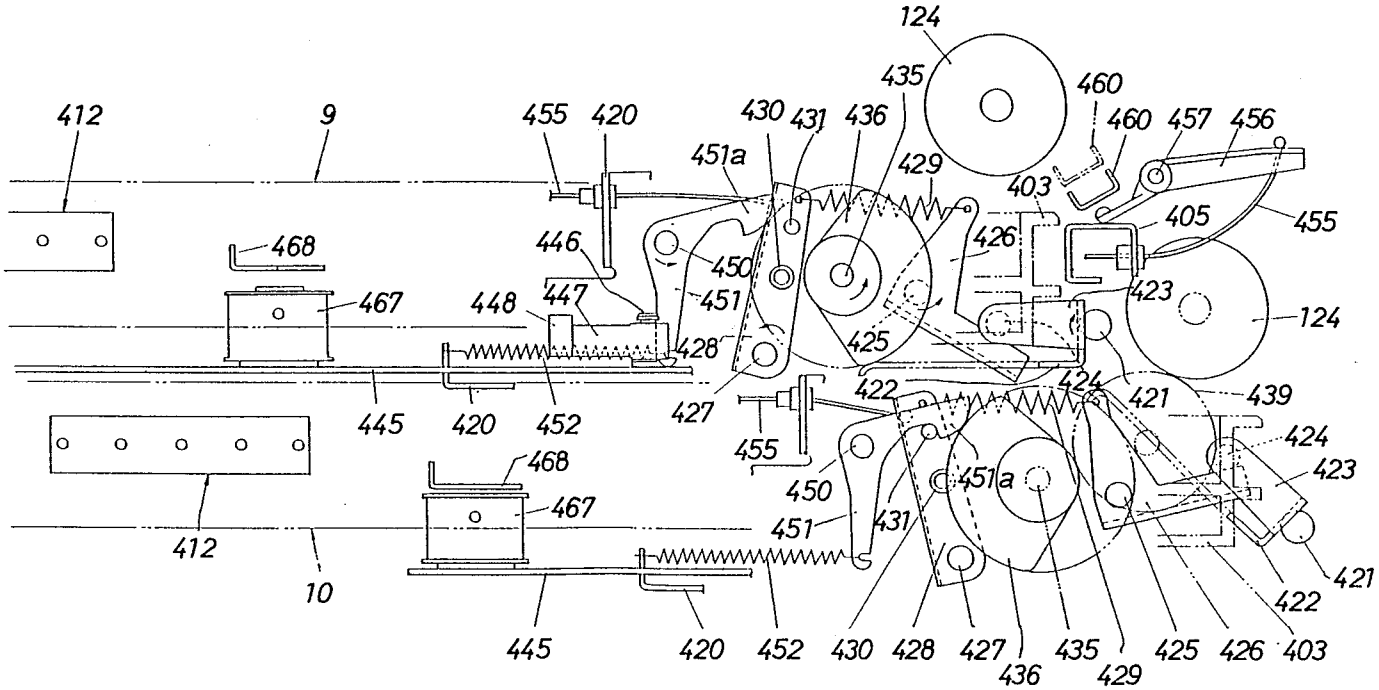

Explanation will next be made regarding the paper feeding mechanism. As shown in FIG. 26, a shaft 421 is rotatably disposed to a side frame 320 on the right of the cassette table 403, and a bottom plate lift arm 422 and an arm 423 for lifting the bottom plate 402 of the paper feed cassettes 9 and 10 on the cassette table 403 are secured to the shaft 421.

A pin is planted to the top end of the arm 423, and an arm 426 substantially of an L-shaped configuration rotatably journaled to a shaft 425 secured to the side frame 420 is engaged at one end to the pin 424.

A tension coil spring 429 is connected between the other end of the arm 426 and the top end of a cam follower 428 rotatably journaled by a shaft 427 secured to the side frame 420. A cam roller 430 is planted at the center of the cam follower 428 and a pin 431 is planted at the top end thereof.

A shaft is rotatably attached to the side frame 420, and a cam 436 capable of abutting against the cam roller 430 of the cam follower 428 is rotatably mounted to the shaft 45. Further, a spring clutch 437 is rotatably mounted so as to be in contact with the cam 436 and a gear 438 connected with the spring clutch 437 is meshed with a gear 439 for driving the feed roller 124.

An engaging plate 441 having an engaging piece 441*a* is disposed for corresponding to a protrusion 437*a* of the spring clutch 437, and the engaging plate 441 is resiliently biased by a tension coil spring 442 in the direction of a spring clutch 437. A solenoid 443 is disposed for releasing the engagement between spring clutch 437 and the engaging plate 441.

On the other hand, a shaft 446 is planted to a bottom sub plate 445 and an arm 447 is rotatably mounted to the shaft 446. A roller 448 is attached at one end of the arm 447, which is pressed by the side of the cassette table 403 when the cassette table 403 is pushed further from the set position.

A ratch plate 451 substantially of an L-shaped configuration is rotatably journaled by means of a shaft 450 secured to the side frame 420, and a ratch plate 451 is formed at one end thereof with an engagement 451*a* capable of engaging the pin 431 of a cam follower 428, while a tension coil spring 452 is connected between the other end thereof and the side frame 420.

The other end of the ratch plate 451 is engaged with the other end of the arm 447.

One end of the wire 455 is engaged with the top end of the cam follower 428 and the other end of the wire 455 is engaged by way of the side frame 420 and the cassette rail 455 with a pad rotation arm 456.

The pad rotation arm 456 is rotatably journaled by way of a shaft 457 and the top end of the pad rotational arm 456 is situated at the rear end of the pad arm 460.

The pad arm 460 is rotatably journaled by way of a shaft 461 to a mounting plate 405a attached to the cassette rail 405, and a shaft 464 disposed at the top end thereof rotatably journals a pad support member 463 for supporting a friction pad 462 in contact with the paper feed roller 124. A tension coil spring 465 rotationally biases the friction pad 462 in the direction to the surface of the feed roller 124.

Further, an engaging plate 468 is disposed to the bottom sub plate 445 and actuated by a solenoid 467 for inhibiting the cassette table 403 from being taken out during use or upon jamming.

Further, as shown in FIG. 25, a paper end sensor 471 of a photosensor comprising a light emitting element and a photoreceiving element is disposed as shown in FIG. 25 above each of the feed cassettes 9 and 10.

FIG. 26 shows a state where the upper feed cassette 9 is not yet been loaded.

Then, if the upper feed cassette 9 is put on the cassette table 403 in this state and set by pushing the cassette table 403 in, the solenoid 443 is turned ON to release the engagement of the spring clutch 437 with the engaging plate 441.

Thus, the rotation of the spring clutch 437 is transmitted to the cam 436 thereby rotating the cam 436 in the direction of the arrow shown in FIG. 26. Since the cam 436 abuts against the cam roller 430 of the cam follower 428 at a predetermined position and pushes the cam follower 431, the cam follower 428 is rotated in the direction of the arrow shown in the drawing.

Since the arm 426 rotates in the direction of the arrow shown in FIG. 26 and lifts the arm 423 by the rotation of the cam follower 428 by way of the spring 429, the bottom plate lift arm 422 rotates in the direction shown by the arrow in the drawing, enters the upper feed cassette 9, lifts the bottom plate 402 of the upper feed cassette 9 and brings the paper into contact with the feed roller 124 for assuming a state capable of paper feeding.

Figure 30:
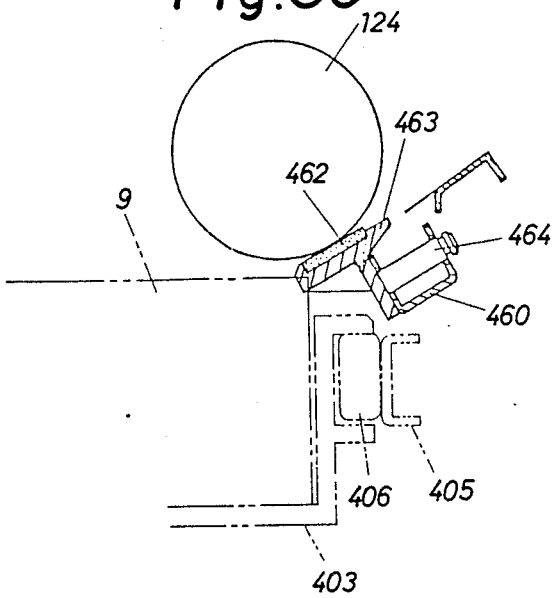
Figure 31:
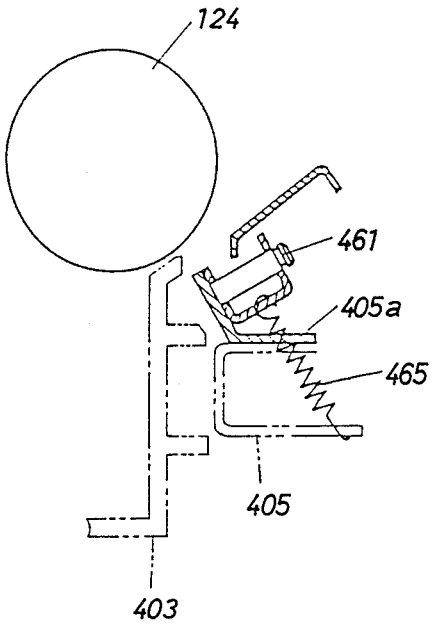
Figure 32:
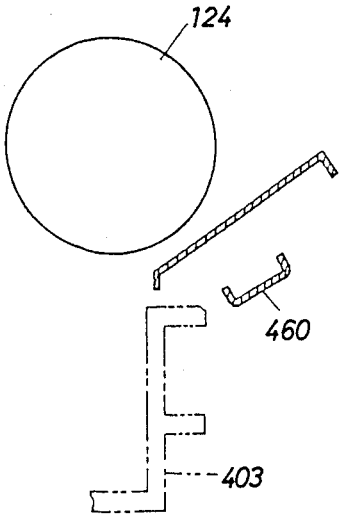

Simultaneously, the wire 455 engaged with the cam follower 428 is slackened and the pad arm 460 rotates by the returning force of the spring 465 to a position shown by the phantom line, by which the friction pad 426 presses the feed roller 124 as shown in FIG. 30.

The pin 431 of the cam follower 428 is engaged with the engagement 451a of the clutch plate 451 at a predetermined position and maintained at the engaged state.

Then, when a print start switch is depressed, the paper feed solenoid is turned ON to actuate the paper feed clutch, by which the rotation of the gear 439 is transmitted to the feed roller 124 and the feed roller 124 rotates to feed the uppermost paper set on the paper feed cassette 9.

Figure 27:
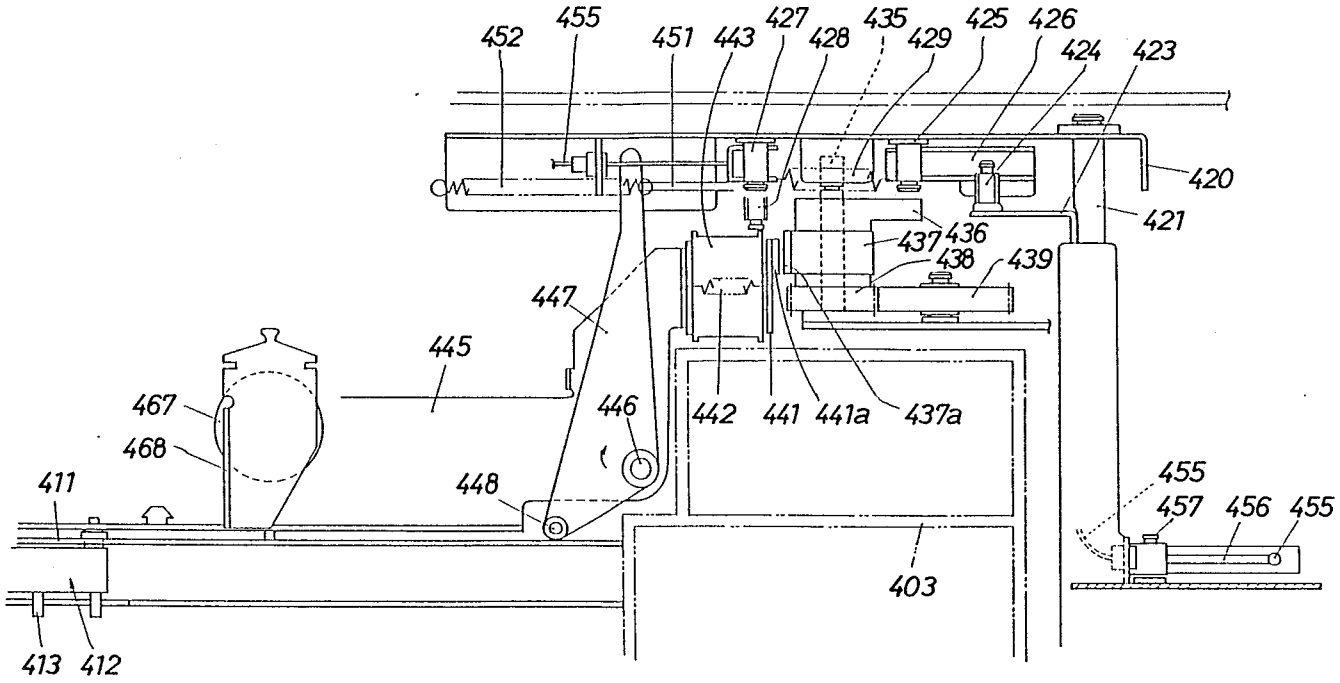
Figure 28:
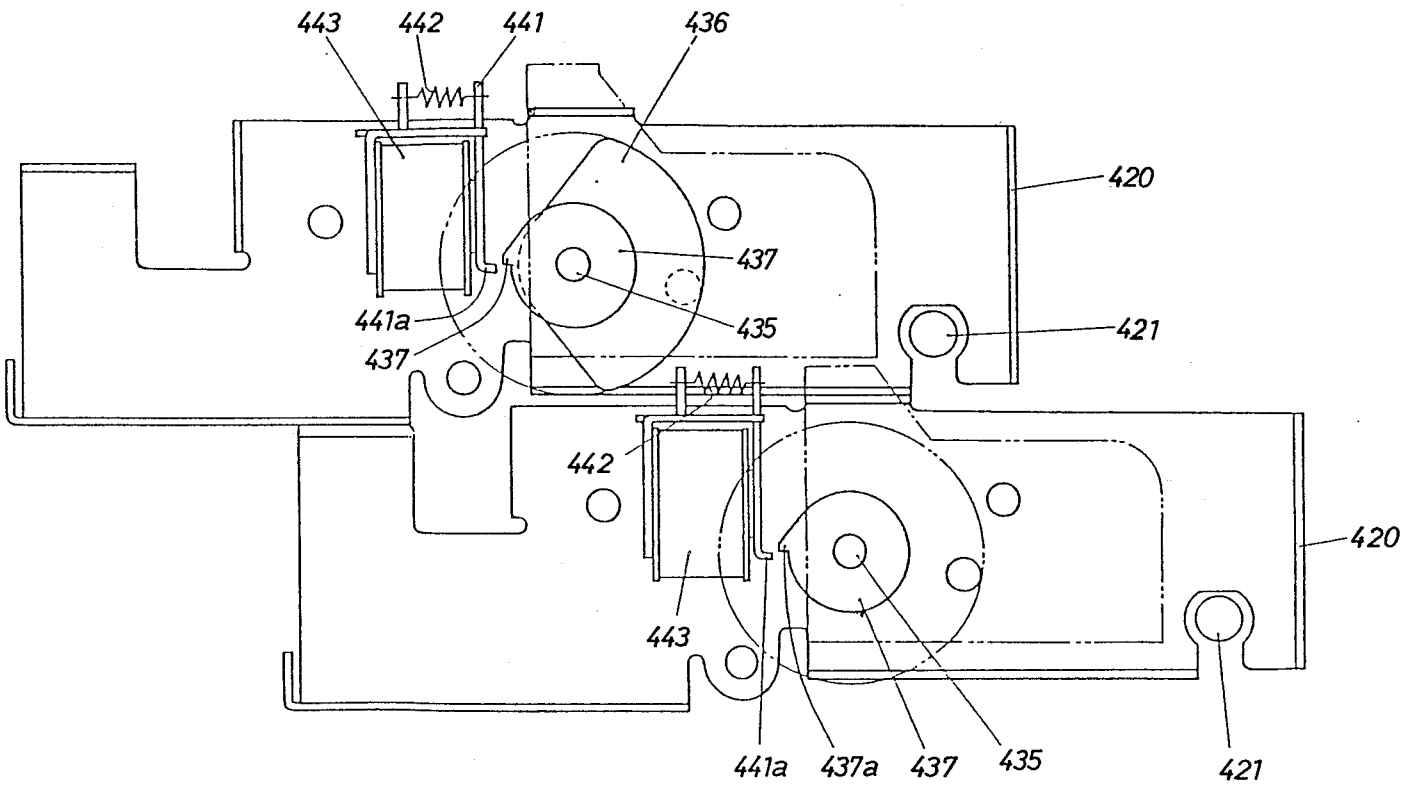
Figure 29:
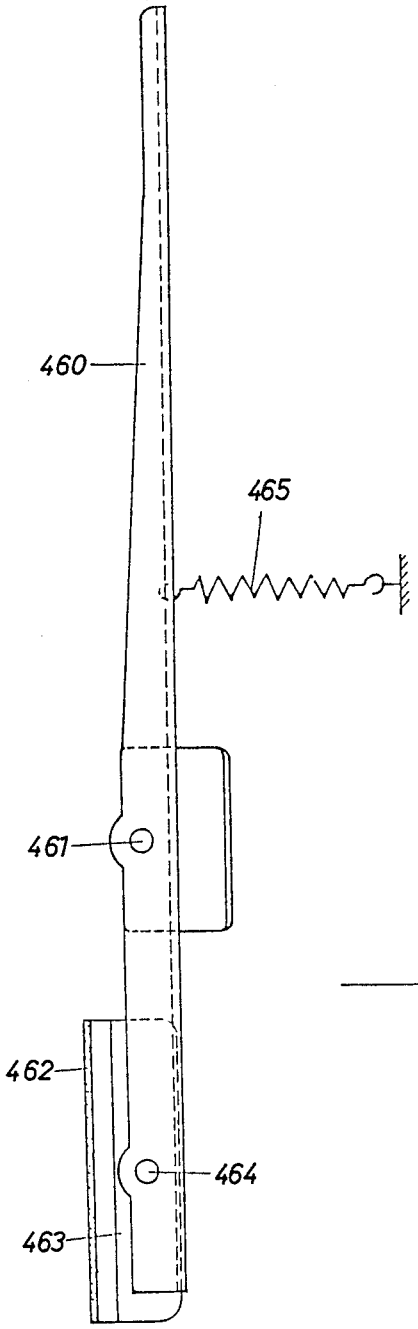

For taking out the lower feed cassette 10, the cassette table 403 is pushed further from the set position, by which the roller 448 of the arm 447 is pushed to rotate the arm 447 in the direction of the arrow shown in FIG. 27 and the clutch plate 451 rotates in the direction of the arrow shown in FIG. 26 to release the engagement of the cam follower 428.

Thus, since the cam follower 428 rotates in the direction opposite to that shown by the arrow in FIG. 26, the pad arm 460 rotates against the spring 465 by being pulled at the rear end of the pad rotation arm 456 by way of the wire 455, the friction pad 462 aparts from the feed roller 124 and the arm 426 returns to the initial state, the bottom plate lift arm 422 aparts from the cassette table 403 and returns into the initial state, and the cassette table 403 is put into a state capable of taking out.

Further, in the paper feeding mechanism, the bottom plate lift arm 422 may be lifted by rotating the gear 439 by driving the main motor 100 upon setting the cassette table 403. In this case, if the paper cassettes containes no paper, the paper end is displayed directly upon setting the cassette table 403.

Alternatively the main motor 100 may be driven upon depressing a print start switch to lift the bottom plate lift arm 422 to establish a state capable of paper feeding. In this case, if the paper cassette contains no paper, paper end is displayed upon depressing the print start switch.

Figure 33:
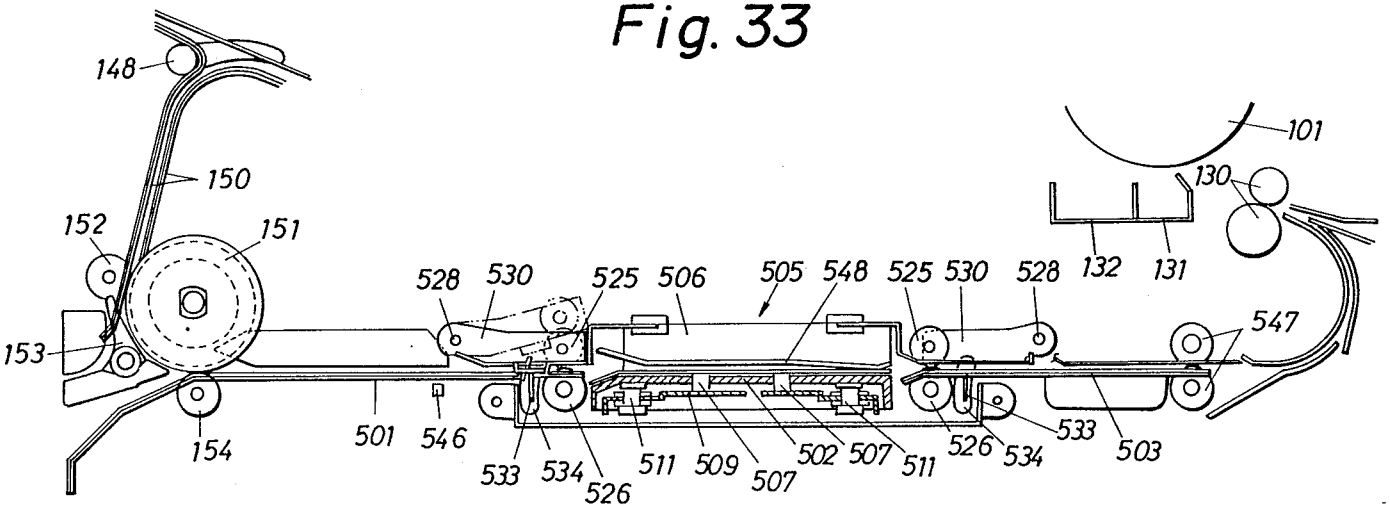
FIGS. 33 through 35 ar a front elevational cross sectional view, a front elevational view for a main portion and a plan view, respectively, for providing an explanation of the conveying unit.
Figure 34:
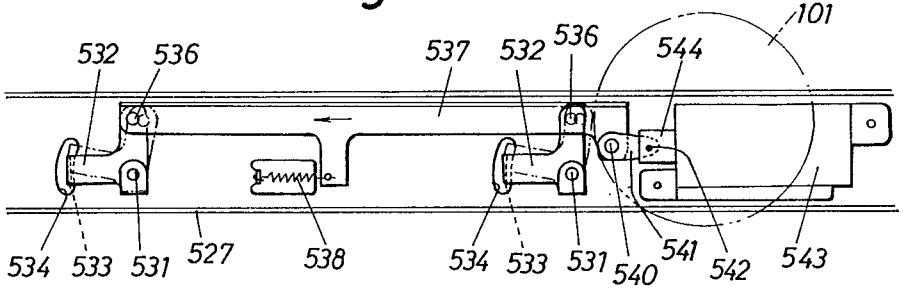
Figure 35:
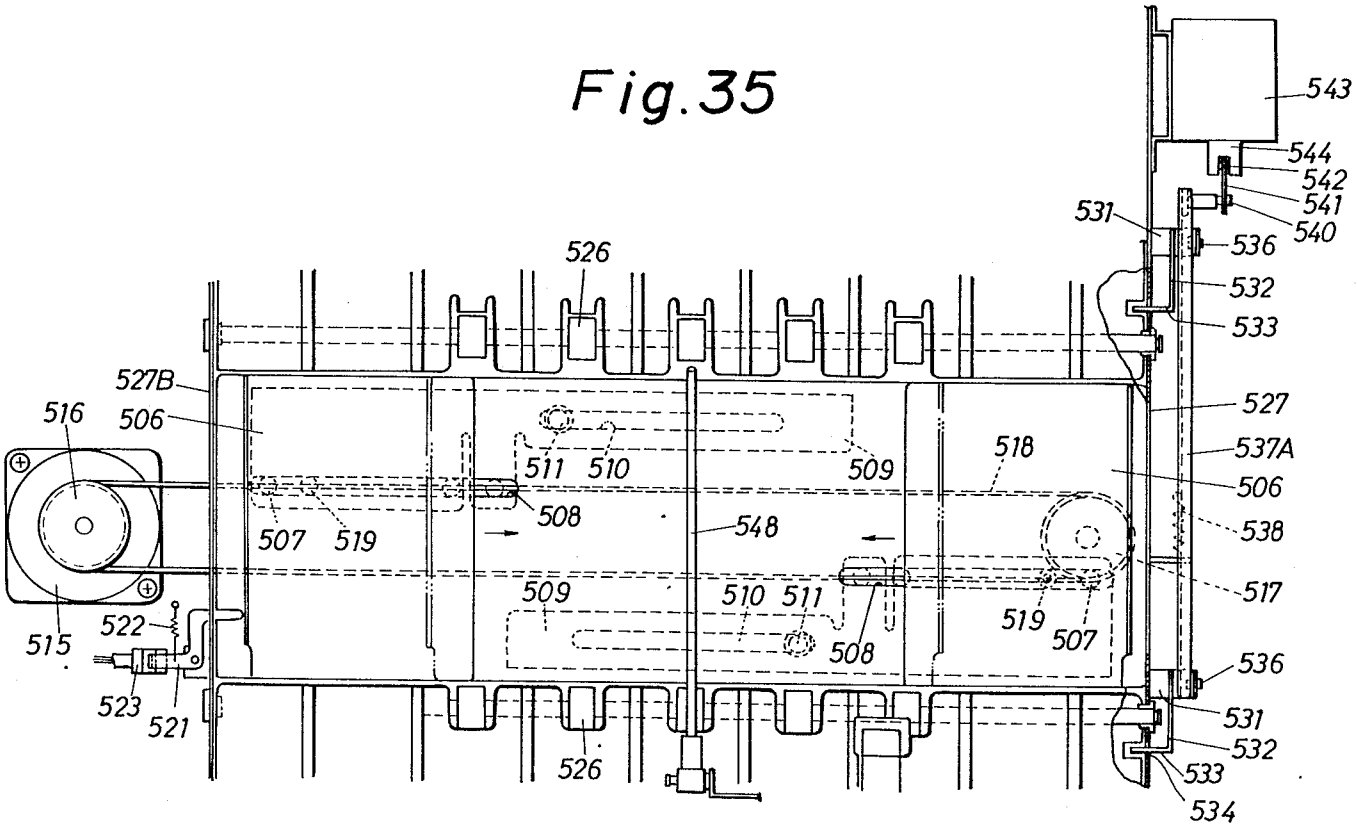

FIG. 33 through FIG. 35 are a front elevational view in cross section of a synthesis/both faces conveying unit, a front elevational view and a plan view for a main portion thereof, respectively.

The synthesis front and back faces conveying unit comprises a switching finger 148, a guide 150, guide plates 501, 502 and 503 for guiding a paper sent through the gap between rollers 151, 152 and a roller 154. A jogger device 505 is disposed above the guide plate 502 for arranging the paper.

The jogger device 505 comprises two joggers 506 slidably mounted on a guide plate 502. Pins 507 are planted at the lower surface of the jogger 506, and the pins 507 are passed through long holes 508 formed int he guide plate 502, and the lower end of the pin 507 is secured to the sub plate 509. Pins 511 planted on the lower surface of the guide plate 502 are engaged with the long holes 510 formed in the sub plate 509.

A jogger motor 515 comprising a step motor and a wire 518 stretched between a pulley 516 secured to the rotating shaft of the jogger motor 515 and a pulley 517 rotatably disposed below the guide plate 502. A wire 518 is secured to the pins 519 and 519 positioned on the lower surface of each of the joggers 506, so that each of the joggers 506, 506 each moves slidably in the opposite direction when the jogger motor 515 rotates.

Further, a rotatable sensor member 521 capable of abutting against the side of the jogger 506 is disposed and resiliently biased rotationally by a spring 522. A jogger home position sensor 523 of a photosensor composed of a light emitting element and photoreceiving element opposed to each other on both sides of sensor member 521 is utilized.

On the other hand, as shown in FIG. 33, each pair of conveyor rollers 525 and 526 opposed to each other on both sides of a conveying path is disposed before and after the jogger device 505, in which the conveyor roller 52 is rotatably attached to an arm 530 which rotatably journaled on a shaft 528 secured to a frame 527A and a frame 527B.

Then, a lever 532 substantially of an inverted L configuration is rotatably journaled to the frame 527A by means of a shaft 531. A bent portion 533 is formed at one end of the lever 532 and the bent portion 533 is abutted against the lower surface of the arm 530 by way of a curved long hole 534 formed in the frame 527A.

Further, a link 537 is rotatably journaled to the other end of the levers 532 and 532 by means of pins 536 and 536 and the link 537 is biased by a tension coil spring 538 in the direction of the arrow shown in FIG. 34 and the link 537 is connected by way of a pin 540, an arm 541 and a pin 542 to the plunger 544 of a solenoid 543.

Further, a paper sensor 546 comprising a photosensor is disposed below a guide plate 501 and a pair of feed rollers 547 is disposed at the guide plate 503. A paper retainer bar 548 is rotatably disposed in the middle of the guide plate 502.

In the synthesis front and back faces conveying unit thus constituted, when the top end of a paper sent through the gap between the rollers 151 and 154 has been conveyed by a predetermined distance after passing the paper sensor 546, the conveyance is interrupted.

Then, the solenoid 543 is actuated to retract the plunger 544 thereby pulling the link 537 against the returning tendency of the spring 538 to rotate each of the levers 532 and 532 simultaneously to the position shown by the phantom line in FIG. 34 and rotate each of the arms 530 and 530 to the position shown by the phantom line in the figure thereby retracting the conveyor rollers 525 and 525 from the paper.

Then, the jogger motor 515 is driven to move each of the joggers 506 and 506 till they are separated by a distance corresponding to the size of the paper. Since the size of the paper has previously been detected, each of the joggers 506 and 506 is previously displaced to a position somewhat broader than the size of the paper.

Then, the solenoid 543 is turned OFF to return each of the arms 530 and 530 to a position shown by the solid line in the figure to retain the paper by means of the conveyor rollers 525 and 525.

Then, paper feeding is started again and after feeding the paper to such a position as not to cause a positional deviation in the lateral direction, the joggers 506 and 506 are separated from each other by a distance somewhat larger than the size of the paper.

Further, if paper jamming or the like should occur, the solenoid 543 is also actuated to rotate the arm 530 and retract the conveyor roller 525 from the transfer paper to facilitate the removal of the jammed paper.

Figure 36:
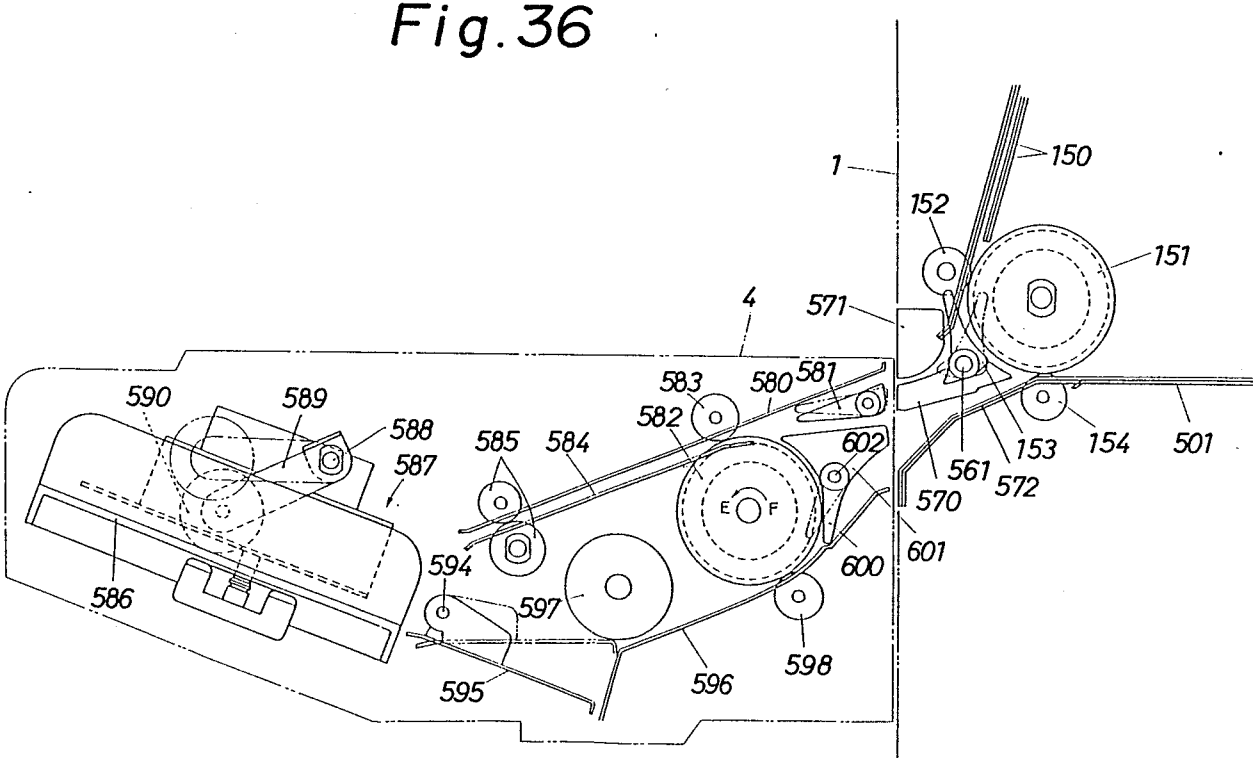
FIGS. 36, 37 and 38 are a front elevational view for an explanation of the switching portion and the synthesis-both faces unit, as well as a side elevational view and a front elevational view for illustrating the switching section.
Figure 37:
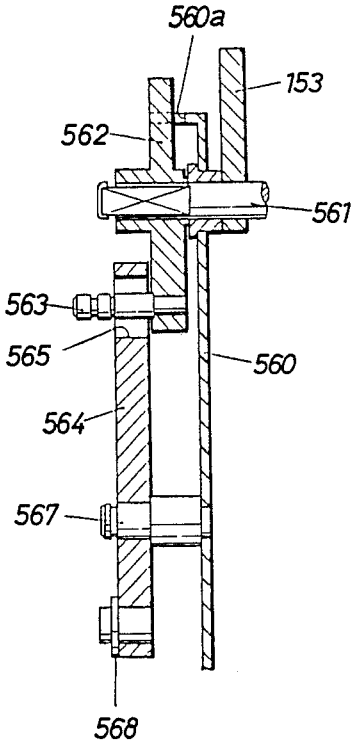
Figure 38:
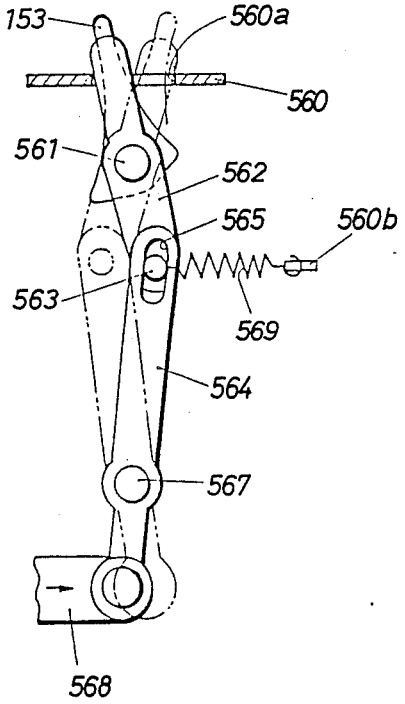

FIG. 36 through FIG. 38 are a side elevational view of a conveying path switching section and the synthesis both faces unit 4 of the copying apparatus main body 1, as well as a cross sectional view and a side elevational view of the conveying path switching section thereof.

Explanation will now be made as to the conveying path switching section of the copying apparatus main body 1. A direction switching member 153 is secured between rollers 152 and 154 to a shaft 561 rotatably attached to a subframe 560. Further, as shown in FIG. 37, a link 562 is secured at a middle portion thereof to the shaft 561. The top end of the link 562 passes through the inside of a groove **560*a* formed on the sub-frame 560 and a pin 563 planted at the rear end is engaged with a long hole 565 formed at the top end of the link 564**.

The central portion of the link 564 is rotatably journaled to a shaft 567 secured to the sub-frame 560 and a pin disposed to the lower end thereof rotatably supports a link 568 which is pushed in the direction of the arrow shown in FIG. 38 by a solenoid disposed inside of the synthesis/both faces unit 4 when the unit is mounted.

A tension coil spring 569 is connected between a pin 563 disposed at the link 562 and a protrusion **560*b* formed on the sub-frame 560 for for biasing each of the links 562 and 564, that is, the direction switching member 153 in the state shown by the solid line in FIG. 38. Guides 570, 571, 572 are disposed in the conveying path switching section, so as to guide the paper into the synthesis/both faces unit 4 and also guide the paper sent from the synthesis/both faces unit 4 to the gap between the rollers 151 and 154**.

In the conveying path switching section having thus been constituted, if the synthesis front and back faces unit 4 is not mounted or if the unit 4 is mounted but the solenoid disposed therein is turned OFF, the direction switching member 153 is maintained at the state shown by the solid line in FIG. 36 by the resilient force of the spring 569.

Accordingly, the paper conveyed from the guide 150 by way of the rollers 151 and 152 is guided along the circumferential surface of the roller 151 by the direction switching member 153, reaches the rollers 151 and 154 and is then sent into the synthesis/both faces conveying unit 4.

On the other hand, if the faces unit 4 is mounted and the solenoid disposed therein is actuated, the link 568 is pushed in the direction shown by the arrow in FIG. 38 by the plunger of the solenoid to rotate the links 564 and 562 to the position shown by the phantom line in the figure against the resiliency of the spring 569, by which the direction switching member 153 is also rotated in the direction shown by the phantom line.

Accordingly, the paper conveyed from the guide 150 by way of the rollers 151 and 152 is sent into the unit 4 by the direction switching member 153 while being guided by the guides 570 and 571.

Explanation will next be made as to the synthesis front and back faces unit 4. As shown in FIG. 36, a guide plate 580 for guiding the paper and a switching plate 581 also serving as the guide plate disposed rotatably below the guide plate 580 are disposed at the inlet of the unit 4.

An intermediate roller 582 capable of rotating forwardly and reversely is disposed near the center of the guide plate 580, a roller 583 is abutted against the intermediate roller 582 and, further, a guide plate 584 opposed to the guide plate 580 is disposed.

Discharge rollers 585 are disposed at the top end of the guide plates 580, 584 and an intermediate tray 586 slanting downwardly to the right is disposed below and in front of the discharge rollers 585. A jogger device 587 similar to the jogger device 505 as described above in conveying unit is disposed over the intermediate tray 586, a sponge roller 590 is attached at the top end of an arm 589 rotatably journaled by a shaft 588 and the sponge roller 590 is mounted on the intermediate tray 586.

Further, on the right of the intermediate tray 586, are disposed a pressure plate 595 rotatably journaled by a shaft 594 with the top end of the pressure plate 595 being opposed to one end of a guide plate 596 for guiding the paper to the inside of the copying apparatus main body 1, and a re-feed roller 597 pressed by the top end of the pressure plate 595 when the plate is lifted.

Further, the lower portion of the intermediate roller 582 is pressed by a roller 598, and a forked finger 600 is rotatably disposed by a shaft 602 attached to the guide plate 601 in front of the rollers 582 and 598.

In the faces unit 4 having thus, when the paper is sent from the copying apparatus main body 1, the switching plate 581 is at a position shown by the solid line int he figure and the paper sent into the unit is guided by the guide plate 580 and the switching plate 581, discharged by the rotation of the intermediate roller 582 in the direction of the arrow E from the discharge rollers 585 and 585 by way of the guide plates 580 and 584 onto the intermediate tray 586 and caused to slide downwardly on the intermediate tray 586 and the pressure plate 595 till the top end of the paper abuts against the guide plate 596.

Then, after arranging the paper in the same manner as described above by the jogger device 587, the pressure plate 595 rises to feed the paper again to the re-feed roller 597.

Then, in case of the two sided copy, the forked finger 600 is in the state shown by the solid line in which the paper is guided by the both faces/synthesis forked finger 600, a guide plate 601 and the circumferential surface of the intermediate roller 582 by the rotation of the intermediate roller 582 in the direction of the arrow E and once sent to the space between the guide plates 580 and 584. In this case, the rotation of the intermediate roller 582 is controlled so that the rear end of the transfer paper is held between the intermediate roller 582 and the roller 583.

Then, the intermediate roller 582 is rotated reversely in the direction of the arrow F and the switching plate 581 is rotated to a position shown by the phantom line, whereby the paper is passed through the space between the guide plate 601 and the switching plate 581 by the intermediate roller 582 and the roller 583, further, passed through the space between the guides 570 and 572 and then sent into the unit 4 by the rollers 151 and 154.

On the other hand, in case of synthesis copying, the forked finger 600 is in a state shown by the phantom line, whereby the paper is passed through the space between the guide plate 596 and the guide plate 601 by the rotation of the intermediate roller 582 in the direction of the arrow E, sent to the inside of the copying apparatus main body 1 and then sent into the unit 4 in the same manner as described above.

Explanation has been made for the case of copying only one paper sheet. In case of the continuous copy mode, after setting all of the paper sheet completed with the single side copy on the intermediate tray and the pressure plate 595, and conducting jogger operation they are fed again one by one as described above in accordance with the two sided copy mode.

Figure 39:
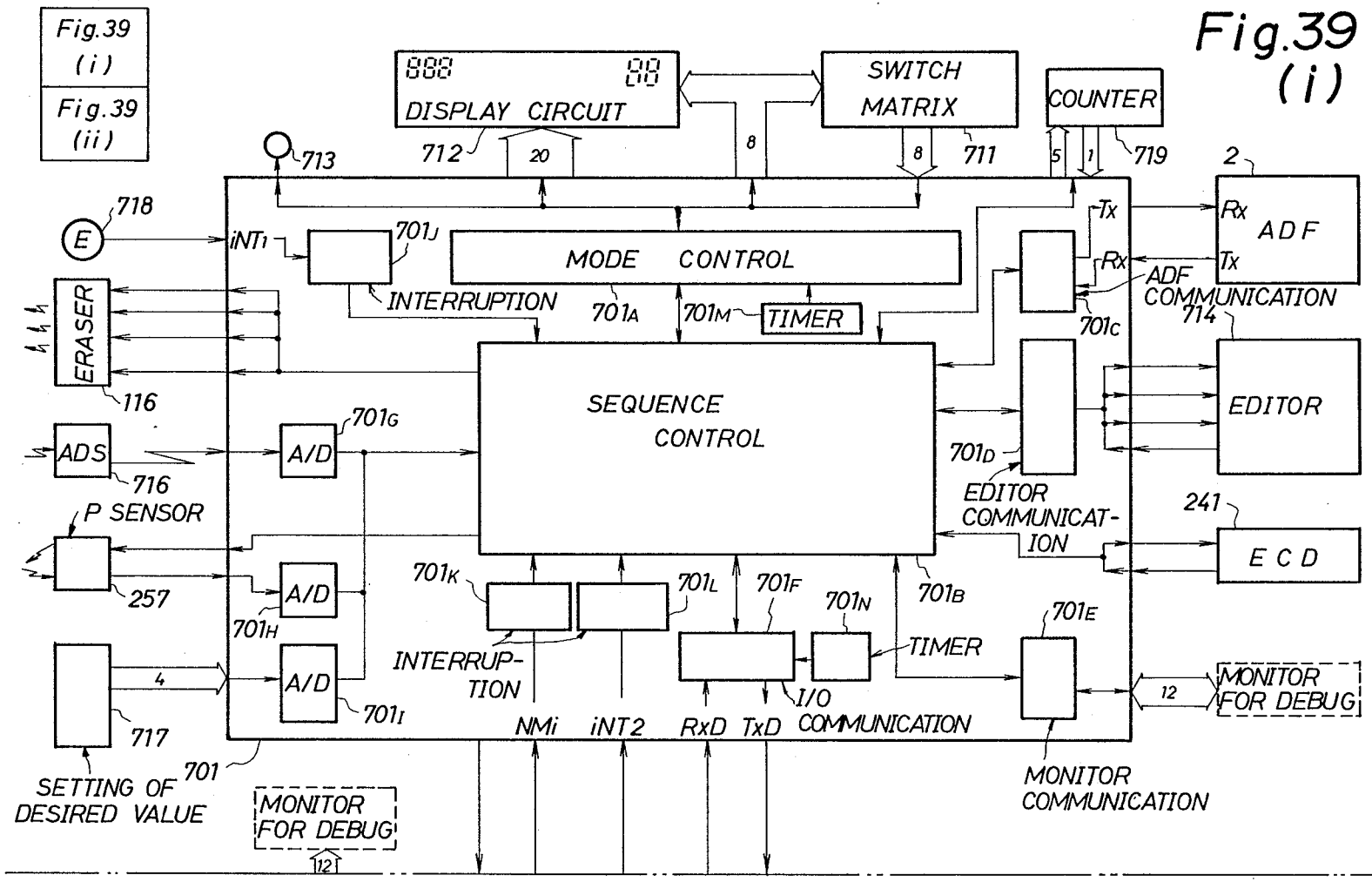
FIGS. 39 through 43 are a functional block diagram for the explanation of the control section in the copying apparatus, a block diagram for the system controller and I/O controller, a circuit block diagram for the AC drive circuit and a circuit diagram, respectively for the portion relevant to the editor control.
Figure 39:
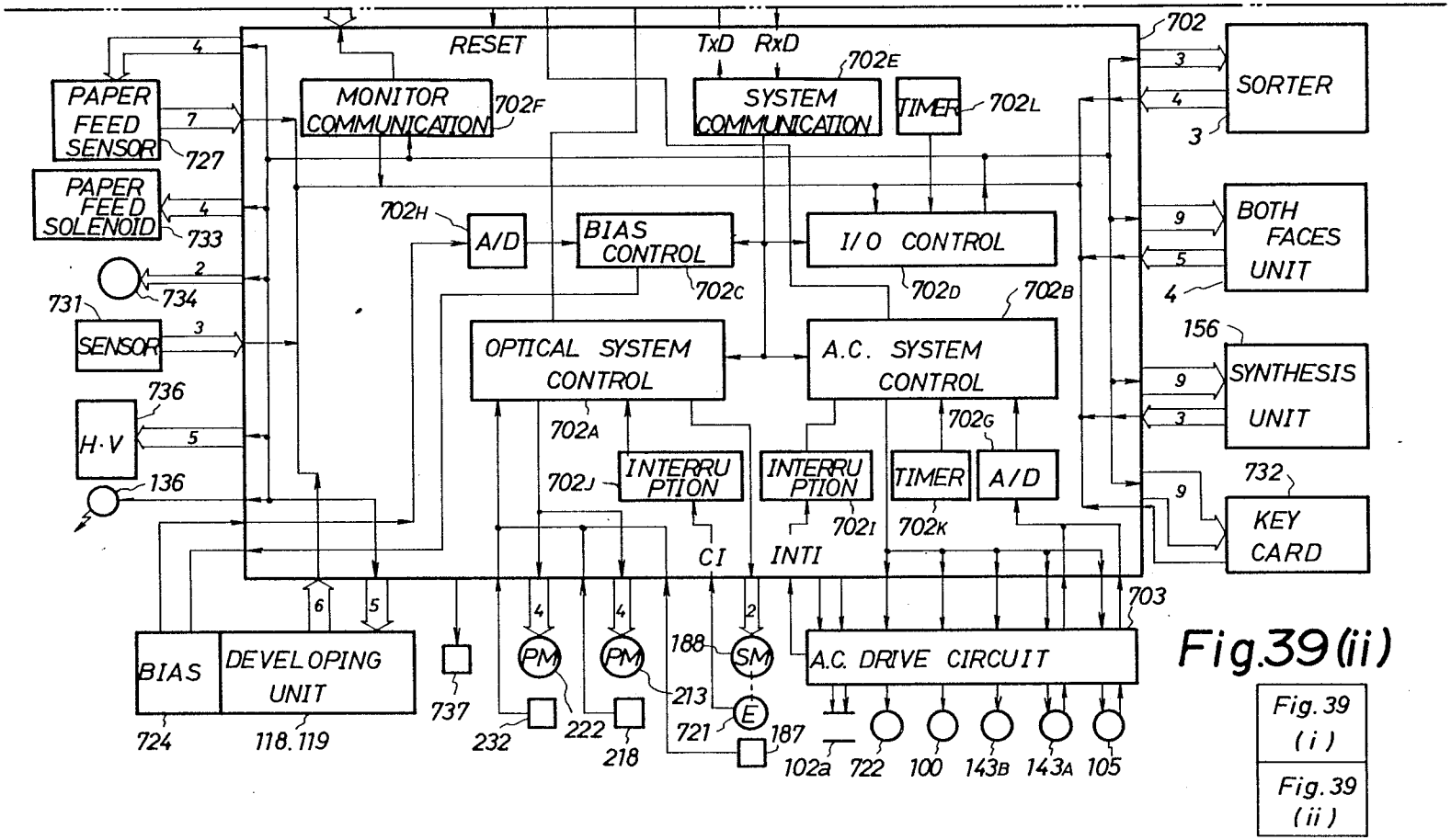

FIG. 39 is a block diagram showing the control section for the copying apparatus in view of its function.

The control section comprises a main controller 701 mainly in charge of the mode control and the sequence control for the copying process, an I/O controller 70-mainly in charge of the input/output control to each of the mechanical sections and an AC drive circuit 703 for driving the AC system.

The main controller 701 comprises a mode control section 701A for controlling the copy mode, a sequence control section 701B for controlling the sequence of the copy process, an ADF communication control section 701C in charge of the communication control, an editor communication control section 701D, a monitor communication control section 701E, an I/O communication control section 701F, A/D conversion sections 701G, 701H and 701I for the A/D conversion for input data, interruption request generating sections 701J, 701K and 701L for generating the interruption request to the sequence control section 701B, a timer 701M used in the mode control section 701A and a timer 701N used in the I/O communication control section 701F.

The mode control section 701A is adapted to fetch input information by scanning a switch matrix circuit 711 comprising various types of keys and a DIP switch, not illustrated attached to the main operation panel 7 and the sub-operation panel 8 at a predetermined time interval by using the timer 701M and set a copy mode according to the input information.

The mode control section 701A is adapted to scan a display circuit 712 and indicate the copy mode information and the data sent from the I/O controller 702 by way of the sequence control section 701B in each of the displays attached to the main operation panel 7 and the suboperation panel 8 and also actuate a buzzer 713 upon an input error occurring.

The sequence control section 701B is adapted to fetch the copy mode information set by the mode control section 701A, fetch the region information designated by the editor 714 by way of the editor communication control section 701D and, further, conduct transference of display information, etc. to and from the date printing display device (ECD) 241.

Further, the sequence control section 701B is adapted to fetch the data from the ADS circuit 716 subjected to A/D conversion in the conversion section 701G obtains the output signal from the photoreceiving element of the P sensor 257 subjected to A/D convers-on in the A/D conversion section 701H, and further obtains the desired lamp voltage, fixing temperature, developing bias voltage and ADS from the setting section 717 subjected to A/D conversion in the A/D conversion section 701I.

Further, the sequence control section 701B is adapted to receive an interruption request output from the interruption request generating section 701J on every input of clock pulses output from a drum encoder 718 attached to the photosensitive drum 101 according to the rotation of the photosensitive drum 101, receive an interruption request output from the interruption request generating section 701K on every input of a lead edge signal from the I/O controller 702 and, further, receive an interruption request output from the interruption request generating section 701L on receiving an input of the I/O down signal from the I/O controller 702.

Then, the sequence control section 701B is adapted to control the ADF 2 by way of the ADF communication control section 701C based on various obtained information as described above to feed an original document, to control the erase lamp 116 thereby eliminating the electric charges in the region on the photosensitive drum 101 which should not be transferred and, further, transfer that information required for the execution of the copy process such as charge, exposure, development, transfer, paper feeding, fixing, conveying, etc. (timing signal, magnification ratio, binding width, various setting data and various mode data) by way of the I/O communication control section 701F to the I/O controller 702 thereby executing a predetermined sequence control for the copy process.

The sequence control section 701B is adapted to store the total number of copy sheets, number of color copy sheets, and the number of copy sheets for each paper size into the counter 719 including a total counter, a color counter and a counter for each size, every time the copying process is executed.

Next, the I/O controller 702 comprises an optical system control section 702A for controlling the optical system, an AC system control section 702B for controlling the AC system, a bias control section 702C for controlling the developing bias voltage int he developing devices 118, 119, an I/O control section 702D for controlling the input/output for various input/output sections, a system communication control section 702E in charge of the data communication control relative to the main controller 701, and a communication control section 702F as a monitor, A/D conversion sections 702G and 702H, interrupting request generating sections 702I, 702J, a timer 702K used in the AC system control section 702B and a timer 702L used in the I/O control section 702D.

The optical system control section 702a is adapted to receive an interruption request output from the interruption request generating section 702J on every input of timing signals, etc. from the main controller 701, a detection signal from the scanner home position sensor 187 and clock pulses from the encoder 221 attached to the scanner motor 188, and drive the scanner motor 188 to control the movement of the scanner according to the interruption request.

Also, the optical system control section 702A is adapted to drive the mirror motor 213 to control the movement of the fourth mirror 110 and the fifth mirror 111 and drive the mirror motor 222 to control the movement of the through lens 109, based on the magnification ratio data from the main controller 701, detection signal from the mirror home position sensor 218 and the detection signal from the lens home position sensor 232.

The AC system control section 702B is adapted to control the lighting of the exposure lamp 105, ON-OFF for the two fixing heaters 143A, 143B attached to the inside of the fixing roller 143, driving of the main motor 100, driving of the fan group 722 such as a cooling fan and an optical system cooling fan not illustrated and the fan 382, etc. and application of a grid voltage onto the grid 102a of the electric charger 102 by way of the AC drive circuit 703 based on timing signals, etc from the main controller 701.

Also, the AC system control section 702B is adapted to control the lamp voltage applied to the exposure lamp 105 by way of the AC drive circuit 703, fetch an interruption request outputted from the interruption request generating section 702I upon every input of a zero cross pulse ZCP, and output an I/O down signal to the main controller 701, based on the interruption request for example, when the power source is down.

The bias control section 702C is adapted to control the developing bias voltage output from the bias circuit 724 based on the developing bias setting data, etc. from the main controller 701 and a bias voltage fedback from the bias circuit 724 of the developing devices 118, 119, after being subjected to A/D conversion in the A/D conversion section 702H.

The I/O control section 702D is adapted to obtain a detection signal for the size of a paper and a signal for the paper end detection by scanning a paper feed sensor group 727 such as the paper size sensor 412 and the paper end sensor 471, obtain various detection signals from a register sensor 728 disposed in front of the register roller 130 from a fixing discharging sensor 729 disposed in the fixing device 142 and from a discharge sensor 730 disposed in the paper discharging section and, further, obtain input information from the sorter 3, unit 4, conveying unit 156 and the key card 732.

Also, the I/O control section 702D is adapted to control, based on the various kinds of input information as described above, a solenoid group 443 such as a feed paper setting solenoid 733 and a paper feed solenoid for driving the feed roller 124, a clutch group 734 such as a register clutch for driving the regist roller 130 and an intermediate clutch for driving the intermediate roller 125, etc, a high voltage circuit (HV) 736 for applying high voltage to the electric charger 102, the transfer charger 131 and the separation charger 132, the charge elimination lamp 136, the sorter 3, unit 4, conveying unit 156 and the key card 732.

Further, said also controls the change of application voltage as well as the application timing of the high voltage for the high voltage circuit 736 for use int he transfer charger 131 and the separation charger 132, depending on whether the copy mode is the synthesis mode or not.

The I/O controller 702 is adapted to control a red filter 737 to be at either position, that is, a position on the optical path and a position retracted from the optical path.

Figure 40:
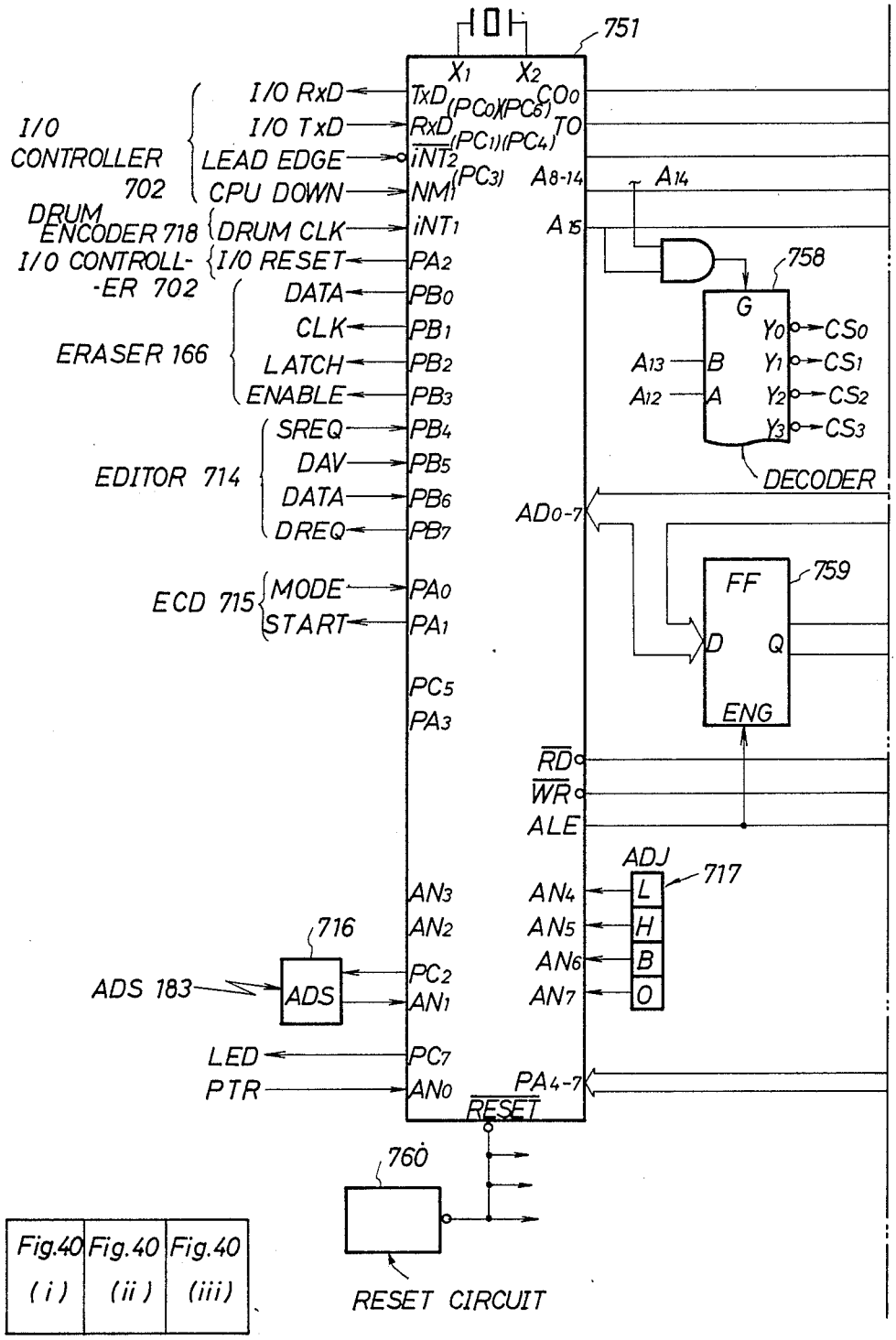
Figure 40:
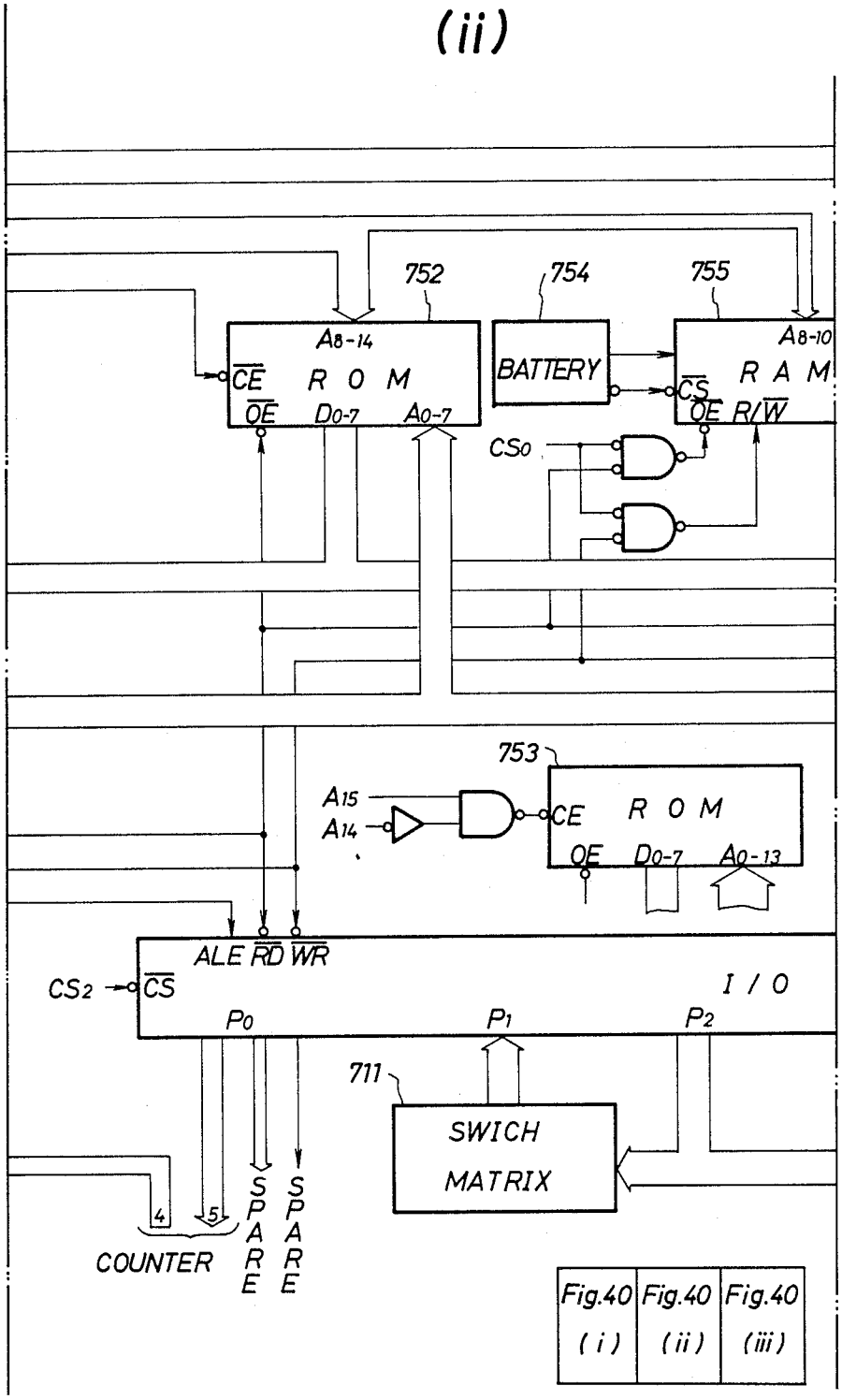
Figure 40:
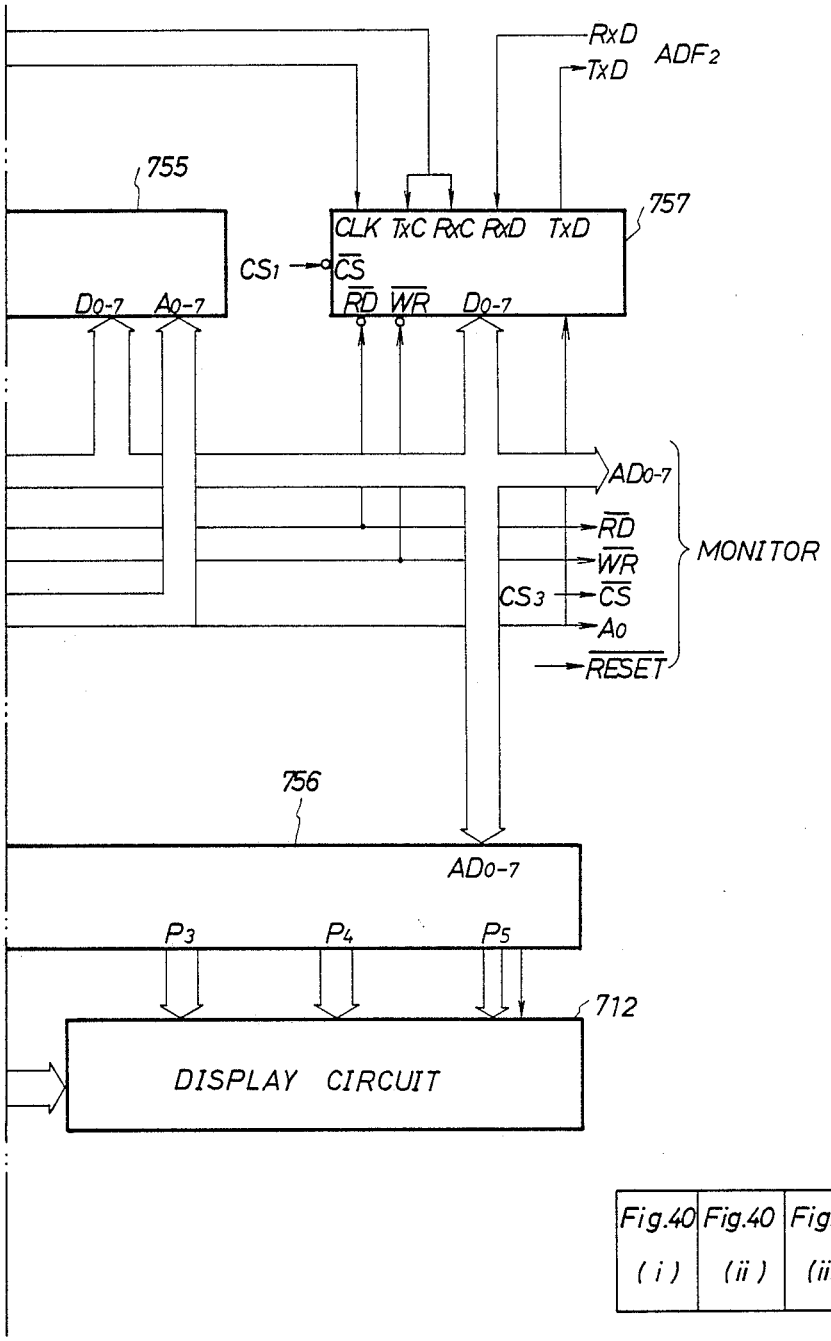
Figure 41:
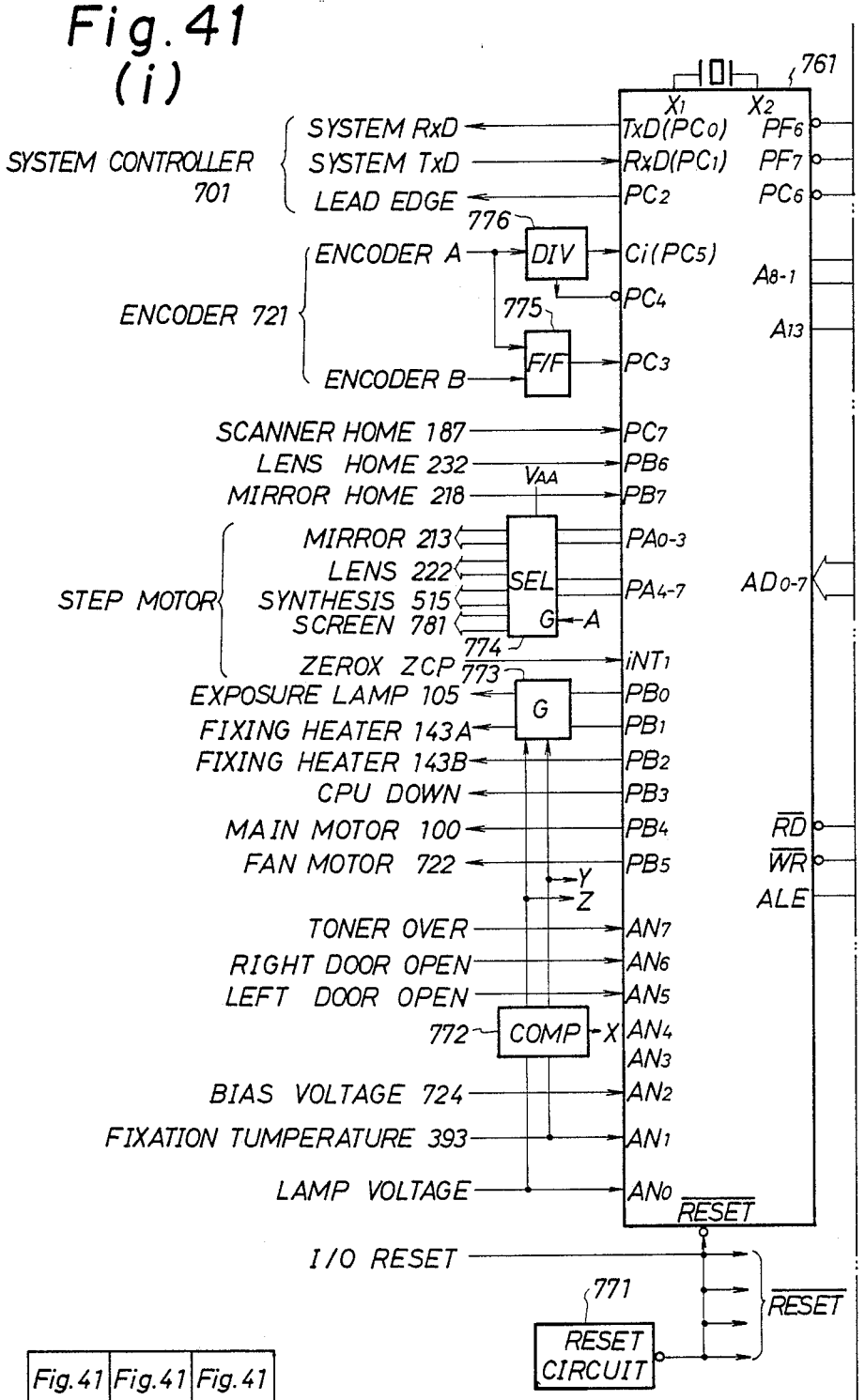

FIG. 40 and FIG. 41 are block diagrams illustrating the specific constitution of the main controller 701 and the I/O controller 702.

The main controller 701 comprises a microcomputer 751 having CPU, ROM, RAM and I/O, etc., two ROMs 752 and 753 having a capacity of 48K byte in total, a RAM 755 having a capacity of 2.25K byte supported by a battery 754, an I/O 756, a serial interface 757, an address decoder 758 for chip selection, a D type flip-flop circuit 759 and a reset circuit 760, etc.

The microcomputer 751 is in charge of the total control of the main controller 701, that is, data transfer mainly to and from the I/O controller 702, obtaining the drum clock form a drum encoder 718, data transfer to and from the eraser 116, editor 714 and the date printing display device (ECD) 241, reading of a detection signal from the ADS circuit 716, control of the light emitting element of the P sensor 257 (LED), obtaining the output signal from the photoreceiving element (photo-transistor), and obtaining setting information from the setting section 717 for setting the lamp voltage (L), fixing temperature (H), developing bias voltage (B) and ADS (O).

Also, the I/O 756 is adapted to deliver scan data to the switch matrix circuit 711 and the display circuit 712, obtain the input data and output the display data, while the serial interface 757 is in charge of the serial communication with the to ADF 2.

The I/O controller 702 comprises a microcomputer 761 including CPU, ROM, RAM, I/O, etc, ROM 762 of a capacity of 8K byte I/O 763, 764, a serial 765, an oscillator (OSC) 766, a drive circuit 767 for use in the scanner motor 188, a gate circuit 768 for the developing bias circuit 724, an address decoder 769 for use in chip selection, a D type flip-flop circuit 770, a reset circuit 771, a comparator (COMP) 772, a gate circuit (G) 773, a select circuit (SEL) 774, a flip-flop circuit (FF) 775 and a divisional circuit (DIV) 776, etc.

The microcomputer 761 is in charge of the entire control of the I/O controller 702 for example, the data transfer to and from the main controller 701 and the obtaining of phase A and phase B pulses from the encoder 721 of the scanner motor 188. The phase A and phase B pulses from the encoder 721 are used for the detection of the advance and return of the scanner 9by the phase relationship between the phases A and B), detection of the scanner speed and the detection of the scanner moving amount.

Further, the microcomputer 761 is adapted to obtain detection signals from each of the home position sensors 187, 232 and 218, to control the mirror motor 213, lens motor 225, as well as the jogger motor 515 for the jogger device 505 of the conveying unit, and the motor 781 for the both faces jogger device 587 disposed in the unit 4 and to read the zero cross pulse ZCP from the AC drive circuit 703.

The microcomputer 761 is further adapted for the ON-OFF control of the exposure lamp 105 and the fixing heaters 143A and 143B, driving of the main motor 100 and the blower 722, reading of detection signals from the toner over sensor 278, right door open sensor 783 and the left door open sensor 784, reading of the developing bias voltage from a developing bias circuit 724, reading of the detection signal from the fixing temperature sensor 393 and the reading of the lamp voltage from the AC drive circuit 703.

The I/O 763 is adapted for the delivery of various kinds of output signals to the paper feed solenoid 443, a paper feed scan 787, the developing devices 118 and 119, a register/intermediate clutch 733, the grid 102a of the electric charger 102, a high voltage circuit 736 for each of the chargers and the charge elimination lamp 267.

The I/O 763 is also in charge of the delivery and receiving of various kinds of detection signals to and from the color toner end sensor 345 disposed in the developing devices 118 and 119, a sensor 788 for detecting the kinds of color, a sensor 789 for detecting the paper feed from the tray 5, the paper size sensor 412, the paper end sensor 471, the paper discharge sensor 731, etc.

The I/O 764 is adapted for the delivery of output signals to the cassette lock solenoid 467, a red filter solenoid 737, a load 790 including the solenoid 543 and the paper discharge/switching member 143 for the conveying unit, etc., load 791 including a solenoid for switching the forked finger 600 of the unit 4, a solenoid for driving the re-feed roller 597, a solenoid for vertically moving the sponge roller 590, a solenoid for switching normal and reverse rotation of the intermediate roller 582, etc., sorter load 792 including key card 732, feed motor for sorter 3, etc.

Further, the I/O 764 is adapted also for receiving the detection signals from a synthesis sensor 793 comprising the jogger home position sensor 523, the paper sensor 546, etc. of the conveying unit 156, sensor 794 comprising a jogger home position sensor, a paper sensor, a discharge sensor, a double side open sensor in the conveying unit 4, key card 732 and sorter sensor 795 including a paper sensor or the like in the sorter 3.

Figure 42:
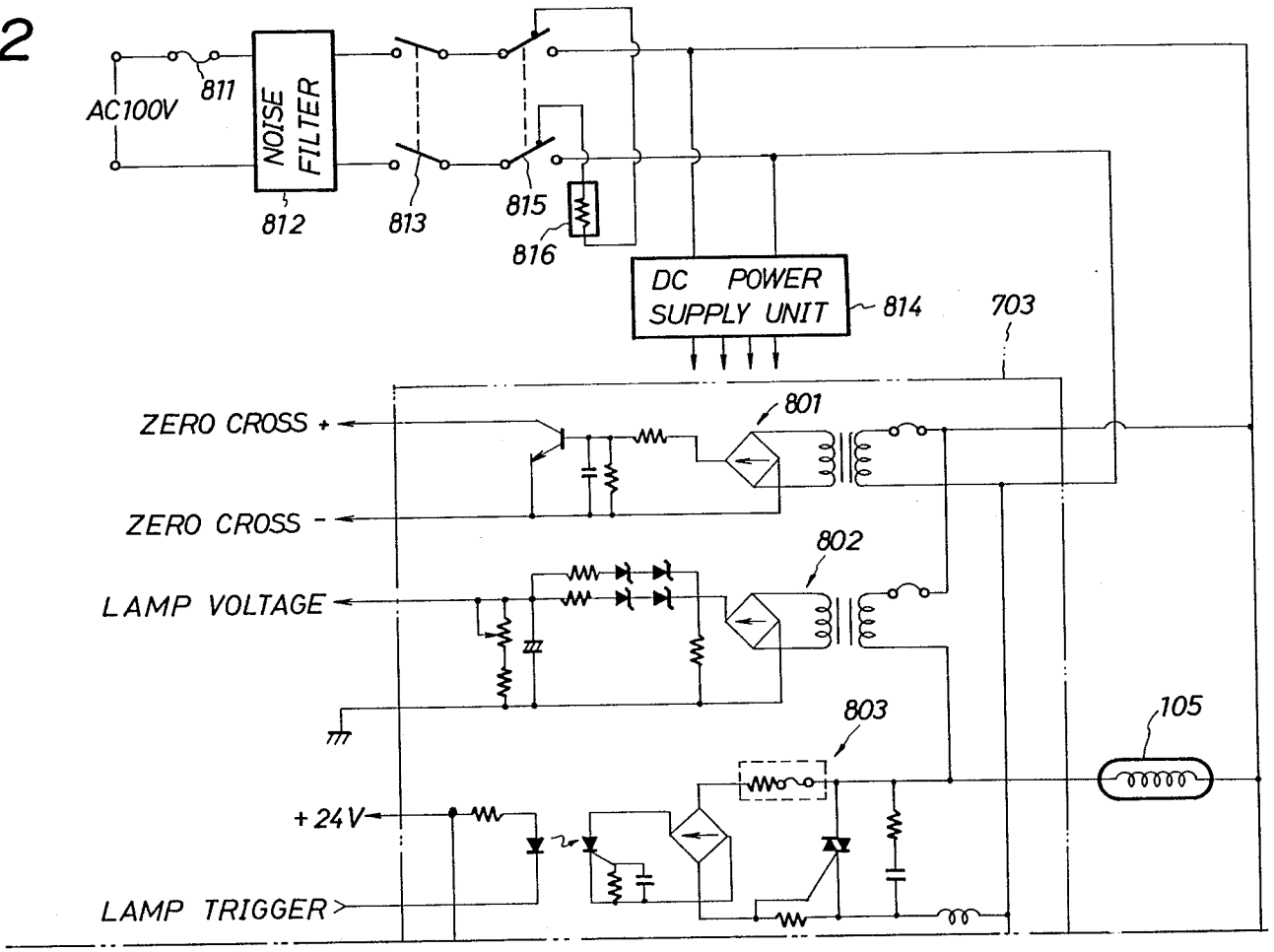

FIG. 42 is a block diagram illustrating a specific structure of the AC drive circuit 703 and the power source circuit.

The AC drive circuit 703 comprises a zero cross detection circuit 801 for detecting the zero cross point in the AC power source and thereby outputting the zero cross pulse, a lamp voltage detection circuit 802 for detecting the voltage of the exposure lamp 105 and out-putting a lamp voltage, a lamp driver 803 receiving a lamp trigger for turning the exposure lamp 105 to ON and OFF, a motor driver 804 receiving motor trigger for driving the main motor 100, heater drivers 805 and 806 receiving heater 1 trigger and heater 2 trigger for turning the fixing heaters 143A and 143B to ON and OFF, a relay circuit 807 receiving a blower speed signal for driving a discharge blower 722 at a low or high speed, photo-coupler 808 for turning a varister 809 connected to the grid electrode 102A of the electric charger 102 to ON and OFF, etc.

On the other hand, the power source circuit is adapted to eliminate noises by a fuse 811 and a noise filter 812 and then supplies power to the AC drive circuit 703 and each of AC loads by way of a cover open switch 813. Further, the power source circuit has a DC power source unit 814 for generating and outputting a DC voltage. Furthermore, the power source circuit supplies power by way of a switch 815 to a dew proof heater 816.

For improving safety, the power source circuit is so constituted that when a cover is opened the cover open switch 813 is turned OFF to disconnect both the AC and DC systems.

The I/O controller 702 is adapted to monitor the zero cross pulse ZCP from the A/C drive circuit 703 and delivers the I/O down signal to the main controller 701 if the succeeding zero cross pulse is not detected even after the elapse of a predetermined of time.

Figure 43:
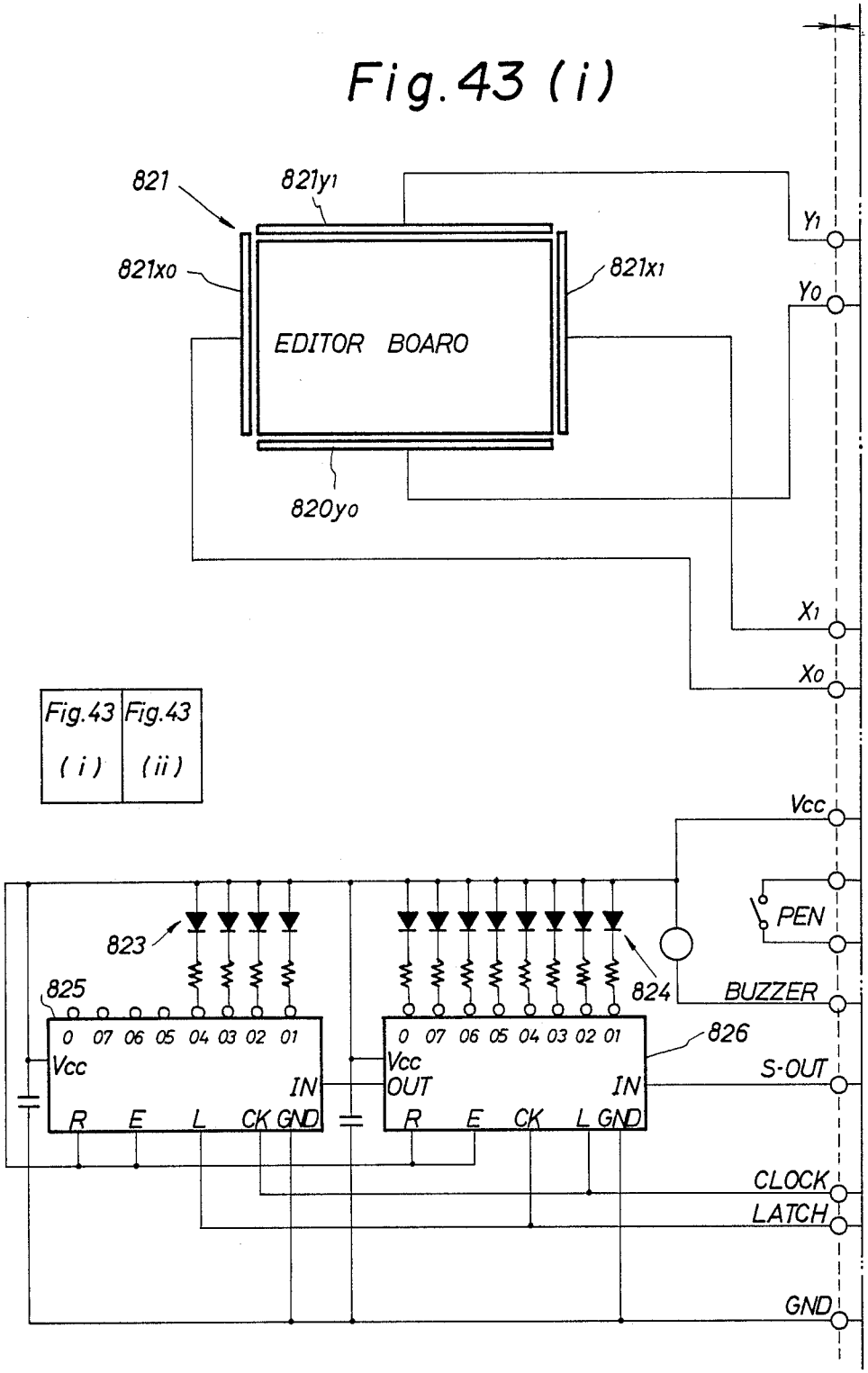

Then, the microcomputer 751 of the main controller 701 receives the interruption request by the I/O down signal and transfers all of the data to the RAM 755 backed up with the battery 754. FIG. 43 is a block circuit diagram illustrating a portion concerning the control of the editor 714.

The editor board 821 of the editor 814 comprises resistors and it has Y electrodes 821y1, 821y0 and X electrodes 821x1, 821x0 opposed with each other.

Further, the editor 714 has various operation keys not illustrated, for example, a trimming key and a masking key, display groups 823 and 824 each comprising light emitting diodes (LED) for displaying the operation state for each of the operation keys and shift registers 825 and 825 for supplying display signals to each of the display groups 823 and 824.

In case of performing edition by using the editor 714, the content of the edition is instructed by each of the operation keys and the area is designated by designation of points on the board 821.

Referring to the designation of the point, the microcomputer 751 of the main controller 701 at first turns the scan signal outputted from the port PC5 to "L". Since the scan signal is input by way of an inverter 831 to transistors 832, 833, both of the transistors 832, 833 are turned ON to apply a predetermined voltage (for example, +5 V) between the Y electrodes 821y1 and 821y0 of the editor board 821. At the same time, since the scanner signal is directly input to an analog switch 834, the analog switch 834 is turned OFF. On the other hand, since the scanner signal is also input by way of an inverter 835 to an analog switch 836, the analog switch 836 is turned ON. Further, since the scanner signal is input by way of the inverter 837 to transistors 838, 839, the transistors 838, 839 are turned OFF.

Accordingly, an analog voltage in accordance with the Y coordinate of the designated point on the editor board 821 is input by way of the analog switch 836 to the terminal $AN_2$.

After reading of the Y coordinate, the microcomputer 751 turns the scan signal to "H". Then, in the same way as described above, the transistors 832 and 833 are turned OFF, the analog switch 834 is turned ON, the analog switch 836 is turned OFF and the transistors 838, 839 are turned ON in this case.

Accordingly, an analog voltage in accordance with the X coordinate of the designated point on the editor board 821 is input by way of the analog switch 834 to the terminal $AN_3$.

In this manner, the coordinate position of the designated point of the editor board 821 can be read.

Description will now be made as to the operation of the preferred embodiment having thus been constituted.

Explanation will at first be made for the various types of adjusting modes and the operation procedures for the change of the mode in the copying apparatus.

1. Adjusting Mode

Display for the P sensor output voltage (1) Turn DIP switch ON.
(2) Set number "44" by ten key 15.
(3) Turn confirmation key 16 "ON"—VSP is displayed.
(4) Set number "0" by ten key 15—VSG is displayed upon depression.

Display for the P sensor input voltage (1) Turn DIP switch ON.
(2) Set number "43" by ten key 15.
(3) Turn confirmation key 16 "ON"—VSG is displayed.

ADS Data (1) Turn DIP switch ON.
(2) Set number "45" by ten key 15.
(3) Turn confirmation key 16 ON—ADS input voltage is displayed.
(4) Set number "0" by ten key 15—ADS input data are displayed upon depression.

Switching of toner supply mode (1) Turn DIP switch ON.
(2) Set number "30" by ten key 15.
(3) Turn confirmation key 16 ON.
(4) Set number "0" (P sensor control) or "1" fixed quantity by ten key 15.
(5) Turn ten key 16 ON.

Adjustment for the amount of toner supply (1) Turn DIP switch ON.
(2) Set number "31" by ten key 15.
(3) Turn confirmation key 16 ON—Present set value is displayed. (standard 30%)
(4) Set a number within "0" "3" by ten key 15. Relationship between the number and the set value is as follows. "0": 30%, "1": 15%, "2": 45% and "3": 60%.
(5) Turn ten key 16 ON.

Adjustment of P sensor bias voltage (1) Turn DIP switch ON.
(2) Set number "33" by ten key 15.
(3) Turn confirmation key 16 ON—Present set value is displayed (standard 500 V).
(4) Set a number within "0"~"3" by ten key 15. The relationship between the number and the voltage is as follows. "0":500 V, "1": 440 V, "2": 470 V, "3": 530 V.
(5) Turn ten key 16 ON.

Register adjustment (1) Turn DIP switch ON.
(2) Set number "36" by ten key 15.
(3) Turn confirmation key 16 ON—Present set value is displayed.
(4) Set optional number by ten key 15 Register can be adjusted every one step of 1 mm/15 and the center corresponds to the number "10".
(5) Turn ten key 16 ON.

Adjustment for longitudinal magnification (1) Turn DIP switch ON.
(2) Set number "38" by ten key 15.
(3) Turn confirmation key 16 ON—Present set value is displayed.
(4) Set a number within "6"~"14" by ten key 15. The relationship between the number and the set value is defined as below in which the number "10" corresponds to the center.

Set value : −0.8 −0.6 −0.4 −0.2 0 +0.2 +0.4 +0.6 +0.8 (mm)
Number 6 7 8 9 10 11 12 13 14

(5) Turn ten key 16 ON.

Adjustment for the blank portion at the top end.

(1) Turn DIP switch ON.
(2) Set number "38" by ten key 15.
(3) Turn confirmation key 16 ON—Present set value is displayed.
(4) Set number within "6"~"14" by ten key 15 The relationship between the number and the set value is defined as below in which the number "10" corresponds to the center.

Set value : −3.2 −2.4 −1.6 −0.8 0 +0.8 +1.6 +2.4 +3.2 (mm)
Number : 6 7 8 9 10 11 12 13 14

Adjustment for transverse magnification (1) Turn DIP switch ON.

(2) Set number "38" by ten key 15.

(3) Turn confirmation key 16 ON—Present value is displayed.

(4) Set a number within "6"~"14" by ten key 15 The relationship between the number and the set value is defined as below in which the number "10" corresponds to the center.

Set value : −0.8 −0.6 −0.4 −0.2 0 +0.2 +0.4 +0.6 +0.8 (mm)

Number : 6 7 8 9 10 11 12 13 14

Adjustment for color toner level (1) Turn DIP switch ON
(2) Set number "95" by ten key 15.
(3) Turn ten key 16 ON.
(4) Turn start key 14 ON.
(5) Confirm for control level.
red : Number "0"
green : Number "1"
blue : Number "2"
(6) Turn confirmation key 16 ON.

Adjustment for the color toner supply (1) Turn DIP switch ON.
(2) Set number "96" by ten key 15.
(3) Turn confirmation key 16 ON—Present set value is displayed.
(4) Set a number within "9"~"16" by ten key 15. The relationship between the amount of color toner supply and the number is as below and the number "10"is used as the standard.
Supply amount : 7 14 21 28 35 42 49 56
Number : 9 10 11 12 13 14 15 16
(6) Turn ten key 16 ON.

Increase of density (1) Turn DIP switch ON.
(2) Set number "97" by ten key 15.
(3) Turn confirmation key 16 ON—Present set value is displayed.
(4) Set number "0" (590 V) or "1" (620 V) by ten key 15.
(5) Turn ten key 16 ON.

Exposure lamp voltage (1) Turn DIP switch ON.
(2) Set number "40" by ten key 15.
(3) Turn ten key 16 ON.
(4) Set number "0" by ten key 15.
(5) Turn confirmation key 16 ON.
(6) Turn start key 14 ON.

Exposure lamp OFF (1) Turn DIP switch ON.
(2) Set number "40" by ten key 15.
(3) Turn confirmation key 16 ON.
(4) Set number "0" by ten 15.
(5) Turn confirmation key 16 ON.
(6) Turn start key 14 ON.

Exposure lamp voltage (1) Turn DIP switch ON.
(2) Set number "40" by ten key 15.
(3) Turn confirmation key 16 ON.
(4) Set number "3" by ten key 15.
(5) Turn confirmation key 16 ON.

Power pack C ON (1) Turn DIP switch ON.
(2) Set number by ten key 15.
(3) Turn confirmation key 16 ON.
(4) Turn clear stop key 17 ON.

Power pack C photographic mode ON (1) Turn DIP switch ON
(2) Set number by ten key 15.
(3) Turn confirmation key 16 ON.
(4) Turn clear stop key 17 ON.

Power pack T ON (1) Turn DIP switch ON.
(2) Set a number by ten key 15.
(3) Turn confirmation key 16 ON.
(4) Turn clear stop key 17 ON.

Power pack T : rear end switching mode ON (1) Turn DIP switch ON.
(2) Set a number by ten key 15.
(3) Turn confirmation key 16 ON.
(4) Turn clear stop key 17 ON.

Power pack D ON (1) Turn DIP switch ON.
(2) Set a number by ten key 15.
(3) Turn confirmation key 16 ON.
(4) Turn clear stop key 17 ON.

Power pack D : top end switching mode ON (1) Turn DIP switch ON.
(2) Set a number by ten key 15.
(3) Turn confirmation key 16 ON.
(4) Turn clear stop key 17 ON.

Charge elimination lamp ON (1) Turn DIP switch ON.
(2) Set a number by ten key 15.
(3) Turn confirmation key 16 ON.
(4) Turn clear stop key 17 ON.

Charge elimination lamp before transfer ON (1) Turn DIP switch ON.
(2) Set a number by ten key 15.
(3) Turn confirmation key 16 ON.
(4) Turn clear stop key 17 ON.

Size sensor data (length)

(1) Turn DIP switch ON.
(2) Set number "46" by ten key 15.
(3) Turn confirmation key 16 ON.

Size sensor data (width)

(1) Turn DIP switch ON.
(2) Set number "47" by ten key 15.
(3) Turn confirmation key 16 ON.

2. Check Mode

Fixing roller temperature (1) Turn DIP switch ON.
(2) Set number "41" by ten key 15.
(3) Turn confirmation key 16 ON.

Drum temperature (1) Turn DIP switch ON.

(2) Set number "42" by ten key 15.
(3) Turn confirmation key 16 ON

Bias voltage (1) Turn DIP switch ON.
(2) Set number "47" by ten key 15.
(3) Turn confirmation key 16 ON.

Color counter : R, G, B (1) Turn DIP switch ON
(2) Set number "98" by ten key 15.
(3) Turn confirmation key 16 ON.
(4) Set a number within "0"~"2" by ten key 15. The relationship between the number and the color counter is as below: "0":red counter, "1":green counter, "2":blue counter.
(5) Turn confirmation key 16 ON.

VR increase confirmation (1) Turn DIP switch ON.
(2) Set number "59" by ten key 15.
(3) Turn confirmation key 16 ON.

3. Mode change 1

Counter up/down (1) Turn DIP switch ON.
(2) Set number "21" by ten key 15.
(3) Turn confirmation key 16 ON.
(4) Set number "0" (up) or "1" (down) by ten key 15.
(5) Turn confirmation key 16 ON.

Discharge of odd number sheet upon ADF/both faces copy mode (1) Turn DIP switch ON.
(2) Set number "50" by ten key 15.
(3) Turn confirmation key 16 ON.
(4) Set number "0" (discharge) or "1" (not discharge) by ten key 15.
(5) Turn confirmation key 16 ON.

Selection of ADF (1) Turn DIP switch ON.
(2) Set number "51" by ten key 15.
(3) Turn confirmation key 16 ON.
(4) Set number "0" (not selected) or "1" (selected) by ten key 15.
(5) Turn confirmation key 16 ON.

Setting of magnification (1) Turn DIP switch ON.
(2) Set number "52" by ten key 15.
(3) Turn confirmation key 16 ON.
(4) Set number "0" (200%) or "1" (155%) by ten key 15.
(5) Turn confirmation key 16 ON.

Sorter MAX (1) Turn DIP Switch ON.
(2) Set number "53" by ten key 15.
(3) Turn confirmation key 16 ON.
(4) Set number "0" (not max) or "1" (max) by ten key 15.
(5) Turn confirmation key 16 ON.

Forward rotation (1) Turn DIP switch ON.
(2) Set number "54" by ten key 15.
(3) Turn confirmation key 16 ON.
(4) Set number "0" (not fwd. rotation mode) or "1" (fwd. rotation mode) by ten key 15.
(5) Turn confirmation key 16 ON.

Free run (1) Turn DIP switch ON.
(2) Set a number by ten key 15.
(3) Turn confirmation key 16 ON.

Optical free run (1) Turn DIP switch ON.
(2) Set number "11" by ten key 15.
(3) Turn confirmation key 16 ON.

Forming (1) Turn DIP switch ON.
(2) Set number "10" by ten key 15.
(3) Turn confirmation key 16 ON.

Entire lighting mode (1) Turn DIP switch ON.
(2) Set number "12" by ten key 15.
(3) Turn confirmation key 16 ON.

Jam detection OFF (1) Turn DIP switch ON
(2) Set number "55" by ten key 15.
(3) Turn confirmation key 16 ON.

Display of machine type No.

(1) Turn DIP switch ON.
(2) Set number "15" by ten key 15.
(3) Turn confirmation key 16 ON.

Compulsory reload (1) Turn DIP switch ON.
(2) Set a number by ten key 15.
(3) Turn confirmation key 16 ON.

4. Mode change 2

Buzzer sound switching (1) Set number "27 by ten key 15 while depressing confirmation key 16—mode is set upon releasing the confirmation key 16.
(2) Set number "0" (ON) or "1" (OFF) by ten key 15.
(3) Turn confirmation key 16 ON.

Auto reset (1) Set number "20" by ten key 15 while depressing confirmation key 16—mode is set upon releasing the confirmation key 16.
(2) Set number "0" (1 minute) or "1" (3 minutes), or "2" (zero) by ten key 15.
(3) Turn confirmation key 16 ON.

ADS adjust mode (1) Set to ADS mode
(2) Depress ADS 19 while depressing clear stop key 17—present status of set mode is displayed.
(3) Adjust by depressing DL key—Setting is completed by releasing the clear stop key 17.

Limitless paper feed (1) Set number "22" by ten key 15 while depressing confirmation key 16—Mode is set upon releasing key 16.

(2) Set number "0" (limitless mode) or "1" (release) by ten key 15.

(3) Turn confirmation key 16 ON.

Preheat upon auto reset mode (1) Set number "56" by ten key 15 while depressing confirmation key 16—Mode is set upon releasing confirmation key 16.

(2) Set number "0" (not preheat mode) or "1" (preheat mode) by ten key 15.

(3) Turn confirmation key 16 ON.

ADF/SADF preferential switching (1) Set number "25" by ten key 15 while depressing confirmation key 16—Mode is set upon releasing confirmation key 16.

(2) Set number "0" (ADF) or "1" (reversed ADF) by ten key 15.

(3) Turn confirmation key 16 ON.

ADF/manual preferential switching (1) Set number "23" by ten key 15 while depressing confirmation key 16—Mode is set upon releasing confirmation key 16.

(2) Set number "0" (ADF) or "1" (Manual) by ten key 15.

(3) Turn confirmation key 16 ON.

Selection of first feed or 1000 sheets tray (1) Set number "24" by ten key 15 while depressing confirmation key 16—Mode is set upon releasing confirmation key 16.

(2) Set number "0" (1000 sheets tray) or "1" (first feed) by ten key 15.

(3) Turn confirmation key 16 ON.

APS/AMS/ Clear preferential switching (1) Set number "57" by ten key 15 while depressing confirmation key 16—Mode is set upon releasing confirmation key 16.

(2) Set number "0" (APS) or "2" (clear) by ten key 15.

(3) Turn confirmation key 16 ON.

Sort/stack/clear preferential switching (1) Set number "58" by ten key 15 while depressing confirmation key 16—Mode is set upon releasing confirmation key 16.

(2) Set number "0" (clear), "1" (sort) or "2" (stack) set by ten key 15.

(3) Turn confirmation key 16 ON.

Explanation will next be made as to the operation timing of each of the copying mechanical portions of the copying apparatus main body 1.

Figure 44:
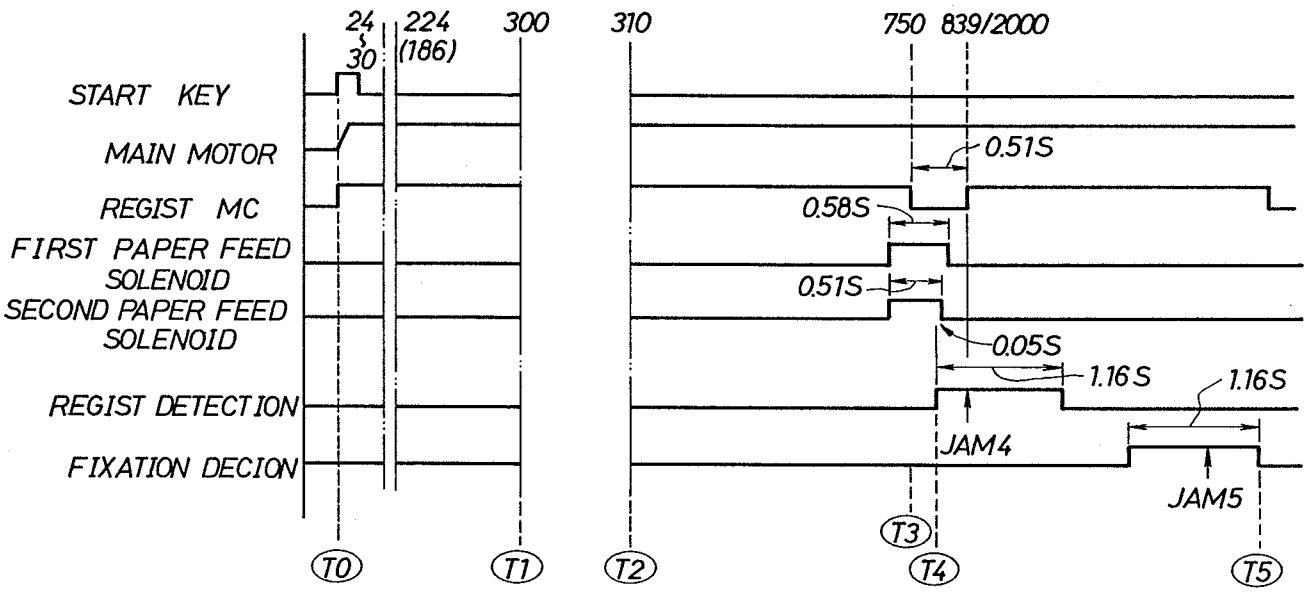

At first, the operation timing of the paper feed unit is explained referring to FIG. 44.

At first, the start key 14 is depressed (turned ON), at the Time T0 the main motor 100 is started to rotate and the register clutch is turned ON to rotate the regist rollers 130.

Then, between the TIME T1–T2, correction is made for the number of pulses in accordance with a selected feed cassette and, after the elapse of a predetermined of time from the depression of the start key 14, the feed solenoid 433 corresponding to the selected feed cassette is turned ON.

Then, the register clutch is turned OFF at the Time T3 after the elapse of time in accordance with the selected feed cassette has been elapsed after the depression of the start key 14.

Then, the feed solenoid 733 is turned OFF at Time T4 after a predetermined time has been elapsed from the arrival of the paper to the register detection sensor. Since the distance to the register detection sensor from the first (upper) paper feed cassette is different from that from the second (lower) paper feed cassette, the timings for turning the feed solenoid 443 to OFF for the first and second paper feed cassettes are also different each other. At the time T5, the fixing detection is turned OFF.

Figure 45:
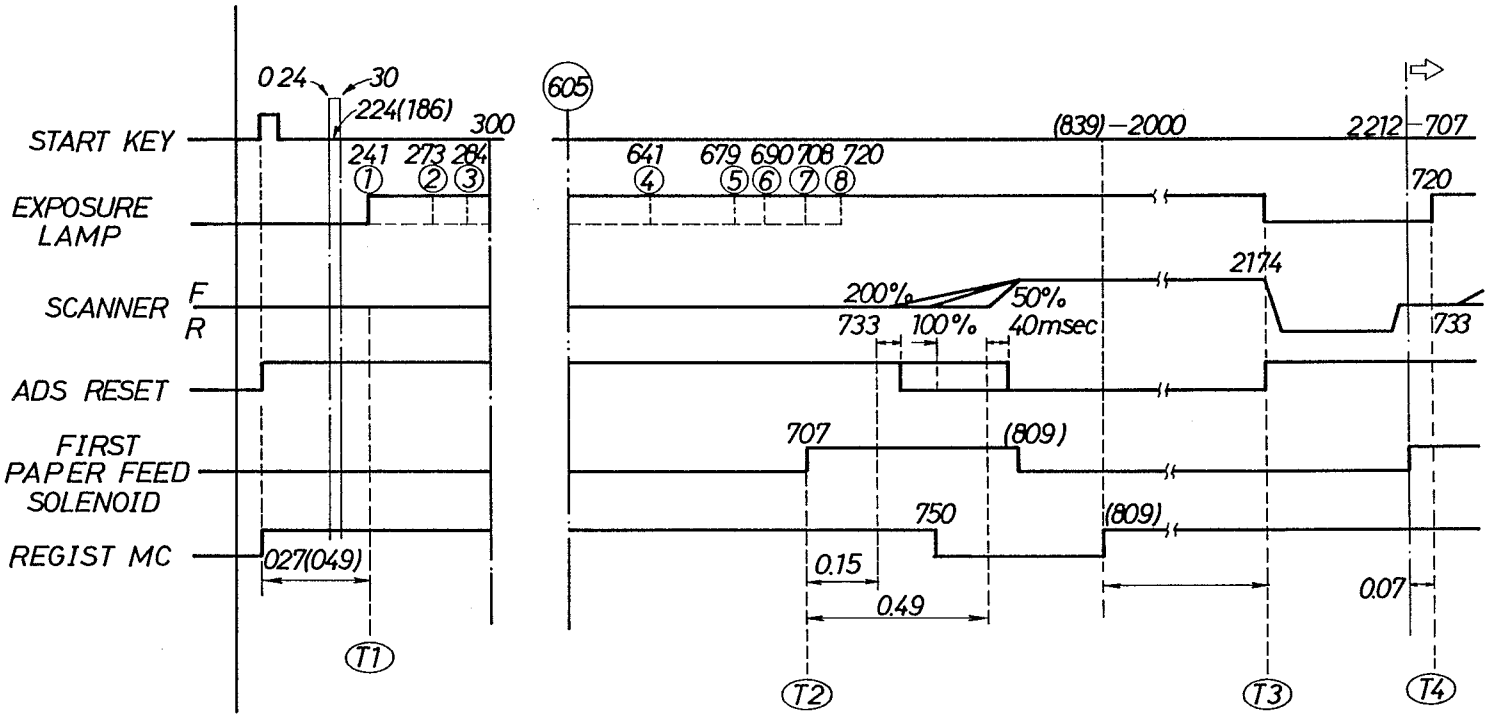

Next explanation will be made as to the operation timing of the optical system while referring to FIG. 45. The operation timing is explained for the case of A4 size paper repeat copy, ADS mode and using first paper feed cassette.

At first, the exposure lamp is lighted at time T1 after a predetermined time has elapsed after the turn-ON of the regist clutch.

Then, the scanner motor 188 is turned ON after the elapse of a predetermined time from time T2 at which the first paper feed solenoid 443 has been turned ON and the scanner 181 and 185 start to move. In the ADS reset mode, it is released after the elapse of a predetermined time from the start of the scanner.

Then, the scanner motor 188 rotates reversely at the time T3 after the elapse of a predetermined time from the turn ON of the regist clutch, to return the scanners and, at the same time, the exposure lamp 105 is turned OFF. The timing is different depending on the paper size.

Then, the exposure lamp 105 is turned ON for the next copy at the time T4 after the elapse of a predetermined time from the turn ON of the first feed solenoid 443.

Explanation will now be made regarding the abnormal detection display for the exposure system and the optical system.

1. Abnormal status in optical system

Status 11

The exposure lamp 105 is lighted or disconnected during stand-by.

Status 12

The exposure lamp 105 is lighted out of the range of 10 ±4 sec and the lamp timer is turned ON.

2. Abnormal status in optical system

Status 21

Scanner home position sensor 187 does not go "H" upon turning ON of the main switch.

Status 22

The scanner home position 187 does not go "L" upon turning ON of the main switch.

Status 23

No register start signal can be obtained even after an elapse of a predetermined time from the start of the scanner.

Status 24

The scanner home position sensor 187 does not indicate "H" even after a predetermined time has elapsed from the scanner start.

Status 25

It can not be judged that which of the phase A pulse and the phase B pulse of the encoder 721 is preceeded, that is, the moving direction of the scanner can not be judged.

Status 28

Upon moving the lens 109 from the equi-magnification/ enlargement position to the reduction position, the lens home position sensor 232 does not turn from "L" to "H" after the elapse of a predetermined time.

Status 29

Upon moving the through lens 109 from a reduction position to equi-magnification/enlargement position, the lens home position sensor 232 does not turn from "H" to "L" even after an elapse of a predetermined time after the lens motor 220 has been turned ON.

Status 2c

The speed of scanner motor 188 exceeds by 25% usual speed.

Status 2d

The speed of scanner motor 188 is 25% less than usual.

Status 2e

Phase A and phase B pulses are not inputted from the encoder 721 of the scanner motor 188.

Figure 46:
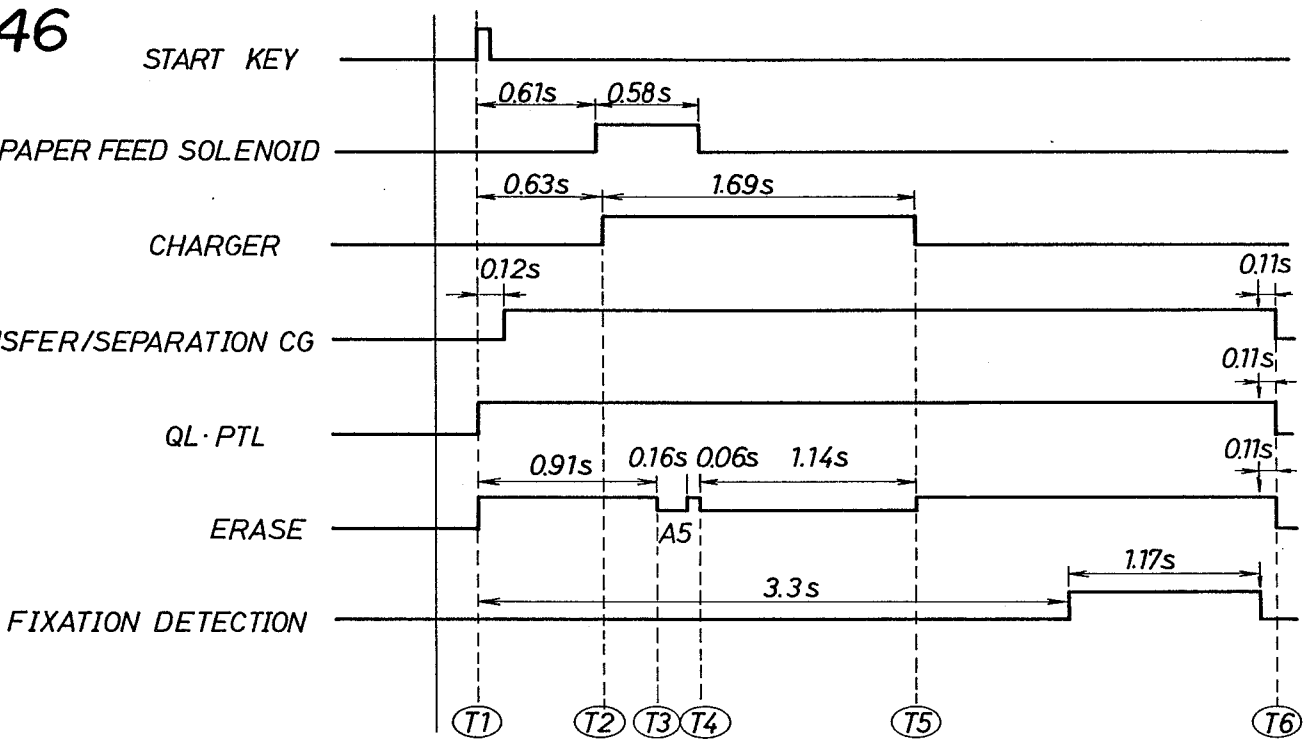

Then, explanation will be made to the operation timing of the chargers and the lamps around the drum while referring to FIG 46. The operation timing is explained for the case of the first paper feed cassette and A4 paper size.

At first, at the time T1 when the start key 14 is turned ON, the charge elimination lamp (QL) 136, the pre-transfer charge elimination lamp (PTL) 267 and the erase lamp 116 are lighted up.

Then, the electric charger 102 is turned ON at the time T2 after an elapse of a predetermined time depending on the selected feed cassette from the time T1 at which the start key 14 has been turned ON.

Erasing operation by the erase lamp 116 will now be explained.

Figure 47:
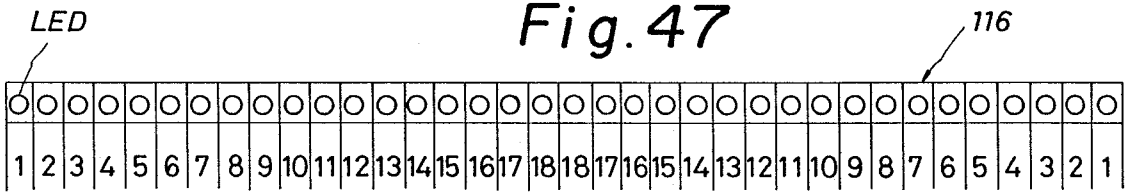

The erase lamp 116 comprises, for example, light emitting diodes (LED) arranged in the main scanning direction, for example, at 2.5 mm pitch (partially 5 mm pitch shown, for example, in FIG 47). The lighting for LED is controlled at a 2.5 mm pitch. Accordingly, for the portion where LEDs are arranged at 5 mm pitch, an identical LED is lighted by two drive signals. Then, in the case of side erasure, for example, LEDs situated at the side are lighted up in accordance with the width of erase. Further, in the case of masking or trimming, erasure in the main scanning direction is conducted by selectively lighting LED, while erasure in the sub-scanning direction is conducted by controlling the lighting time of LED and, accordingly, the necessary portion can be erased.

The erase lamps in the case of side erasure is controlled depending on the combination of the cassette size (paper size) data and the magnifying ratio data. In the case of equi-magnifying copy and enlargment copy, the lightening of the LED is controlled only by the cassette size data, and in case of reduction copying it is controlled by logic sum (OR) of the cassette data and the magnifying ratio data.

FIG. 48 shows the relationship between the cassette data and the state of LED 1~18, while FIG. 49 shows the relationship between the magnifying ratio data and the state of LED 1~18 respectively. In each of the drawings, "0" means a put out condition and "1" means a lighted up condition. Further, LED 12 represents all of the states for LED 12~18.

Figure 50:
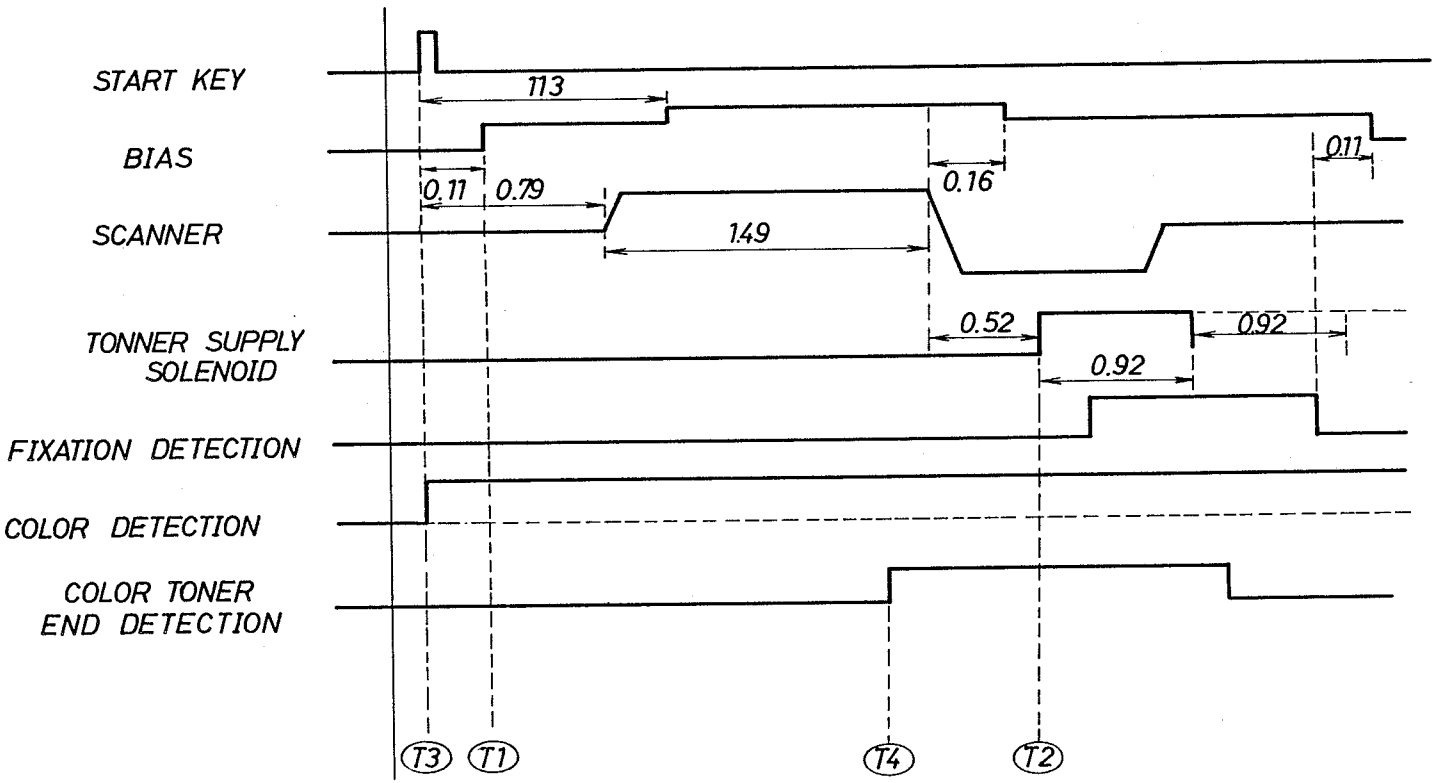

Explanation will next be made as to the operation timing of the developing device referring to FIG. 50.

The bias is turned ON at the time T1 after and elapse of a predetermined time from the time T3 at which the start key 14 has been turned ON. The bias in this instance has no concern with the notch of the density key 18 and the bias is constant. Then, after a lapse of a predetermined amount of time, the bias is set by the ADS data. Further, the bias is set so as to be constant again after the lapse of a predetermined time from the return of the scanner and, further, the bias is turned OFF after the lapse of a predetermined time from the time at which the fixing detection has been turned OFF.

If the toner density is lowered, for example, the toner supply solenoid is turned ON at the time T2 after the lapse of a predetermined time from the time at which the scanner has been returned return, and the state is continued till the next toner density check.

Further, the kind of the color toner in the color developing device 118 is displayed at the time T3 at which the start key 14 has been turned ON. The color toner end is detected by the vibration sensor as described above. The condition of the color toner end is indicated if the vibration continues for more than a predetermined time from the time T4 at which the vibration has started.

Explanation will now be made as to the control of the developing bias. The method of adjusting the developing bias includes a method of adjusting the bias together with a lamp voltage by a density key 18 as described above and a method of reading the background density of an original by ADS and adjusting the bias depending on the value thereof.

Figure 51:
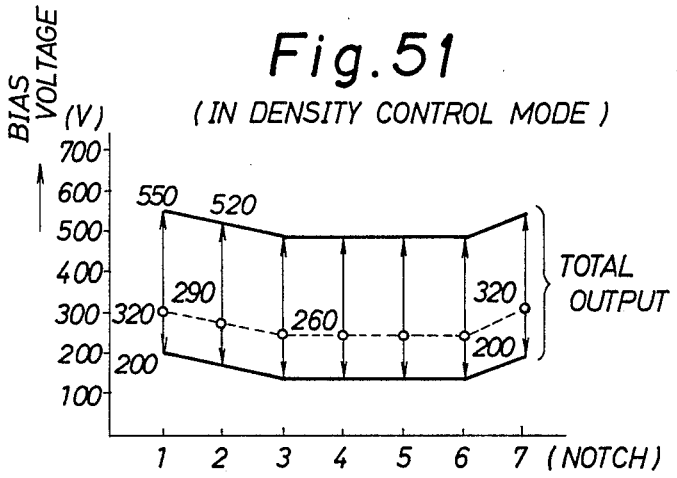
Figure 52:
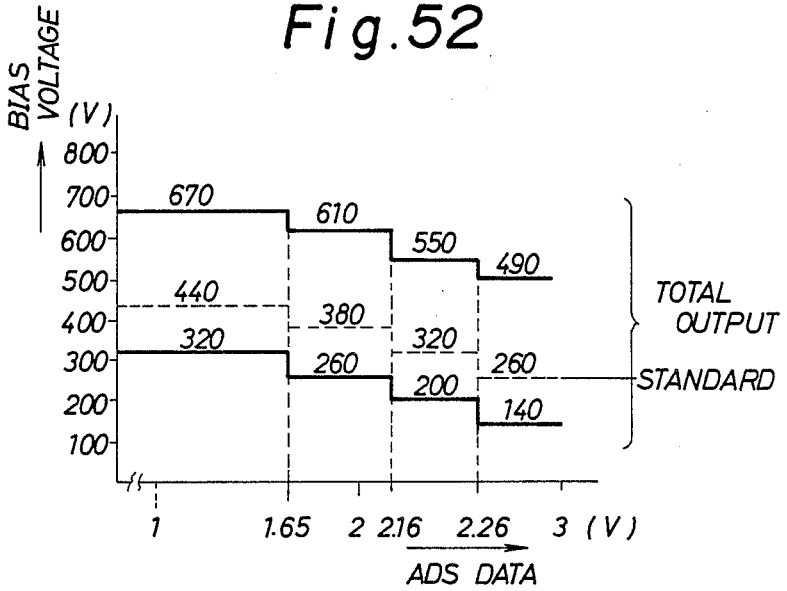

FIG. 51 shows the relationship between the notch set by the density key 18 and the bias voltage, and FIG. 52 shows the relationship between the ADS data and the bias voltage in the ADS mode. Further, FIG. 53 shows the relationship between the bias control voltage and the output voltage outputted from the I/O controller 702.

Figure 54:
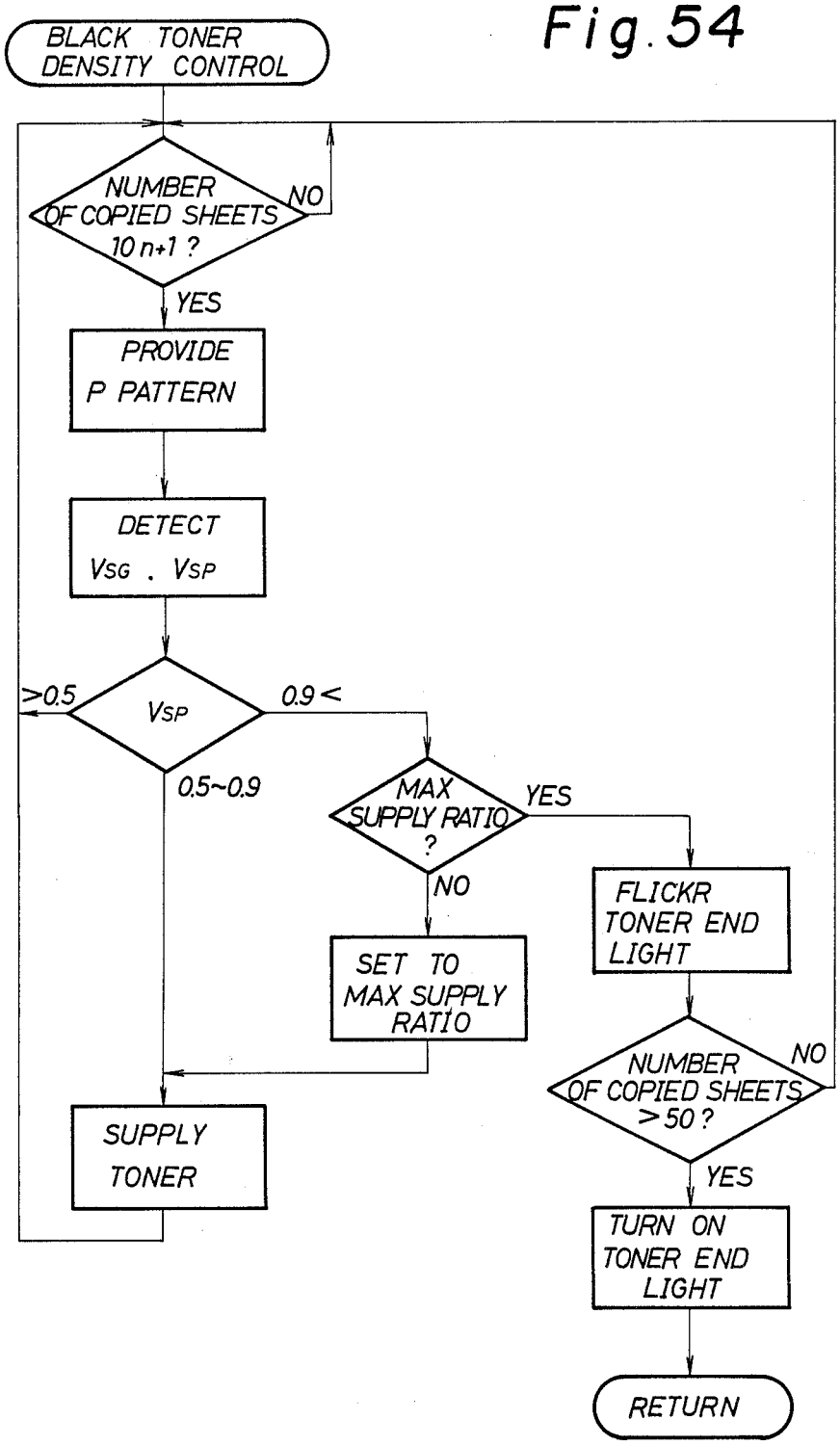

Explanation will next be made regarding the control of the toner density int he black color developing device 119 referring to FIG. 54. When ten sheets of copy have been completed from the previous check, that is, when the number of copy sheets reaches $(10n+1)$, a P sensor pattern image is formed, and the output VSG of the P sensor 257 obtained by sensing before and after the P sensor pattern image and the output VSP of the P sensor 257 obtained by sensing the P sensor pattern image are compared.

If $0.5>VSP$, the sequence returns directly to the process of the count of copy sheet number, whereas if $0.5\leqq VSP$, the sequence returns to the process of counting the copy sheet number after supplying toners.

Further, if $0.9<VSP$, it is judged whether the toner supply is at the maximum ratio or not and if it is not, the sequence returns to the process of counting the copy sheet number after supplying the toners.

On the other hand, if the toners are supplied at the maximum ratio, the sequence sets the toner end display to flicker and then judges whether the number of copy sheets has exceeded 50 or not. If the number of sheets is not more than 50, copy operation is continued, whereas if the copy sheet number exceeds 50, the toner end display is lighted up and the start key 14 is turned red (copy disable state).

For the color toners, if the output VSP of the P sensor 257 goes lower than a predetermined reference value (become dense), the supply of a constant amount is interrupted.

For the black toners, if the output VSG of the P sensor 257 goes lower than a predetermined reference value, it is judged that the control of the density is abnormal and the sequence transfers to the constant amount supply mode. For the color toners, when the VSG goes below other reference value, the toner supply amount is reduced to ½.

Figure 55:
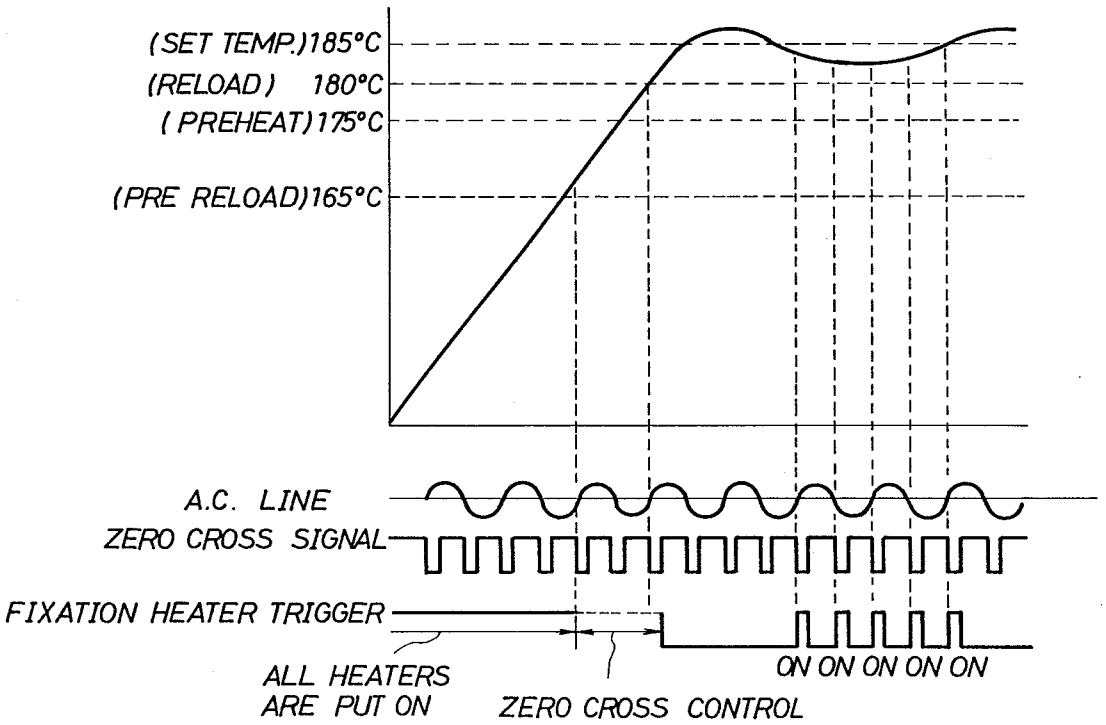

Next, explanation will be made as to the fixing temperature control referring to FIG. 55.

The fixing temperature is controlled by zero cross control. All of the heaters are turned ON irrespective of the zero cross pulses from the turning of the main switch till the pre-reload (165° C.) and when the pre-reload has been conducted, the temperature control transfers to the zero cross control and the heater is turned ON/OFF at the fall of the zero cross pulses so that it is controlled at a set temperature (185° C.).

For avoiding the effect on the scanner motor, etc., ON-OFF control is not conducted during movement of the scanner and the sequence transfers to the zero cross control again upon returning of the scanner.

Explanation will next be made regarding the abnormal status in fixing control.

Status 52

The thermal fuse is disconnected or the setting of the fixing unit is failed.

Status 53

The thermister abnormal signal turned from "H" to "L". AC system has to be interrupted.

Status 54

No reload signal comes from the operation section even after power relay is turned ON or even after an elapse of a predetermined time from the release of preheating Status 55

Thermister is abnormal and the fixing temperature has become 220° C.

Explanation will now be made as to the main key operation on the sub-operation panel 8.

(1) Size designation

After depressing the size designation key 33, input of the original length (for example, 100 mm) from the ten key 15 occurs. Then, after depressing the confirmation key 16, input of the designated size (for example, 64%) by ten key 15 occurs. Then, a copy in a designated size can be obtained.

(2) Photographic original

By depressing the photographic original key 36 once, since a red filter enters the optical path, a copy removed with red color can be obtained. When the photographic original key 36 is depressed again, the voltage applied to the grid 102*a* of the electric charger 102 is changed to the voltage for the photographic original.

(3) Edition

The edition is generally divided into three types, that is, shift a mode, trimming mode and masking mode.

The centering mode in the shift mode has a function of copying an original at the center of a paper. Further, explanation will now be made as to right/left shifting of the shift mode. At first, the shift key 61 is depressed to designate right shift or left shift mode. Then by imputting coordinates for two points (X1, Y1 and X2, Y2), with the point designation key 46, ten key 15, and confirmation key 16 a copy in which the designated region is shifted to the right or the left on the paper can be obtained.

Further, by depressing the erase key 58 to select the frame erase mode or book center erase mode and then inputting the width of erase with ten key 15 and confirmation key 16, a copy in which the frame or center portion is erased can be obtained.

Further, a copy applied with masking or trimming can be obtained by designating either one of the masking and trimming modes by depressing the mode designation key 50 and then inputting coordinates of two points of the region to be applied with masking or trimming with the ten key 15 and confirmation key 16.

It is also possible to conduct composite mode combining each of shift, erase, trimming, masking and synthesis modes.

While the descriptions have been made to a copying apparatus in the foregoing embodiment, this invention can be applied in the same manner to other printing apparatuses for example, laser printers. Obviously, numerous modifications and variations of the present invention are possible in light of the above teachings. It is therefore to be understood that within the scope of the appended claims, the invention may be practiced otherwise than as specifically described herein.

What is claimed is:

1. An image forming device having a mechanism for conducting variable magnification by moving mirrors and lenses, which comprises: an optical system including at least six mirrors and a lens wherein said lens is disposed downstream of a fourth and fifth mirror of said at least six mirrors;

a mechanism for moving said fourth and fifth mirror; and means for shifting said lens towards said fourth and fifth mirrors so as to change the magnification thereof between x2.0 and x0.5

2. The image forming device of claim 1, wherein said fourth and fifth mirrors are constructed integrally and are integrally movable.

3. The image forming device of claim 1, which comprises means for driving said lens and means for driving said fourth and fifth mirrors.

* * * * *

UNITED STATES PATENT AND TRADEMARK OFFICE

CERTIFICATE OF CORRECTION

PATENT NO. : 4,901,113

DATED : FEBRUARY 13, 1990

INVENTOR(S) : NOBORU SAWAYAMA, SHINICHI KAMIYAMA, HIDEO YUH, MASAYUKI TAKASHIMA, TADAYUKI SEKIYA

It is certified that error appears in the above-identified patent and that said Letters Patent is hereby corrected as shown below:

ON THE TITLE PAGE

The inventors should read --Tadayuki Sekiya--.

The foreign application priority should read --61-164831, filed July 15, 1986 in Japan--.

Signed and Sealed this

Seventh Day of April, 1992

*Attest:*

*Attesting Officer*

HARRY F. MANBECK, JR.

*Commissioner of Patents and Trademarks*